US009797076B2

(12) United States Patent
Khokar

(10) Patent No.: US 9,797,076 B2
(45) Date of Patent: Oct. 24, 2017

(54) 3D FABRIC AND A METHOD AND APPARATUS FOR PRODUCING SUCH A 3D FABRIC

(76) Inventor: Nandan Khokar, Gothenburg (SE)

( * ) Notice: Subject to any disclaimer, the term of this patent is extended or adjusted under 35 U.S.C. 154(b) by 0 days.

(21) Appl. No.: 14/387,351

(22) PCT Filed: Mar. 23, 2012

(86) PCT No.: PCT/EP2012/055240

§ 371 (c)(1),
(2), (4) Date: Jan. 7, 2015

(87) PCT Pub. No.: WO2013/139401

PCT Pub. Date: Sep. 26, 2013

(65) Prior Publication Data

US 2015/0111457 A1 Apr. 23, 2015

(51) Int. Cl.
*D04H 3/05* (2006.01)
*D04H 3/08* (2006.01)

(52) U.S. Cl.
CPC ..... *D04H 3/05* (2013.01); *D04H 3/08* (2013.01); *Y10T 442/643* (2015.04)

(58) Field of Classification Search
CPC ..... D04H 3/05
See application file for complete search history.

(56) References Cited

U.S. PATENT DOCUMENTS 3,095,338 A 6/1963 Romanin
3,818,951 A 6/1974 Greenwood
3,834,424 A 9/1974 Fukuta et al.
(Continued)

FOREIGN PATENT DOCUMENTS

EP 0236500 A1 9/1987
FR 2227748 A5 11/1974
(Continued)

OTHER PUBLICATIONS

International Search Report PCT/ISA/210 for International Application No. PCT/EP2012/055240 Dated Apr. 10, 2013.
(Continued)

*Primary Examiner* — Andrew Piziali

(74) *Attorney, Agent, or Firm* — Harness, Dickey & Pierce, P.L.C.

(57) ABSTRACT

A method and device are disclosed for producing 3D fabrics including yarns/tows that remain in pre-tensioned condition. Further, the method and device produce 3D fabrics with features that increase the mechanical performance of produced materials which are highly suited for composite materials and impact injury mitigation applications. The method and device also provide a simple, quick and compact arrangement to produce economically both uniaxial and multiaxial types of 3D fabrics with specific dimensions and shapes in 'middle-outwards' manner to reduce production time by half by arranging the set of axial yarns in zigzag fashion between oppositely facing supports. The method and device aid automated production of 3D fabrics and their direct packaging to eliminate contamination of produced 3D fabrics. A 3D fabric produced in this way is also disclosed. The 3D fabric includes yarns/tows that remain in pre-tensioned condition.

15 Claims, 36 Drawing Sheets

(56) References Cited

U.S. PATENT DOCUMENTS

| | | | | |
|---|---|---|---|---|
| 3,955,602 | A | | 5/1976 | King |
| 4,336,296 | A | | 6/1982 | Fukuta et al. |
| 4,518,640 | A | | 5/1985 | Wilkens |
| 4,872,323 | A | | 10/1989 | Wunner |
| 5,085,252 | A | | 2/1992 | Mohamed et al. |
| 5,137,058 | A | * | 8/1992 | Anahara ..... B29C 70/24 139/20 |
| 5,242,768 | A | | 9/1993 | Nagatsuka et al. |
| 5,270,094 | A | | 12/1993 | Anahara et al. |
| 5,327,621 | A | | 7/1994 | Yasui et al. |
| 5,343,897 | A | | 9/1994 | Sakatani et al. |
| 5,353,844 | A | | 10/1994 | Monget et al. |
| 5,435,352 | A | | 7/1995 | Yamamoto et al. |
| 5,449,025 | A | | 9/1995 | Weinberg |
| 5,465,760 | A | | 11/1995 | Mohamed et al. |
| 6,186,185 | B1 | | 2/2001 | Khokar |
| 6,315,007 | B1 | | 11/2001 | Mohamed et al. |
| 6,338,367 | B1 | | 1/2002 | Khokar |

FOREIGN PATENT DOCUMENTS

| | | | |
|---|---|---|---|
| SE | 9500309 | L | 8/1996 |
| WO | WO-9803712 | A1 | 1/1998 |

OTHER PUBLICATIONS

Written Opinion of the International Searching Authority PCT/ISA/237 for International Application No. PCT/EP2012/055240 dated Apr. 10, 2013.

* cited by examiner

3D FABRIC AND A METHOD AND APPARATUS FOR PRODUCING SUCH A 3D FABRIC

TECHNICAL FIELD

The inventions disclosed herein generally belong to the field of textiles. In particular, they pertain to an innovative method and device for manufacturing novel 3D fabric objects.

BACKGROUND

A large number of 3D fabric forming processes have been developed in the past 50 years, especially for producing textile reinforcements for manufacturing composite materials. A 3D fabric is defined as a single-fabric system (i.e. not stitched sheets/layers of fabrics), the constituent yarns/tows of which are supposed to be disposed in a three mutually perpendicular planes relationship. Accordingly, a 3D fabric can be produced using one or more sets of yarns.

Most methods aim to essentially arrange and integrate three sets of yarns/tows orthogonally, i.e. in XYZ (i.e. length, width and thickness) directions. Some methods additionally incorporate additional yarns in bias directions relative to fabric-length direction (whereby such 3D fabrics comprise five sets of yarns). Technically all such methods can be classified as 3D-weaving (U.S. Pat. Nos. 6,186,185 and 6,338,367) and non-woven "noobing" (EP 0236500, U.S. Pat. No. 5,465,760, WO 9803712, U.S. Pat. Nos. 6,315,007, 5,353,844, FR 2227748, U.S. Pat. Nos. 5,343,897, 5,449,025, 5,435,352, 5,327,621, 5,270,094, 4,336,296, 3,834,424, 5,137,058, SE 9500309, U.S. Pat. Nos. 5,242,768, 3,818,951, 5,085,252, 3,955,602, 4,518,640, 5,465,760, 5,270,094, 4,872,323etc.) types, as established by Khokar [1-3].

The main technical difference between the 3D-weaving and non-woven "noobing" processes resides in the fundamental technical fact that the shedding operation is foremost and indispensable for technical realization of the weaving process and woven (interlaced) material. Accordingly, the 3D-weaving process is technically realizable by employing only the dual-directional shedding operation (U.S. Pat. Nos. 6,186,185 and 6,338,367) to create sheds in fabric's thickness and width directions (compared with the conventional 2D-weaving process wherein the mono-directional shedding operation is employed to realize the process by creating a shed in only the fabric's width direction). It may be noted that exploitation of conventional 2D-weaving process for producing a 3D fabric does not make it the 3D-weaving process. This is because the 2D-weaving process remains identical whether producing 2D fabric or 3D fabric and both these types are composed of a set of warps interlacing with a set of wefts. In comparison, the 3D fabric produced by the 3D-weaving process is composed of a set of warps interlacing with two sets of mutually perpendicular wefts—one interlacing in fabric's thickness direction and the other in fabric's width direction. The non-woven noobing process, on the other hand, is realized without involving any shedding operation. As a consequence, the 3D fabrics producible by the 3D-weaving and the non-woven noobing processes respectively have the characteristic interlaced (woven) and non-interlaced (noobed) structures. However, this fundamental difference has been overlooked in the past and without any technical basis the noobing process was assumed and misrepresented as 3D-weaving until they were technically described, clarified and characterized by Khokar [1-3].

It is relevant here to give details in brief of the noobing process which is unique in that it produces only 3D fabrics. Unlike other fabric-forming processes the noobing process can neither produce 2D fabrics (such as woven, braided and knitted sheet fabrics) nor 2.5D fabrics (such as pile, plush and terry fabrics). The noobing process essentially involves binding a set of stacked unidirectional yarns (X), the orientation of which is usually in fabric's length direction, using two other sets of binding yarns (Y) and (Z). Each of these sets of binding yarns is oriented in the stacked unidirectional yarns' width direction (Y) and thickness direction (Z). The structural integrity of the 3D fabric is realized by cyclically binding the set of unidirectional yarns (X) with binding yarns (Y) and (Z). The binding yarns of the sets (Y) and (Z) connect with their respective directions' opposite exterior yarns of the stacked unidirectional yarns (X). The created bindings therefore occur at the surfaces/exteriors of the produced 3D fabric. The yarns of the sets (X), (Y) and (Z) occur linearly, or straight, between their respective directions' opposite surfaces of the produced 3D fabric. In another variant of noobing process, sets of yarns oriented in fabric's length (X), width (Y) and two bias (+/−β) directions are stacked and then bound by using another set of yarns (Z) which are oriented in the stacked yarns' thickness direction. Inclusion of the two sets of bias yarns (+/−β), which lie between the two longitudinal edges of the 3D fabric at an angle other than 90° with respect to the longitudinal edges, is done to improve the mechanical performance of the 3D fabric to meet application demands. As can be noted now, binding of one (uniaxial) or more (multiaxial) directionally oriented sets of stacked yarns is indispensable to the noobing process whereby the noobing process stands technically differentiated from the weaving, knitting, braiding and all known non-woven processes.

Accordingly, the former process type is referred to as the uniaxial noobing process and the latter is called the multiaxial noobing process (which is commercially employed to produce the so-called multiaxial non-crimp fabrics). The 3D fabrics produced by both these process types are henceforth respectively called uniaxial noobed fabric and multiaxial noobed fabric. Both these types of noobed fabrics are fundamentally a 3D fabric because they invariably comprise three and five sets of yarns (X, Y, Z in former and X, Y, Z and +/−β in latter) respectively, which are disposed in a three mutually perpendicular planes relationship. In either case, the longitudinal direction yarns (X) are supplied individually and bound into the 3D fabric directly. As all the constituent yarns of both the noobed fabric types occur linearly, i.e. without interlacing, intertwining and, interlooping, the structural integrity of the noobed fabrics comes from the bindings at its surfaces. Clearly, because noobed fabrics are technically different from woven, braided and knitted fabrics, the noobing process is also therefore technically unlike weaving, knitting, braiding and all known non-woven processes.

SUMMARY OF THE INVENTION

It is therefore an object of the present invention to provide a new type of noobed 3D fabric which at least alleviates the above-discussed problems of the prior art. This object is obtained by means of a 3D fabric and a method and apparatus for producing such a fabric, as defined in the appended claims.

According to a first aspect of the present invention, there is provided a method for producing a 3D fabric comprising the steps of:

laying first yarn in consecutive turns or convolutions in a first direction to form a zigzag or sinuous formation in a first plane, and in a plurality of superposed layers in parallel to said first plane;

laying second yarns in a second direction which is different from said first direction, whereby said second yarns at least partly extend between said superposed layers of first yarn, said second yarns thereby being arranged obliquely or parallel to the first plane of the first yarn;

laying, before or after the laying of the second yarns, third yarns in a third direction which is different from said first and second direction, whereby said third yarns at least partly extend between the turns or convolutions of said zigzag or sinuous formations of the first yarn, said third yarns thereby being arranged obliquely or essentially orthogonal to the first plane of the first yarn; and sequentially repeating the steps of laying second yarns, at least partly between said superposed layers of first yarn, and laying third yarns, at least partly in between said zigzag or sinuous formations of the first yarn.

The second yarns are preferably laid between said superposed layers of first yarn, thereby being arranged parallel to the first plane of the first yarn.

The third yarns are preferably laid between the turns or convolutions of said zigzag or sinuous formations of the superposed layers of the first yarn, and thereby being essentially orthogonal to the first plane of the first yarn.

Additionally or alternatively, at least one of the second and third yarns may extend obliquely in relation to the first plane.

The method further preferably comprises the step of applying a pressure to compress at least some of the laid yarns during or in between said sequential repetitions.

The repeated laying of the second yarns preferably occurs without cutting the second yarns, whereby the second yarns are folded to present integrated turns or convolutions for the laid second yarns.

The repeated laying of the third yarns preferably occurs without cutting the third yarns, whereby the third yarns are folded to present integrated turns or convolutions for the laid third yarns.

The first laying of the second yarns between said superposed layers of first yarns and of the third yarns in between said zigzag or sinuous formations of the first yarns are preferably made centrally in the superposed layers of first yarns, and wherein the sequential repetition of the steps of laying second yarns between said superposed layers of first yarns and laying third yarns in between said zigzag or sinuous formations of the first yarns are made on both sides of the first laid second and third yarns, thereby producing the 3D fabric from the middle and outwards.

The sequential repetition of the steps of laying second yarns between said superposed layers of first yarns and laying third yarns in between said zigzag or sinuous formations of the first yarns are preferably made simultaneously on both sides of the first laid second and third yarns, respectively.

The turns or convolutions of each of the sequentially laid second yarns are preferably laid in a common plane, and preferably a common plane being parallel to the first plane.

The turns or convolutions of each of the sequentially laid third yarns are preferably laid in a common plane, and preferably a common plane being orthogonal to the first plane.

The turns or convolutions of each of the sequentially laid second and/or third yarns may alternatively be laid in at least two different planes.

The method further preferably comprises the step of laying additional binding yarns in the fabric, said additional binding yarn being laid in a direction which is non-parallel to each of the first, second and third yarns, for formation of a multiaxial 3D fabric.

During production at least one of the laid first, second and third yarns are preferably continuously maintained in tensioned condition.

The step of applying a pressure to compress the laid yarns during or in between the sequential repetitions preferably comprises bunching or converging some of the first yarns by applying lateral pressure from four sides of the laid first yarns encircling the axial direction of the first yarns.

Additionally or alternatively, the step of applying a pressure to compress the laid yarns during or in between the sequential repetitions may comprise applying a pressure to compress at least some of the laid yarns in a direction essentially corresponding to the axial direction of the first yarn.

The first yarns are preferably laid in one of the fabrics length direction, width direction and thickness direction.

At least some of the turns or convolutions of the yarns in at least one direction may have different lengths.

The step of sequentially repeating the steps of laying second yarns and laying third yarns may be made so that one layer of second yarns and one layer of third yarns are repeatedly laid after each other in an alternating fashion.

The step of sequentially repeating the steps of laying second yarns and laying third yarns may be made so that more than one layer of second yarns and/or more than one layer of third yarns are laid immediately following each other, whereby the layers are laid in a semi-alternating fashion.

According to another aspect of the present invention, there is provided an apparatus for producing a 3D fabric comprising:

two sets of holders arranged spaced apart from each other, the holders being arranged to hold a first yarn laid in consecutive turns or convolutions in a first direction to form a zigzag or sinuous formation in a first plane, and in a plurality of superposed layers in parallel to said first plane;

a set of first yarn carriers moveable along paths at least partly between said superposed layers of first yarns for laying of second yarns along said paths in a second direction which is different from said first direction, said second yarns thereby being arranged obliquely or parallel to the first plane of the first yarns; and a set of second yarn carriers moveable along paths in a third direction which is different from said first and second direction, said paths at least partly extending between the turns or convolutions of said zigzag or sinuous formations of the first yarns for laying of third yarns along said paths, said third yarns thereby being arranged obliquely or essentially orthogonal to the first plane of the first yarns.

The first yarn carriers are preferably moveable along paths between said superposed layers of first yarn, the paths thereby being arranged parallel to the first plane of the first yarn.

The second yarn carriers are preferably moveable along paths between the turns or convolutions of said zigzag or sinuous formations of the superposed layers of the first yarn, and the paths thereby being essentially orthogonal to the first plane of the first yarn.

Additionally or alternatively, at least one of the first and second yarn carriers may be moveable along paths extending obliquely in relation to the first plane.

The apparatus further preferably comprises a yarn packing device, comprising packing elements being moveable towards each other to apply a pressure to compress at least some of the laid yarns, wherein said packing elements are moveable in a direction essentially corresponding to the axial direction of the first yarn.

The apparatus further preferably comprises a yarn converging device, comprising at least one pair of converging elements being moveable towards each other to apply a pressure to compress at least some of the laid yarns, wherein said converging elements are moveable in a direction essentially corresponding to the axial direction of the second and/or third yarns.

There may be provided two sets of first yarn carriers and two sets of second yarn carriers, the two sets being simultaneously operable on different sides of the fabric, thereby enabling production from the middle and outwards.

Each carrier of the set of first yarn carriers and/or the set of second yarn carriers may be arranged to be moved along different paths when being traversed back and through in relation to the first yarn, said paths all occurring in a common plane.

Additionally or alternatively, each carrier of the set of first yarn carriers and/or the set of second yarn carriers may be arranged to be moved along different paths when being traversed back and through in relation to the first yarn, said paths occurring in at least two different planes.

The apparatus preferably further comprises a set of third yarn carriers, for laying additional binding yarn in a direction which is non-parallel to each of the first, second and third yarns, for formation of a multiaxial 3D fabric.

The apparatus preferably further comprises a loop binding device arranged to bind loops of the first yarns, thereby creating closed end surfaces of the fabric.

Each set of holders are preferably arranged on a supporting structure, the two supporting structures being arranged to face each other. The holders preferably comprise hooks arranged on stems, wherein each stem is connected to one of the supporting structures. The hooks may be separable from the stems. The stems are further preferably arranged to allow passage of yarn carriers between them.

At least one of the supporting structures is preferably moveable in relation to the other supporting structure. The at least one moveable supporting structure may be moveable in a direction to and away from the other support structure. Additionally or alternatively, the at least one moveable supporting structure may be tiltable or rotatable in relation to the other support structure.

It is further preferred that at least one of the support structures is provided with extended slot openings, through which laying of yarn is enabled.

The apparatus further preferably comprises a yarn laying device, arranged to be moveable to lay the first yarn in a zigzag or sinuous formation between the two sets of holders.

The carriers of at least one of the first and second yarn carriers are preferably formed as narrow spools.

The carriers of at least one of the first and second yarn carriers are further preferably moved by positive control.

The holders of the two spaced apart set of holders are preferably arranged to hold the first yarn laid in consecutive turns or convolutions to form loops with curved ends.

According to still another aspect of the invention, there is provided a 3D fabric comprising:

at least one first yarn laid in essentially parallel turns or convolutions in a first direction and in a first plane, and in a plurality of superposed layers in parallel to said first plane, wherein adjacent turns or convolutions are either connected to each other, or cut apart at the ends;

second yarns laid in a second direction which is different from said first direction, whereby said second yarns at least partly extend between said superposed layers of first yarn, said second yarns being arranged obliquely or parallel to the first plane of the first yarn, each of said second yarns being a continuous string arranged in consecutive turns or convolutions to form a zigzag or sinuous formation; and third yarns laid in a third direction which is different from said first and second directions, whereby said third yarns at least partly extend between the turns or convolutions of the first yarn and in between the turns or convolutions of said zigzag or sinuous formation of the second yarns, said third yarns thereby being arranged obliquely or essentially orthogonal to the first plane of the first yarn, each of said third yarns being a continuous string arranged in consecutive turns or convolutions to form a zigzag or sinuous formation;

wherein a majority of the turns or convolutions of the third yarns are laid so that at least two turns or convolutions of the first yarn in each layer are provided between each pair of adjacent turns or convolutions in each of the third yarns.

The second yarns are preferably laid between said superposed layers of first yarn, thereby being arranged parallel to the first plane of the first yarn.

The third yarns are preferably laid between the turns or convolutions of said zigzag or sinuous formations of the superposed layers of the first yarn, and thereby being essentially orthogonal to the first plane of the first yarn.

Additionally or alternatively, at least one of the second and third yarns may extend obliquely in relation to the first plane.

At least one first yarn is preferably laid as a continuous string in consecutive turns or convolutions to form a zigzag or sinuous formation in a first plane, and in a plurality of superposed layers in parallel to said first plane.

The 3D fabric further preferably comprises additional second yarn laid below or on top of the superposed layers of first yarns, whereby said additional second yarn is enclosed by the third yarns.

The 3D fabric preferably further comprises additional third yarn laid beside the columns formed by the second yarn, whereby said additional third yarn is enclosed by the second yarns.

At least one of the first, second and third yarns are preferably being maintained in a pre-tension or pre-stressed state.

All surfaces of the fabric are preferably closed surfaces.

The turns or convolutions of each of the second yarns may be laid in a common plane, said plane preferably being parallel to the first plane.

Additionally or alternatively, the turns or convolutions of each of the third yarns may be laid in a common plane, said plane preferably being orthogonal to the first plane.

Additionally or alternatively, at least some of the turns or convolutions of each of the second and/or third yarns may be laid in at least two different planes.

The 3D fabric further preferably comprises additional binding yarns in the fabric, said additional binding yarns being laid in at least one direction which is non-parallel to each of the first, second and third yarns, thereby providing a multiaxial 3D fabric.

The orientation of first yarns may be in one of the fabrics length direction, width direction and thickness direction.

The first yarn(s) may be of a first material, and wherein at least one of the second and third yarns of a second material, said second material being different from said first material.

In one embodiment, the first yarn(s) is of a first material, the second yarns are of a second material, and the third yarns are of a third material, wherein said first, second and third material are different from each other.

At least one of the first yarn(s), second yarns and third yarns preferably have consecutive turns or convolutions being of different lengths.

The 3D fabric may exhibit different transmission properties in different directions, the property being related to at least one of: thermal conductivity, electrical conductivity, sound conductivity, light conductivity and magnetic conductivity.

The 3D fabric may exhibit different mechanical properties in different directions, the property being related to at least one of: compressive, tensile, bending, twisting and shearing properties.

The 3D fabric may have different abrading or wearing properties exhibited in different areas or sections of the fabric.

Two of the edges of at least one of the surfaces may be non-parallel.

Additionally or alternatively, at least two oppositely arranged surfaces of the fabric may be non-parallel.

At least one surface of the fabric may be curved.

The yarns in the fabric may be laid in such a way that at least one of a recess, slot, taper, hole or projection is formed in the fabric.

The fabric may comprise carriers of a dischargeable chemical formulation to function as either a crack sealant or indicator of damage in composite material and injury mitigation material.

The fabric may comprise a medical formulation, said medical formulation being at least one of: a healing agent, an anti-bacterial agent, a germicidal agent, a bodily discharge agent, a fluid neutralizing agent, an absorbing agent, a blood coagulation agent, a time dependent agent and a pressure dependent agent.

At least some of the yarns may be fusible, stretchable or malleable, to render the fabric to either be split-resistant, conform to or retain a certain shape or form a composite material.

At least some of the yarns may occur in a non-linear path about its longitudinal axis.

At least two adjacent surfaces may be non-orthogonal.

According to still another aspect of the present invention, there is provided a composite material comprising a 3D fabric of the above-discussed type.

According to still another aspect of the present invention, there is provided an injury mitigation protective material comprising a 3D fabric of the above-discussed type.

The inventions disclosed herein uniquely reside in the fields of both uniaxial and multiaxial noobing processes and corresponding noobed fabrics and fabric-objects.

On the basis of the foregoing technicalities the inventions disclosed herein technically relate to noobing process and noobed fabrics, both uniaxial and multiaxial types, which are herewith commonly referred to as 3D fabrics or noobed fabrics or 3D fabric objects. For ease of explaining and describing the various aspects of the inventions, a 3D fabric as used in the context of this application is hereby not limited to being only of a traditional continuous-length form but it is also considered and represented as a 3D fabric object in the form of a cuboid because 3D fabric objects can be produced in limitless forms/shapes. Accordingly, the inventions disclosed herein are neither limited to continuous-length 3D fabric and cuboid form of 3D fabric object, nor to production of only 3D fabric object of cuboid form.

Further, it may be noted that the term yarn(s) is representatively used to express a number of fibres, either of continuous or discontinuous types and either mono or multi filament types, that are either twisted or non-twisted. Such yarn/s also include and represent tows, blended yarns, flat yarns, fibrous tapes, sheathed fibre bundles, strands, twines, co-mingled yarns, prepreg tows etc.

The zigzag or sinusoidal laid yarns have certain bends/turns/convolutions which form the loops. In the context of the present application, the terms bend/turn/convolution is used to indicate one leg of such loops, whereby a full loop, going forth and back, comprises two bends, turns or convolutions. Thus, one bend, turn or convolution is e.g. formed each time a yarn carrier is traversed a manufacturing path in one direction.

Mere arrangement of yarns/tows in XYZ directions, and also additionally in bias directions, as taught by the existing methods are now considered to be inadequate for engineering the mechanical properties or mechanical performance of composite materials, particularly those required for primary load bearing applications. For producing high performance composite materials it is becoming increasingly necessary now to have a 3D fabric of required defined dimensions and shapes comprising at least yarns/tows of one of the required directions X, Y, and Z being inherently maintained in tension, i.e. in pre-stressed or pre-tensioned condition, so that the properties of the constituent fibres get highly/fully exploited and that during matrix impregnation process these yarns/tows do not lose their linearity under impregnation forces (buckling) and thereby cause improper fibre displacement and orientations, improper distribution of fibres and matrix and hence degradation of the properties of the final composite materials.

The existing 3D fabrics do not have/provide any built-in mechanism to assuredly maintain linearity of constituent yarns/tows of any direction. This is because presently there is no process available that enables production of a 3D fabric with its constituent yarns of any direction remaining/existing in a pre-tensioned condition. As a consequence of a 3D fabric not comprising yarns that exist in tension, the linearity of constituent yarns/tows gets disturbed and misaligned due to buckling under matrix impregnation pressure whereby matrix-rich and fibre-rich regions are created and the mechanical properties of the produced composite materials tend to become relatively lower. Such composite materials are not well-suited particularly for manufacturing primary load bearing components/products.

A 3D fabric having inherently pre-stressed or pre-tensioned yarns/tows is also needed in applications that are required to bear quickly high energy impacts, such as those arising from ballistic hit and blast wave. Otherwise, the yarns/tows will have to first generate sufficient tension within the fabric (for example through yarn-to-yarn friction which necessitates some slippage of yarns and hence fabric's buckling) before being able to absorb/take the impact's load. A high energy impact situation demands an equally quick response from the 3D fabric for not only absorbing energy but also the shock associated with it as the shock can at times prove more lethal/fatal than the impact itself. A 3D fabric without its yarns/tows inherently being in pre-tension would be obviously relatively less effective compared with the one that has its yarns always in a tensioned state. Applications for 3D fabrics incorporating yarns/tows that are inherently in a pre-tensioned state include impact injury mitigation protective wears, wall panels and coverings for vehicles, as well as explosive disposal mitigation sheets/covers, besides strengthening new and heritage buildings, bridges etc. Composite materials incorporating a 3D fabric composed of yarns/tows that exist inherently pre-stressed or pre-tensioned would also perform well in said high energy impact applications as also in the fields of transportation (aerospace, aeronautical, automotive, shipping etc.), sports equipment, medical, industrial engineering etc.

Apart from the above indicated important drawback of the existing 3D fabrics, they have at least three other inadequacies as well. First, in general, they do not have at least some of the yarns/tows that float with certain linear length on the fabric's surface/s, and in particular, in only certain required area/s, to impart corresponding improved performance and smoother surface. Second, the primary load-bearing axial/longitudinal direction yarns/tows of such 3D fabrics do not integrate in a tensioned state with either the yarns of the thickness direction or the width direction at both fabric-end surfaces. And third, such 3D fabrics do not have variable yarn placements or spacings and/or concentrations, i.e. unequal yarn distribution in a given zone, for engineering selective and varying performance in a 3D fabric. All these drawbacks arise because of the limitations of the available processes.

The corresponding consequences of the above-indicated inadequacies are:

(i) The first inadequacy causes the load transferring mechanism at the surfaces of a composite material to become relatively less efficient. This happens because: (a) the binding yarns/tows do not float with some linear length at the fabric's surfaces as they fold/bend/curve, tightly/sharply like a hairpin, due to folding, and (b) the frequent folding/bending/curving of yarns/tows creates peaks and valleys and thereby surface unevenness. As a result, when the fabric is impregnated with matrix, the binding yarns get incorporated in folded/bended/curved form at fabric's surface. Whereas the collection of matrix in the valleys unnecessarily increases the dead weight of composite material, the load bearing ability of the relatively small bending/curving/folding, i.e. non-linear, length of binding yarns/tows adhering to matrix is rendered relatively uneven and lower. When such composite material components are surface bonded, the non-linear/bending fibres cannot bear loads evenly and effectively. The consequence of such improper utilization of fibres' tensile property is that more yarns/tows are used in producing the 3D fabric than necessary and use of additional mechanical fasteners also becomes necessary whereby the cost of production and weight of structure increases unnecessarily.

(ii) The second inadequacy relates to design, constructional and utility restrictions of the 3D reinforcement material. These aspects have an adverse effect on the composite materials and high energy impact mitigation products. To exemplify, the axial yarns/tows at the two end surfaces of a 3D fabric occur loose and open ended (i.e. exposed) because they are supplied individually like that. They do not tightly integrate or connect with binding yarns of either one or both sets. As a result, these axial yarns get either easily disturbed in their linear paths or internally displaced or pulled out from the fabric (for example in high energy impact mitigation products). The relatively loose and open/exposed ends of axial yarns/tows at the 3D fabric's two end surfaces cannot be also effectively utilized to bear tensile load in a composite material when compared with the binding yarns which fold/bend and mutually integrate at the other longitudinal surfaces of the 3D fabric. The relative higher utilization of binding yarns' tensile strength happens because at the longitudinal surfaces the binding yarns/tows fold/bend/fold and provide certain bending fibre length to adhere with the matrix. The existing 3D fabrics, which have open-ended axial/longitudinal yarns at either one or both of its end surfaces but integrated longitudinal fabric surfaces, are thus composed of uneven or non-homogenous integration construction. Also, available 3D fabrics do not have their constituent yarns/tows floating at the end surfaces for improved performance as discussed in point (i) above.

(iii) The third inadequacy relates to lack of variable yarn placements or spacings and/or concentrations in a 3D fabric. The existing 3D fabrics have a set uniform yarn spacing/placement due to limitations of the employed processes. Such a 3D fabric structure may not be always suitable for the optimal performance required of a composite material. Because a 3D fabric with variable yarn/tow placements and/or concentrations cannot be engineered by employing existing methods for achieving selective and varying performance, the composite material gets unduly over designed (usually by a factor of 2 to 3) and thereby it becomes overall relatively somewhat bulkier, heavier and expensive, whereby its intended purpose of being a cost-effective lightweight material is not truly realized.

As can be inferred from the presented shortcomings of the available 3D fabrics, the existing methods and devices are practically inefficient and unsuitable for mentioned technical reasons. From economic perspective, the points below amply illustrate why these processes have remained commercially unattractive and unviable for nearly five decades.

1. These processes are inflexible because they can neither produce customized or specific dimensioned and shaped 3D fabrics employing the same method and device nor produce performance enhancing fabric construction/architecture such as incorporation of bias yarns in either fabric's width or length direction (existing methods stack bias yarns in only fabric's thickness direction). Also, they cannot produce special noobed fabrics that comprise bias yarns/tows in only one desired direction that can be needed and suitable for certain application needs.
2. These processes require the axial yarns to be supplied individually in continuous (very long) length (e.g. from spools/beams) for achieving process continuity whereby a large number of spools are involved and their purchase and setting up in creels entails enormous time, effort and costs, which can be uneconomical and not justified for the quick and small production numbers typical to the industry requirements. Moreover, use of creels necessitates requirement of relatively large production floor area to accommodate them, which also adds to the costs.
3. These processes cannot produce a variety of 3D fabrics in required dimensions and shapes quickly and in an automated manner because they require relatively lengthy setting up labour and time, post-production cleaning/clearing labour and time, besides high costs, as each axial yarn constituting the 3D fabric has to be initially drawn out individually from its spool and arranged. The large floor space requirement for production machine, the usually linear type 3D fabric taking-up arrangement and the related working equipment etc. makes controlling and automating difficult and adds to the cost of production enormously. Above all they result in a 3D fabric of limited and relatively small thickness, besides lower performance. Further, once the production is over, thorough cleaning of machine has to be undertaken before the next production can start.

4. These processes are ineffective because they cannot: (a) produce 3D fabrics wherein yarns of at least a desired direction are maintained in tension, (b) produce 3D fabrics wherein planes of bias yarns exist in either fabric's length or width directions, (c) make dense 3D fabrics (i.e. with high fibre content or volume-fraction), (d) produce 3D fabrics with all its surfaces well integrated, (e) produce open-ended 3D fabrics with tightly held axial/longitudinal yarns/tows that remain in tension, (f) produce 3D fabric with varying concentrations of yarns/tows, (g) produce 3D fabric having yarns/tows of certain linear length floating in bias orientations on fabric's surface/s at desired areas (h) produce 3D fabrics with either formed/contoured surface/s or directly shaped products, (i) enable directly packaging of the produced 3D fabric to eliminate its contamination by way of handling mishaps, and (j) produce high-performance customized 3D fabrics in a wide range of dimensions and in a cost-effective manner.
5. They are inefficient because they have: (a) no automated production capability, (b) complicated working, (c) cumbersome procedures, (d) fibre breakage/damage causing actions, (e) slow production rates, and (f) low versatility.
6. They are relatively expensive, not only because they require large production space, but also higher skills and knowledge. Requirement of large number of raw material spools combined with high wastage of fibres, limited dimensioning capability etc. renders these processes and devices unsuitable for industrial and commercial viability and success.

Clearly, all these stated shortcomings need to be overcome quickly because use of composite materials in manufacturing all transportation machines is a key to reduce $CO_2$ emissions, and thereby global warming, $CO_2$ related pollution and associated respiratory and other related ailments.

Therefore, a method and device is needed now to produce 3D fabrics without the above-indicated deficiencies and inadequacies. These important requirements are achieved by the inventions disclosed herein.

Accordingly, a novel 3D fabric disclosed herein is characterized by one or more of the following: (i) it comprises at least some yarns/tows of at least one desired direction (length, width, thickness, bias), maintained inherently in tension, i.e. in pre-stressed or pre-tensioned condition, (ii) it incorporates planes of yarns in bias orientations in either fabric's length or width or thickness direction, (iii) it incorporates yarns/tows with varying yarn/tow placements/spacings or concentrations in desired area/s of noobed fabric for manufacturing optimized performance composite materials, (iv) it comprises yarns/tows of different lengths of at least one given direction to directly create a shaped product, (v) comprises at least some yarns/tows floating with certain linear length on at least one of fabric's surfaces in either fabric's length or width or thickness direction or in bias orientations, at least in some desired zones/areas of a surface, for providing increased adhering length to matrix for improving mechanical performance, and (vi) has customized dimensions and shape with either all surfaces integrated or tightly held open-ended axial/longitudinal yarns.

The innovative 3D fabric-forming method for producing the novel 3D fabrics (F) disclosed herein is characterized by incorporation of following main steps, the order of some of them may be suitably varied according to needs: (1) laying a set of yarns/tows in a zigzag arrangement in a tensioned manner, with their foldings/loops held between pre-selected supporting holders of two sets that face each other in a manner that eventually defines closely the customized shape/form and either length or width or thickness of the 3D fabric to be produced, the laid zigzag yarn/tow arrangement being henceforth called a predisposed set of axial yarns/tows (X), or simply axial or first yarns (X); (2) bunching/converging some of the axial yarns (X) at its middle part by pressing laterally, or putting pressure, at the four sides of the laid axial yarns (X) to a predetermined distance to dimensionally confine them to define the required 3D fabric's cross-sectional dimensions, as well as corresponding fibre volume fraction of 3D fabric; (3) laying a first set of binding yarns (Y), or simply second yarns (Y), in tensioned manner, and a second set of binding yarns (Z), or simply third yarns (Z), in a tensioned manner, in mutually dissimilar orientations by entering each set of binding yarns (Y) and (Z) from opposite end sides of the set of axial yarns (X) and preferably incorporating them in a middle part of the set of axial yarns (X) to start subsequent further laying of these sets of binding yarns (Y) and (Z) at either sides of the incorporated binding yarns (Y and Z), preferably alternately, in their respective directions, to produce 3D fabric (F) simultaneously "middle-outwards", i.e. producing two halves of a 3D fabric simultaneously starting from a middle part of the set of axial yarns (X) and proceeding towards both the end sides; (4) pressing laterally and packing the laid binding yarns of the (Y) and (Z) sets against each other from the directions of respective end sides of the set of axial yarns (X); (5) stop bunching or applying pressure at all four sides of axial yarns (X) and also that on the laid binding yarns (Y) and (Z) from the end sides of the set of axial yarns (X); (6) continuing to lay further the two sets of binding yarns (Y) and (Z) through the set of axial yarns (X) in a manner to fold them to create the respective bound fabric surfaces; (7) repeating steps 2-6 until the two sets of binding yarns (Y) and (Z) producing the two halves of 3D fabric reach close to the respective end sides of the axial yarns (X); (8) initiating integration of the set of axial yarns (X) with either the binding yarns/tows of either the set (Y) or set (Z), or additional yarn/s, for creating the integrated surfaces of the 3D fabric's two end sides, by drawing/passing the individual binding yarns of either the set (Y) or (Z) concerned, or additional yarn/s, through either corresponding rows or columns of the loops of the set of axial yarns (X); (9) cutting the binding yarns of set (Y) or (Z), or additional yarn/s, extending out from the loops of axial yarns (X); (10) clamping the produced 3D fabric (F) at its longitudinal sides to aid release of its end sides from their support holders; (11) disengaging the loops/foldings of axial yarns (X) that are at the end sides of the produced 3D fabric (F) from its supporting holders either without cutting the loops, or by cut-opening the loops of axial yarns (X); and (12) supporting the produced 3D fabric (F) and directly depositing it for packaging.

Certain unique aspects of the described method need to be pointed out here:

While the above indicated procedure relates to production of the uniaxial type 3D fabric, by laying bias-binding yarns (+V and −V) in a manner similar to that described for binding yarns (Y) and (Z), a multiaxial type 3D fabric is producible. Bias-binding yarns (+V and −V), which can also function as the second and third yarns, can be laid, for example in an extension of indicated steps 3 to 7.

Production of the 3D fabric is carried out "middle-outwards" to enable simultaneous production of its two halves. Such a method doubles the production rate without speeding up the process. Hence this method is economically advantageous.

As the production of 3D fabric proceeds middle-outwards along the tensioned axial yarns (X) by bunching/converging them laterally at the time of laying the two sets of binding yarns (Y) and (Z), the set of axial yarns (X) gets tightly packed and bound by both sets of binding yarns (Y) and (Z). As a consequence, the two end sides of the 3D fabric become resistant to unraveling if the loops of the axial yarns (X) are cut off from their support holders and thereby the tension obtaining in axial yarns (X) continues to be maintained. In view of the ability of this novel process to bunch/converge the set of axial yarns (X) for tightly packing and incorporating them in a pre-tensioned condition, the step number 8 indicated in the foregoing is considered optional.

The lateral bunching/converging of the axial yarns (X) and lateral pressing and packing of the laid binding yarns (Y) and (Z) cause lateral compression of the yarns of the three directions. The lateral compressive forces in yarns/tows of any one direction then act in the longitudinal direction of the yarns of the other two sets causing them to stretch longitudinally whereby tension is generated in them. As a consequence, all three sets of yarns (X), (Y) and (Z) remain tensioned in the produced 3D fabric. This is attributed to the mechanical arrangement of the three mutually perpendicular sets of yarns and frictional forces between the tightly packed yarns. The same tensioning mechanism is similarly operating when bias-binding yarns (+V and −V) are incorporated to produce a multiaxial 3D fabric wherein these bias-binding yarns (+V and −V) also exist in a tensioned state.

Accordingly, the novel noobing device for producing 3D fabric (F) comprises the following main arrangements, the order of operations of which may be suitably varied according to requirements: (1) Arrangement to lay the set of axial yarns (X) in a zigzag manner, with their foldings/loops held between pre-selected supporting holders of two sets that face each other in a manner that will eventually define approximately the customized form and length, width and thickness of the 3D fabric to be produced, the laid zigzag yarn arrangement being called a predisposed set of axial/first yarns (X); (2) Arrangement to bunch/converge some of the laid axial yarns (X) at its middle part by pressing laterally, or putting pressure, at the four sides of the laid axial yarns (X) to a predetermined distance to dimensionally confine them to define the required 3D fabric's cross-sectional dimensions, as well as fibre volume fraction of 3D fabric; (3) Arrangement to lay a first set of binding yarns (Y), or second yarns (Y), in a tensioned manner, and a second set of binding yarns (Z), or third yarns (Z), in a tensioned manner, the mutual orientations of which are dissimilar by entering each set of binding yarns (Y) and (Z) from opposite end sides of the set of axial yarns (X) and preferably incorporating them in a middle part of the set of axial yarns (X), to start subsequent further laying of these binding yarns (Y) and (Z) at either sides of the incorporated binding yarns (Y and Z), preferably alternately, in their respective directions, to produce 3D fabric (F) simultaneously "middle-outwards", i.e. producing two halves of a 3D fabric simultaneously starting from a middle part of the set of axial yarns (X) and proceeding towards both the end sides; (4) Arrangement to press laterally and packing the laid binding yarns of the (Y) and (Z) sets against each other from the directions of respective end sides of the set of axial yarns (X); (5) Arrangement to stop bunching or applying pressure at all four sides of set of yarns and also that on the laid binding yarns (Y) and (Z) from the end sides of the set of axial yarns (X); (6) Arrangement for continuing to lay further the two sets of binding yarns (Y) and (Z) through the set of axial yarns (X) in a manner to fold them to create the respective bound fabric surfaces; (7) Arrangements to perform steps 2-6, to achieve process continuity, until the two sets of binding yarns (Y) and (Z) producing the two halves of 3D fabric reach close to the respective end sides of axial yarns (X); (8) Arrangement to initiate integration of the set of axial yarns (X) with the binding yarns of either the set (Y) or (Z), for creating the surfaces of the surfaces of the 3D fabric's two end sides, by drawing/passing the individual binding yarns of either the set (Y) or (Z) concerned, through either column or row of the loops of the set of axial yarns (X); (9) Arrangement to cut the binding yarns of sets (Y) or (Z) extending out from the loops of axial yarns (X); (10) Arrangement to clamp the produced 3D fabric (F) at its longitudinal sides to aid release of its end sides from their support holders; (11) Arrangement to disengage the foldings/loops of axial yarns (X) that are at the end sides of the produced 3D fabric (F) from its supporting holders either without cutting the loops, or by cut-opening the loops of the axial yarns (X); and (12) Arrangement to support the produced 3D fabric and directly deposit it for packaging.

As shall become obvious later, the indicated innovative method and device are also novel by way of the following one or more main features:

1) They can be devised to lay bias-binding yarns (+V and −V), for example in an extension of indicated steps 3 to 7 to produce multiaxial type 3D fabric.

2) They produce customized 3D fabrics wherein at least one set of yarns remains in tension by the forces generated by the laterally compressed yarns of at least one other set of yarns, such 3D fabric being of either uniaxial or multiaxial or partly of both types (e.g. either (i) a 3D fabric comprising one set of binding (either Y or Z) in one half of 3D fabric and bias-binding yarns (either +V or −V) in other half of 3D fabric, or (ii) a 3D fabric comprising only one set of binding (either Y or Z), or one set of bias-binding yarns (either +V or −V).

3) They produce a 3D fabric comprising at least one set of bias-binding yarns (either +V or −V) oriented in bias direction relative to a pair of opposite surfaces (either top-bottom or left-right or front-back end surfaces) of the 3D fabric.

4) They produce 3D fabric with all surfaces integrated, especially the end surfaces by way of yarns of at least one set of binding (Y or Z)/bias-binding (+V or −V) yarns passing through the corresponding direction's loops of the zigzag laid axial yarns (X).

5) They produce 3D fabrics wherein the axial yarns (X) constituting the 3D fabric is oriented in either the length or the width or the thickness direction of the produced 3D fabric.

6) They produce 3D fabrics "middle-outwards" whereby the binding (Y or Z)/bias-binding (+V or −V) sets of yarns, at the point where they pass between/through the plane/s of axial yarns (X), exist mutually separated by 'single' yarns/tows of the axial yarns (X) and thereafter they are mutually separated by at least a 'doubled/paired' yarns of the zigzag axial yarns (X).

7) Depending on the 3D fabric architecture required, they can produce 3D fabrics with at least some of the binding yarns (Y and Z)/bias-binding yarns (+V and −V), which pass between/through the planes in which the axial yarns (X), exist mutually separated by at least a 'doubled/paired' zigzag axial yarns (X) and whereby such binding/bias-binding yarns float on the surface/s concerned of the 3D fabric.

8) Depending on the 3D fabric architecture required, they can produce 3D fabrics by incorporating at least some of the binding yarns (Y or Z)/bias-binding yarns (+V or −V) of at least one set in a helical loop path about either corresponding column or row or diagonal column/row of the set of zigzag axial yarns (X), such traversal in helical loop paths progressing towards the respective end sides from the "middle-outwards" point of production.

9) Depending on the 3D fabric architecture required, they can produce 3D fabrics by incorporating at least some binding yarns (Y or Z)/bias-binding yarns (+V or −V), of at least one of the two sets in a manner whereby they traverse at least in some parts/areas of the 3D fabric in a floating manner at an angle relative to the longitudinal orientation of axial yarns (X) to create a partial multiaxial structure at those corresponding parts/areas of surface/s.

10) Depending on the 3D fabric architecture required, they can produce 3D fabrics by incorporating at least some binding yarns (Y or Z)/bias-binding yarns (+V or −V), of at least one of the two sets in a manner whereby they float at least in some parts/areas of the end surfaces of the 3D fabric to create partial multiaxial structure in corresponding parts/areas of at least one of the end surfaces.

11) They produce 3D fabrics comprising either binding yarns (Y and Z) and/or bias-binding yarns (+V and −V), or one set from both these sets, arranged either in an alternating manner or in another desired order, in their respective directions, either entirely or in only certain areas to produce corresponding fabric structure/architecture.

12) They produce 3D fabric comprising axial yarns (X), binding yarns (Y and Z)/bias-binding yarns (+V and −V) in either constant or varying spacing (i.e. density per unit length) to create a 3D fabric with corresponding yarn concentrations, floats and architecture.

13) They produce customized 3D fabric objects wherein at least some yarns of at least one set are laid in relatively different lengths for creating corresponding shape/form of 3D fabric.

These and other features of the novel 3D fabric, and its production method and apparatus, will become clearer from the description which follows next.

BRIEF DESCRIPTION OF DRAWINGS

The present inventions relating to method of and device for producing customized noobed fabrics, and the fabric products thereof, are illustrated by way of examples wherein:

(FIG. 1*e* shows top view of zigzag laid axial yarns (X); FIG. 1*f*-1*i* show end views of zigzag laid axial yarns (X) for producing different cross-sectional shapes).

DESCRIPTION OF THE PREFERRED EMBODIMENTS

The noobing method according to present invention comprises a preferred set of operations/steps which are performed by a suitable device and produces customized 3D fabric objects. The working of the noobing method and device according to this invention is described below through an example production of 3D fabric object of cuboid shape of uniaxial type comprising three mutually perpendicular sets of yarns—axial (X), binding (Y) and binding (Z). The multiaxial type 3D fabric object comprising additionally bias-binding yarns (+V and −V) will be described later at relevant places as a person skilled in the art can carry out the process with the provided basic knowledge.

Some of the principal structures producible by the method shall be indicated subsequently as other possible structures will become obvious from these examples to a person skilled in the art. These different principal 3D fabric structures, having certain features in common, are possible because the present method can be commenced using either of the two sets of binding yarns. Depending on which set of binding yarns is first used to start the process, and also if the binding yarns of one of the sets are divided and laid from both ends sides, or some from only one end side, together with the flexibility of laying the binding yarns in different positions and sequences, the production of numerous structures become directly possible. Production of only cuboid form is considered here for simplicity of explaining the spirit of the invention as mentioned earlier.

The relevant main aspects of forming 3D fabric by the noobing process according to the present invention is described below through FIGS. 1-5. A practicable noobing device based on these aspects shall be described subsequently.

Figure 1A:
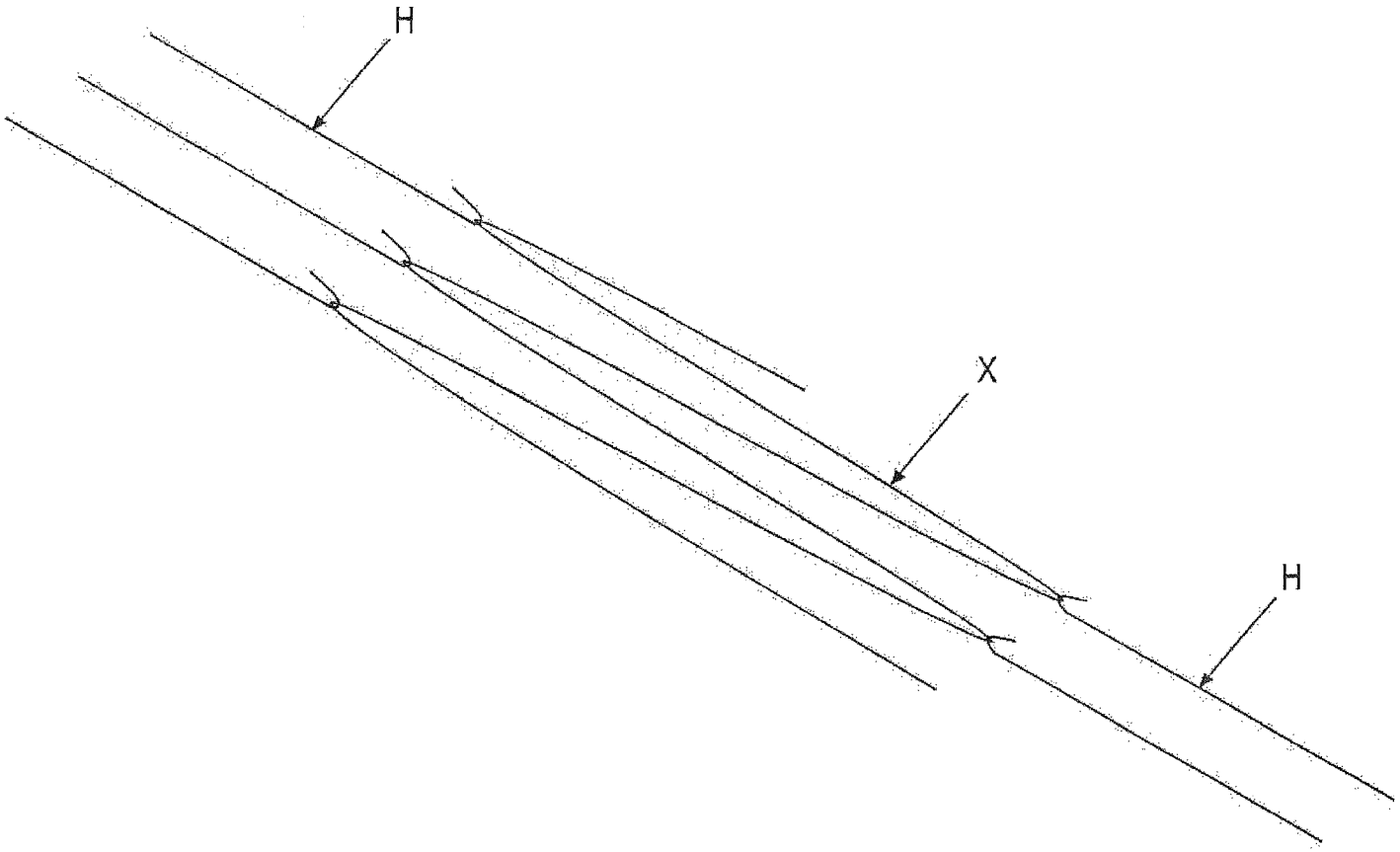
FIGS. 1*a*-1*i* exemplify arrangement of set of axial yarns (X) in zigzag manner
Figure 1B:
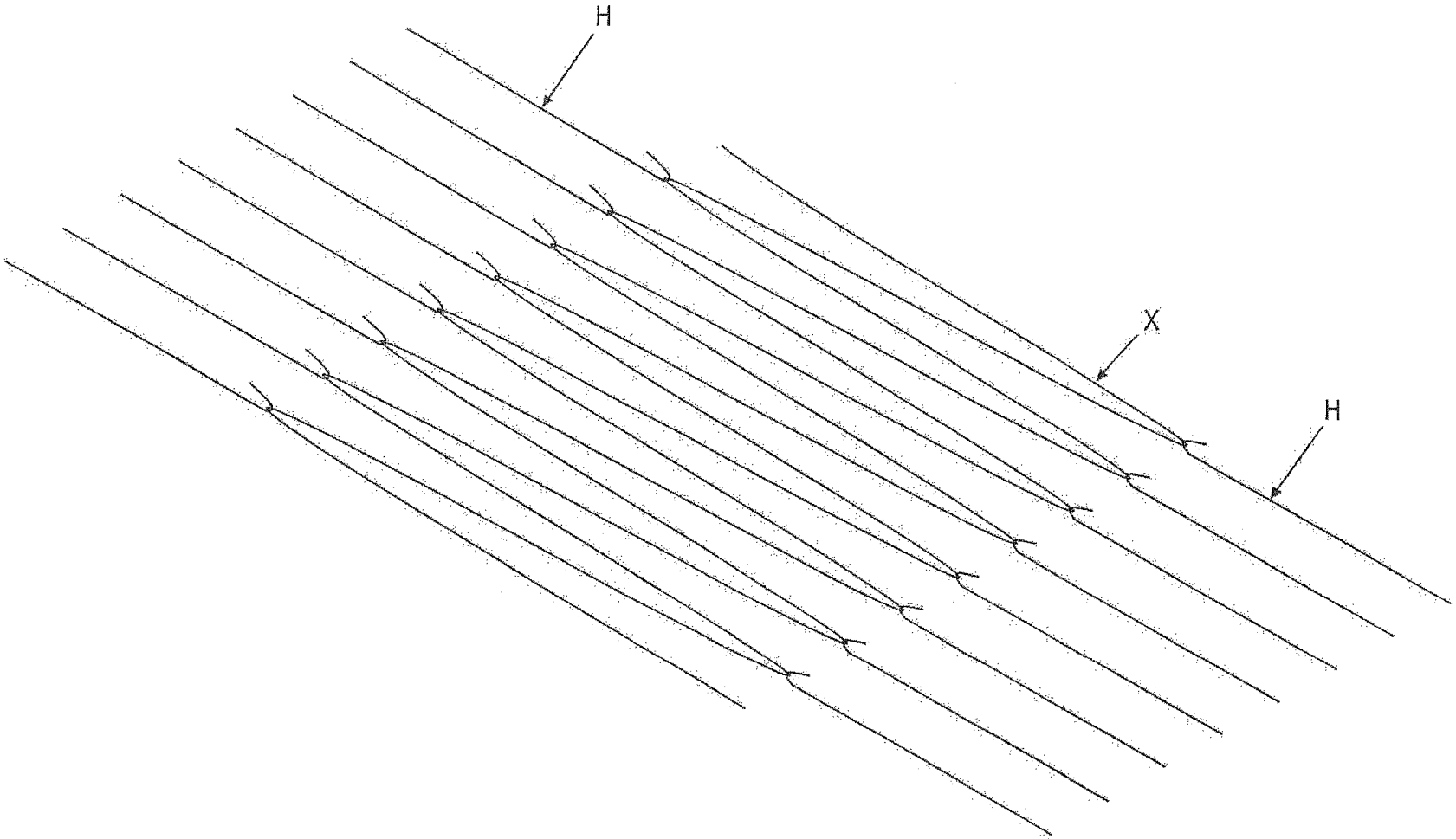
Figure 1C:
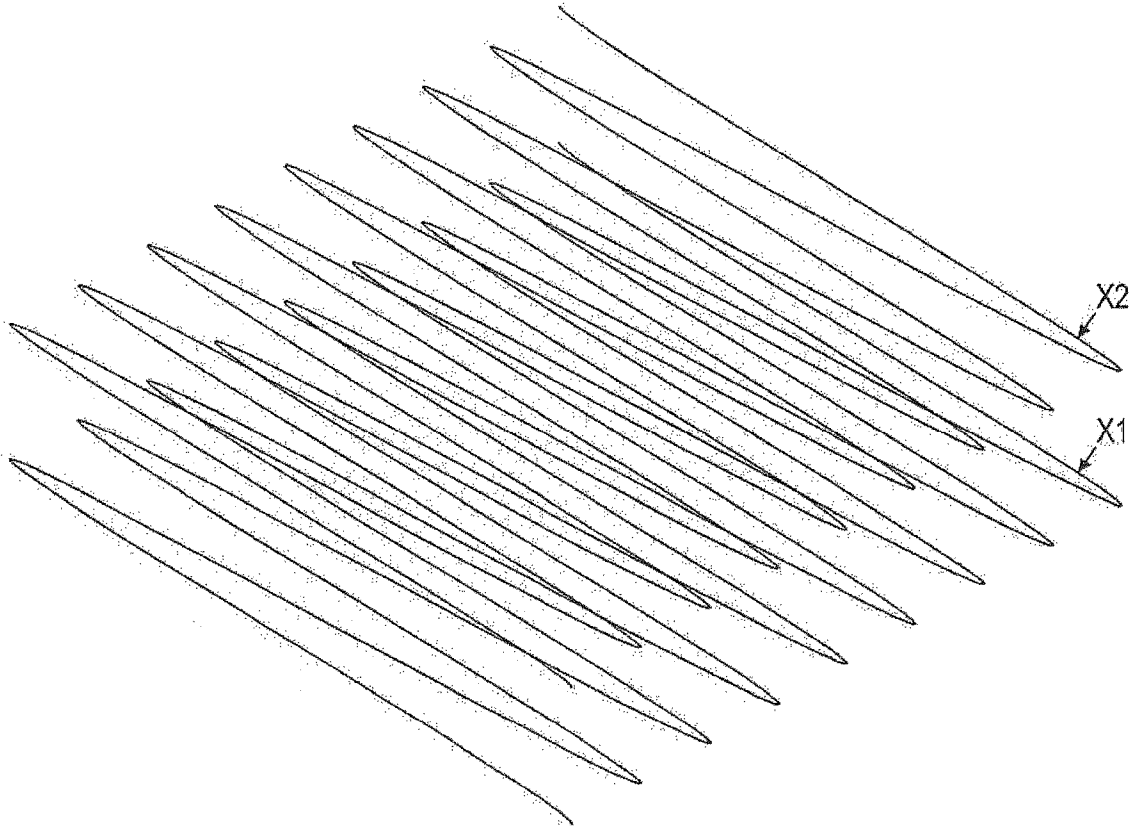
Figure 1D:
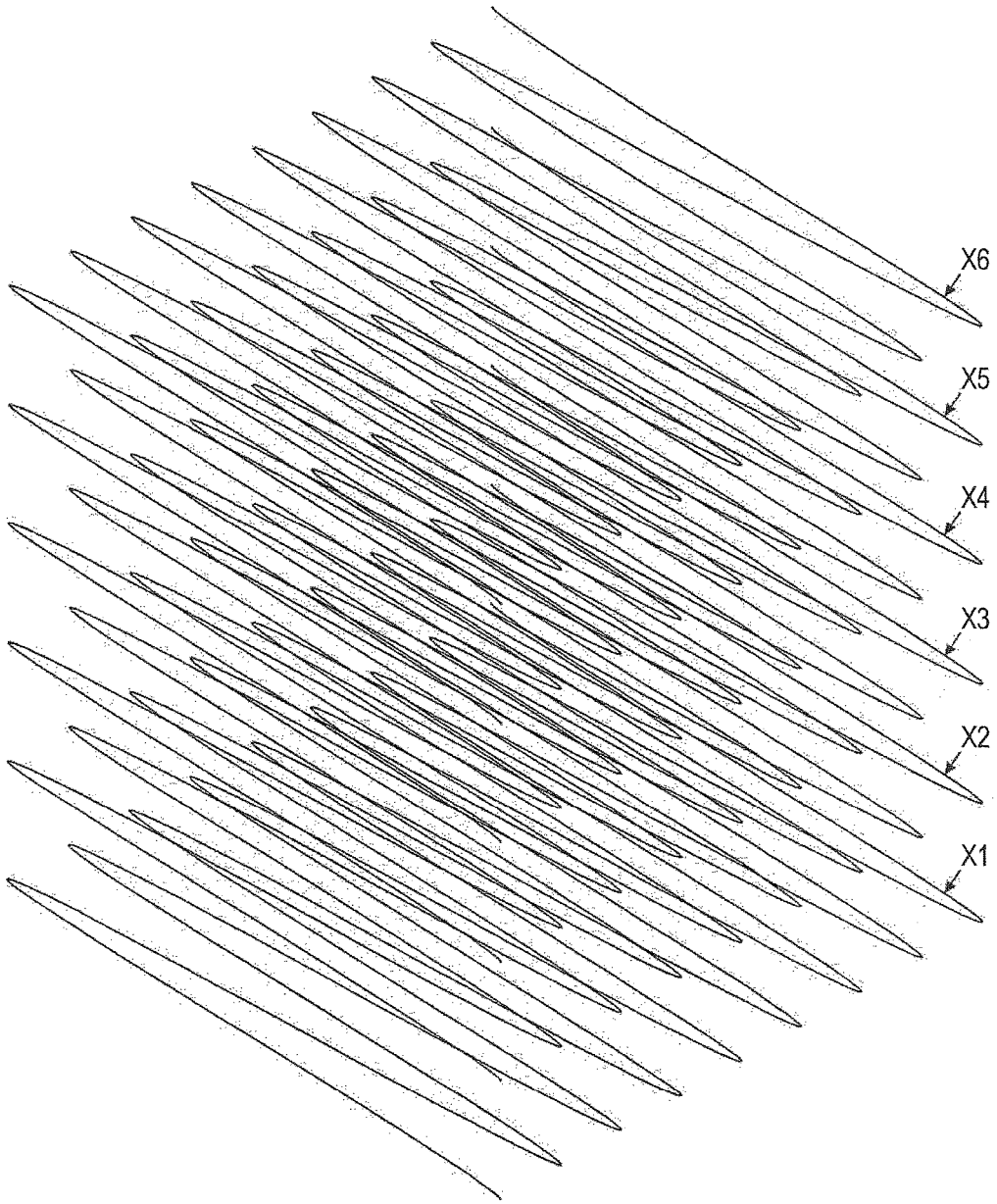
Figure 1E:
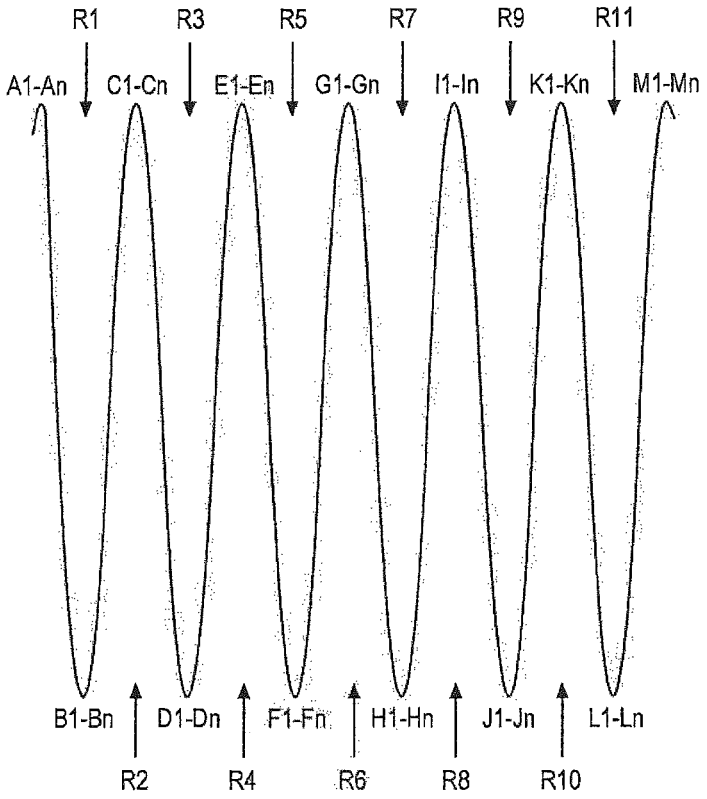
Figure 1F:
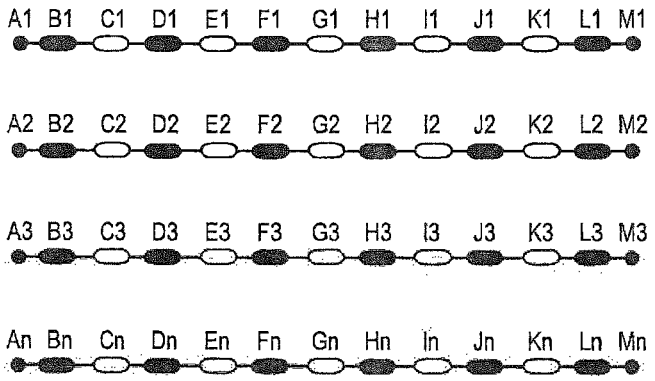
Figure 1G:
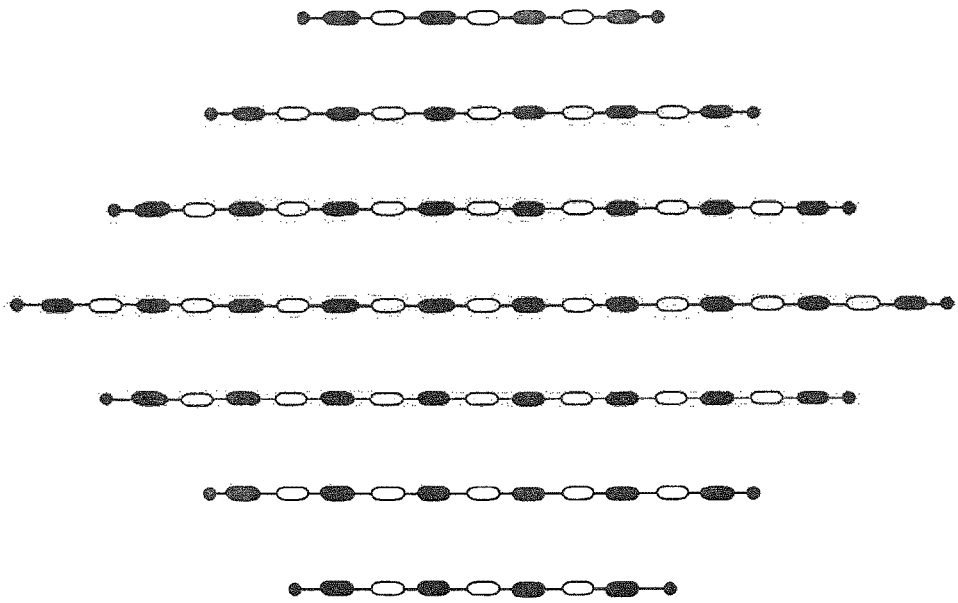
Figure 1H:
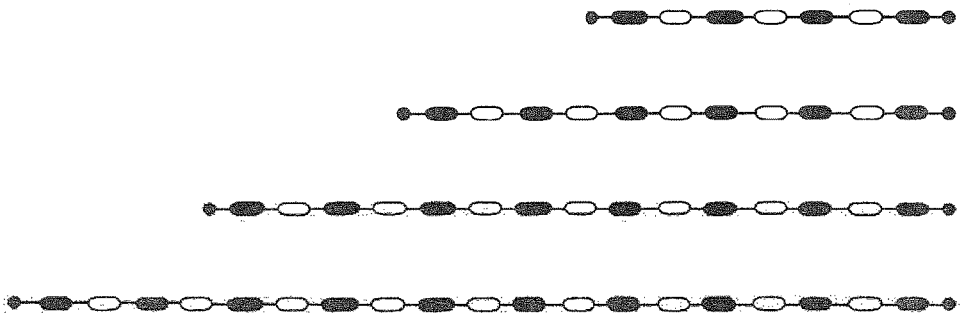
Figure 1I:
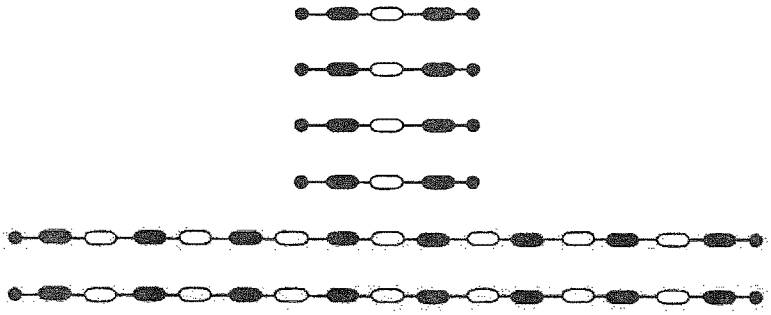

1) Laying in a first plane, preferably horizontal, a set of axial yarns (X) in a zigzag fashion, the foldings/loops of which are held between two sets of holders (H) that face each other separated by a pre-defined distance, as indicated in FIG. 1*a*, to create to-be-produced 3D fabric's either length or thickness or width. The laid yarns, referred to as the set of axial yarns (X), are maintained in the zigzag manner by hooking action of the support holders (H) as each of the back-and-forth folds of axial yarns (X) creates a loop. The zigzag axial yarns (X) are laid in tension between the opposite two sets of holders (H).
2) Continuing to lay the set of axial yarns (X) in as many zigzag formations in the first plane as may be necessary using select/required number of support holders (H) to achieve the eventual desired width and density of the to-be-produced 3D fabric as indicated in FIG. 1*b*.
3) Continuing to lay the set of axial yarns (X) in a second plane, preferably parallel to the previous one, in a zigzag manner as before, and preferably with as many zigzag formations as in the previous one, as indicated in FIG. 1*c*. Axial yarns (X) can be laid in either continuous manner from one plane to the next or preferably discontinuously as is shown in FIG. 1*c* to enable "middle-outward" production of 3D fabric.
4) Continuing to lay the set of axial yarns (X) in a zigzag manner as shown in FIG. 1*d* with as many different stacks (X1-X6) of parallel planes as may be required to achieve the desired thickness and density, and with as many zigzag formations as may be necessary, to create the desired cross-section/form/shape of the to-be-produced 3D fabric. FIGS. 1*e* and 1*f* respectively show the top and end views of the zigzag laid set of axial yarns (X). Whereas FIG. 1*e* shows the columns (A1-An, B1-Bn etc.), FIG. 1*f* shows the rows (A1-M1, A2-M2 etc.) created by the stack of the zigzag set of yarns (X). Each of the columns at one end side of the set of axial yarns (X), e.g. C1-Cn to K1-Kn, uniquely face an opening R2, R4, R6 etc. at the opposite end side as indicated in FIG. 1*e*. Similarly, each of the columns at the other end side of the set of axial yarns (X), e.g. B1-Bn to L1-Ln, uniquely face an opening R1, R3, R5 etc. at the opposite end side. In other words, there is a column-wise opening between two adjacent columns of the set of axial yarns (X). As can be understood now, such a zigzag set of axial yarns (X) directly facilitates laying of column-wise yarns in the column-wise openings at both the end sides. Further, such column-wise openings at both end sides also allow to simultaneously lay the corresponding yarns from both the end sides. Likewise, as can be inferred from FIG. 1*f* (wherein only one end side of the set of axial yarns (X) is shown), there exists a row-wise opening between two adjacent rows of the disposed set of axial yarns (X). Such row-wise openings also exist at the opposite end side. In these row-wise openings at both end sides of set of axial yarns (X) corresponding row-wise yarns can be laid simultaneously. When wanting to create other shapes of cross-section, the set of axial yarns (X) can be arranged accordingly, as is exemplified in FIGS. 1*g*-1*i*, to create columns and rows of yarns/tows with corresponding openings between two adjacent columns and two adjacent rows. For ease of indicating the columns and rows, in FIG. 1*f* the two looping end sides of set of axial yarns (X) are represented by connected solid and empty shapes which represent loops at the two end sides with continuity of the yarn between starting (A1-An) and finishing (M1-Mn) points in each of the rows of axial yarns (X).

Figure 2:
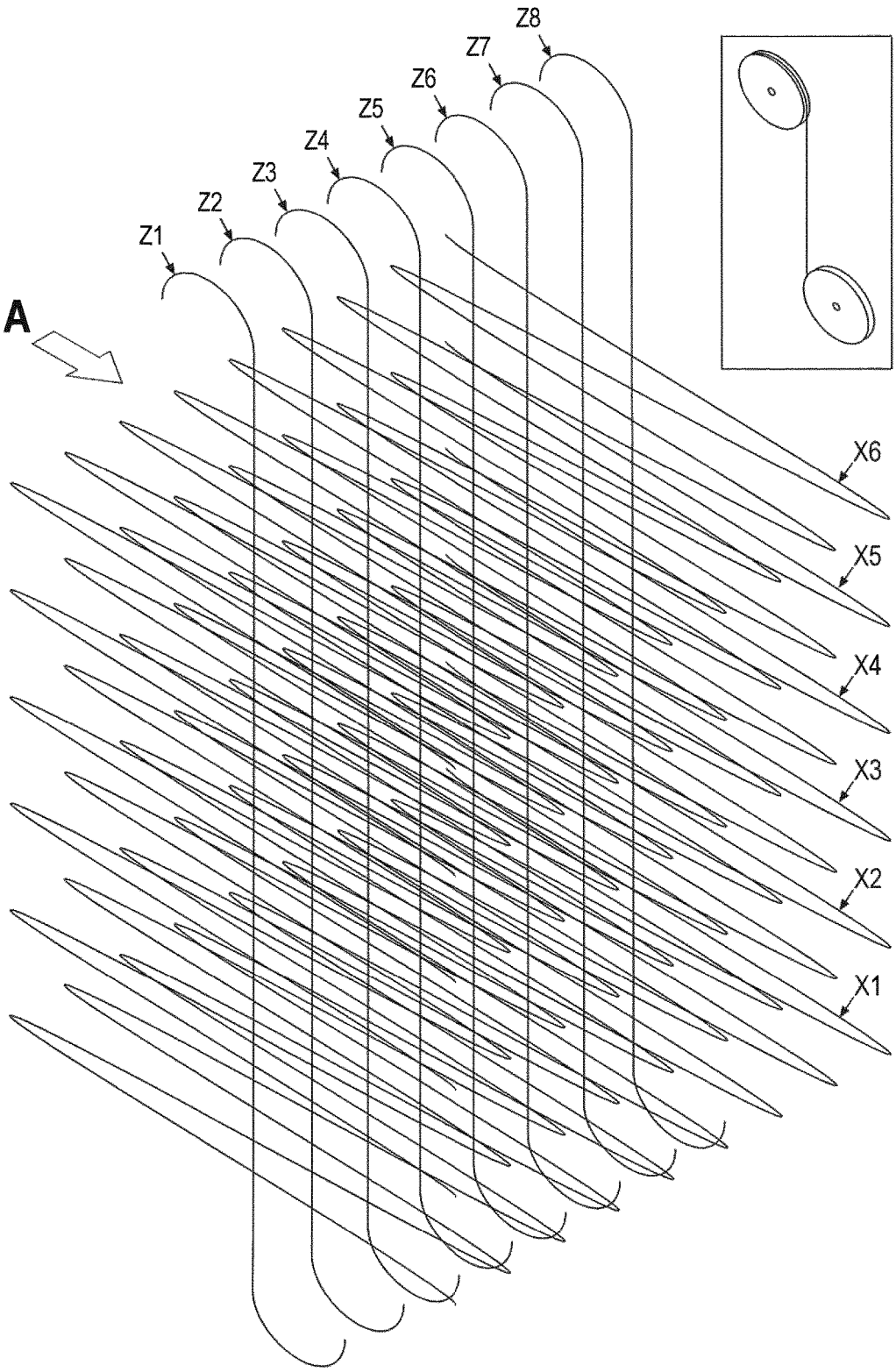
FIG. 2 exemplifies incorporation of a set of binding yarns (Z) through the planes bearing the set of axial yarns (X).

5) Laying a first set of binding yarns (Z1-Z8), each of which is supplied in tension from a pair of carriers/means, such as either spools or needles, in the openings between the columns of the set of axial yarns (X), by gaining entry, for example, from the openings at the end side A, as shown in FIG. 2. These binding yarns (Z) traverse the path passing through the planes in which set of axial yarns (X) exist. It may be noted that each of the yarns (Z1-Z8) is supplied from a corresponding pair of carriers/means, as exemplified in the inset of FIG. 2, to produce the 3D fabric "middle-outwards".

Figure 3:
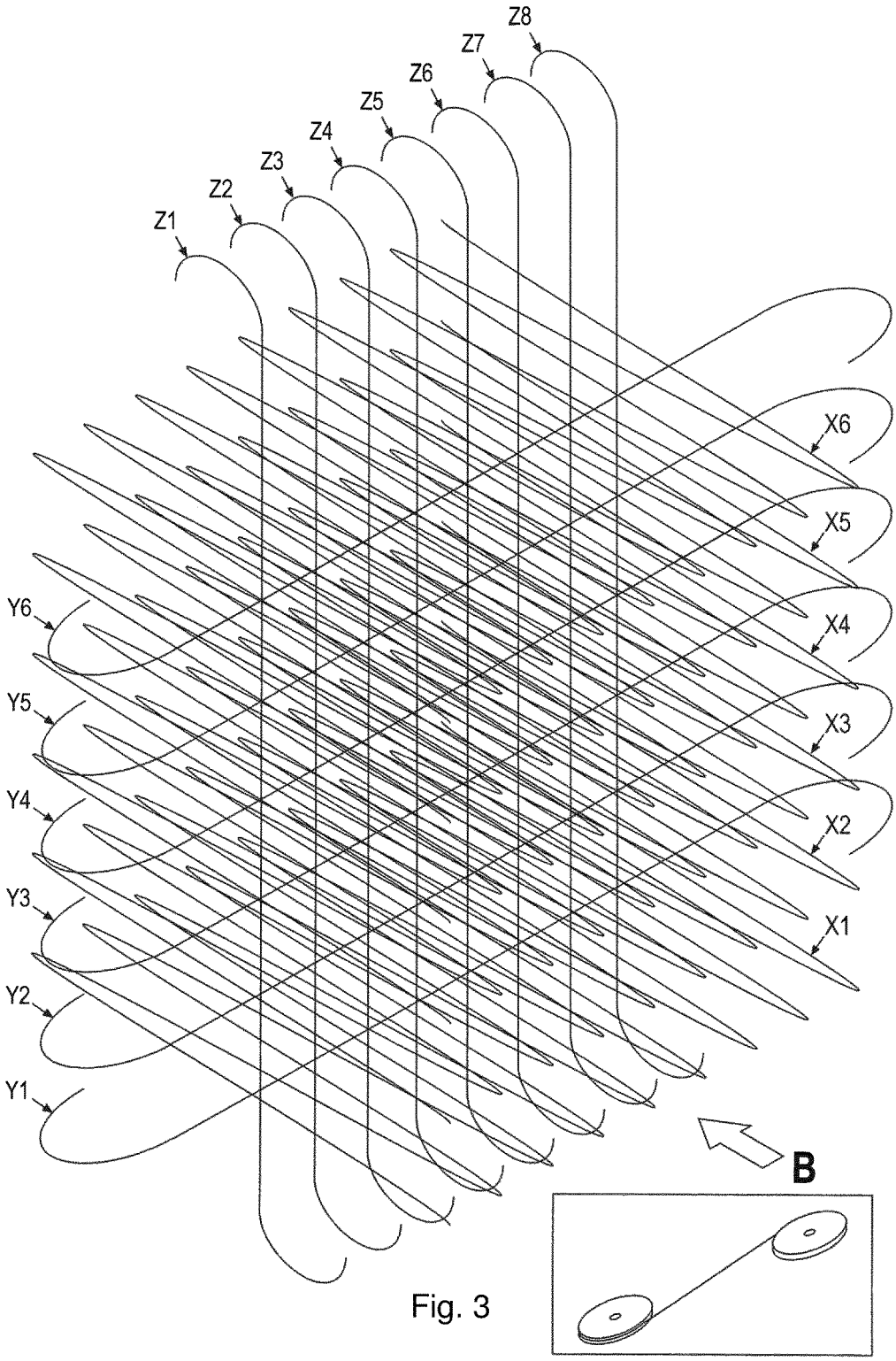
FIG. 3 exemplifies incorporation of another set of binding yarns (Y) besides the planes bearing the set of axial yarns (X).

6) Laying a second set of binding yarns (Y1-Y6), each of which is supplied in tension from a pair of carriers/means, such as either spools or needles, in the openings between the rows of the set of axial yarns (X) by gaining entry, for example, from the openings at the end side B, as shown in FIG. 3. These binding yarns (Y) traverse the path passing between adjacent planes in which set of axial yarns (X) exist. It may be noted that each of the yarns (Y1-Y6) is supplied from a corresponding pair of carriers/means, as exemplified in the inset of FIG. 3, to produce the 3D fabric "middle-outwards". It may be mentioned here that the binding yarns (Y1-Y6) can be laid from end side B at the same time when the binding yarns (Z1-Z8) are being laid from end side A.

7) Positioning the laid sets of binding yarns (Y) and (Z) adjacent/touching to each other and preferably somewhere along middle of the length of the laid set of axial yarns (X) to enable production of two halves of a 3D fabric simultaneously "middle-outwards", as can be inferred from FIG. 3.

Figure 4A:
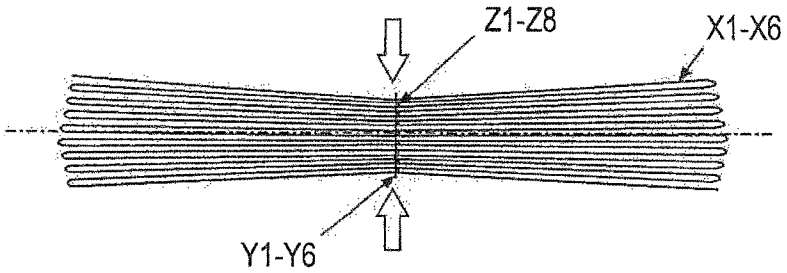
FIGS. 4*a-b* exemplify respectively top and side views of bunching of the set of axial yarns (X) from left-right and top-bottom sides during start of "middle-outwards" production of 3D fabric.
Figure 4B:
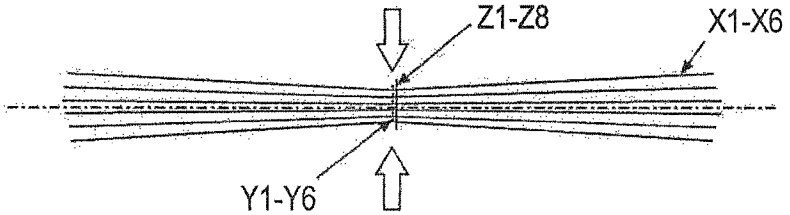

8) Displacing the set of axial yarns (X) inwards towards fabric's central longitudinal axis, or bunching them, by applying pressure from four directions—left and right sides as indicated in FIG. 4*a* (which shows top view of disposed axial yarns X), and top and bottom sides as indicated in FIG. 4*b* (which shows side view of disposed axial yarns X). This bunching displacement of set of axial yarns (X) is done, somewhere close to where the sets of binding yarns (Y and Z) have been laid, to bunch/converge them to contain in dimensionally confined space for producing required dimensions and shape of the cross-section and achieving fibre volume-fraction of the 3D fabric. The set of axial yarns (X) is preferably bunched together slightly more than the required final pre-determined width and thickness dimensions of the to-be-produced 3D fabric. Such bunching of axial yarns (X), which causes their lateral compression, is performed for eventually generating tensions in the sets of binding yarns (Y) and (Z) when these yarns have folded back in their respective directions and the bunched set of axial yarns (X) tends to de-compress upon cessation of bunching action. The laterally compressed set of axial yarns (X) then tends to release the compressive forces causing. Because the binding yarns (Y) and (Z) fold back and prevent the axial yarns (X) from losing its compressive forces completely, the laid sets of binding yarns (Y) and (Z) become longitudinally tensioned and remain so in the required final cross-sectional dimensions of the 3D fabric. Thus, such a 3D fabric comprises pre-tensioned or pre-stressed binding yarns (Y and Z).

Figure 5A:
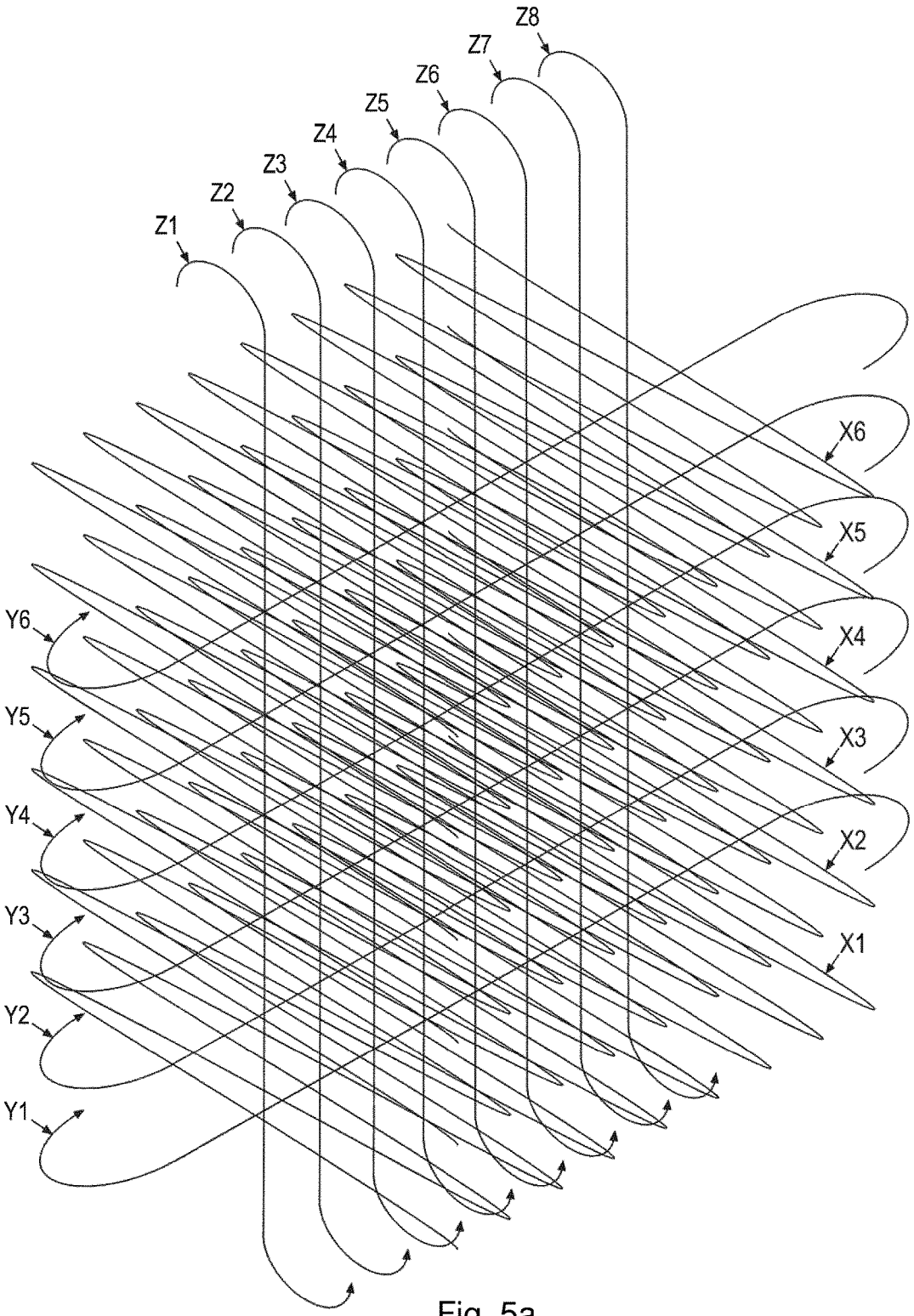
FIGS. 5*a-b* exemplify respectively subsequent laying of binding yarns (Y) and (Z) at either sides of the start position for "middle-outwards" production of 3D fabric.
Figure 5B:
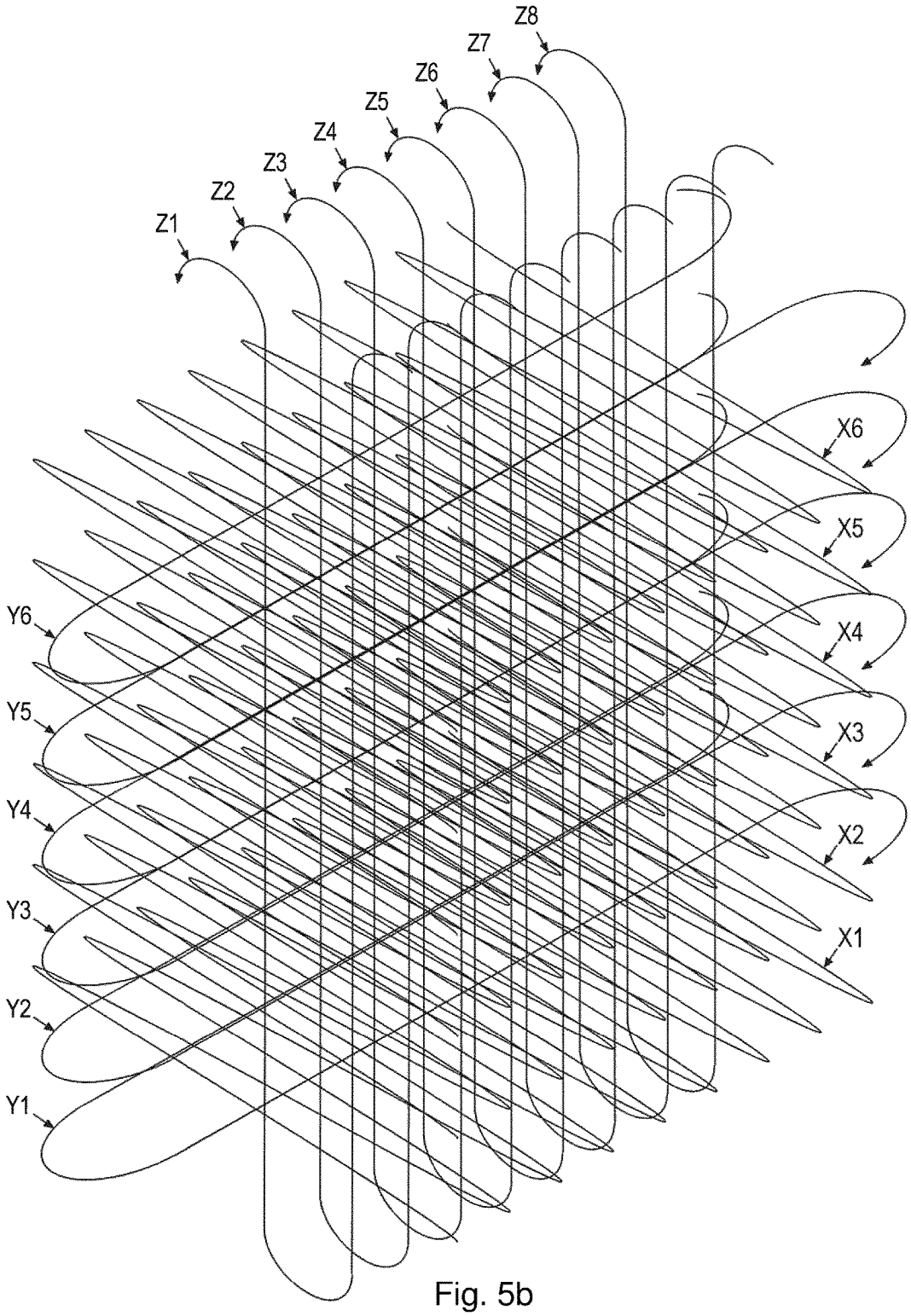
Figure 6:
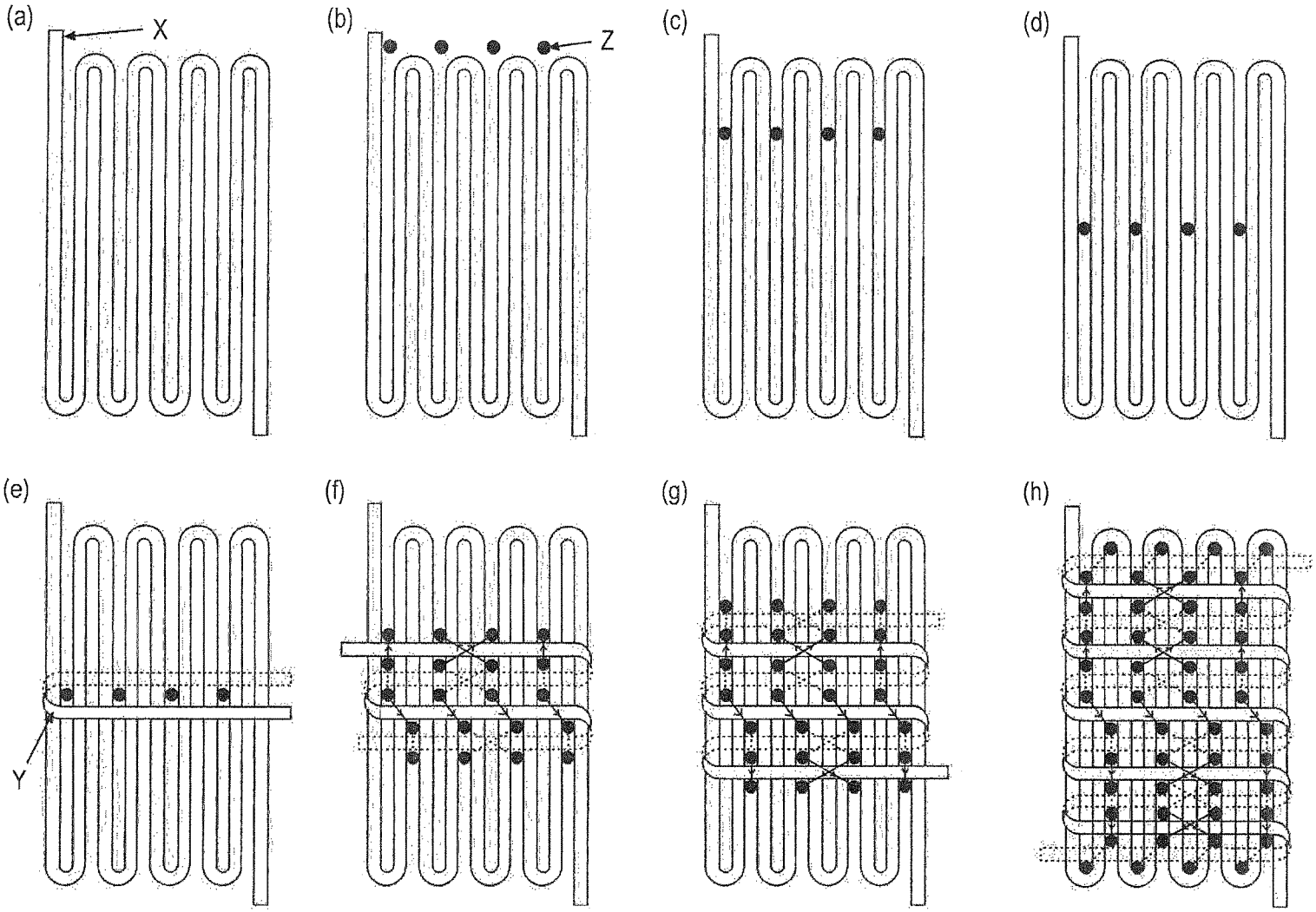
FIGS. 6*a-h* exemplify a construction style of a 3D fabric (top view) when process starts "middle-outwards" with laying of binding yarns (Z) from one end side of the set of axial yarns (X) and then laying the binding yarns (Y) at either sides of the laid binding yarns (Z), after which the binding yarns of the set (Y) traverse looping the corresponding rows of the set of axial yarns (X) while some yarns of binding yarns (Z) traverse looping the corresponding columns of axial yarns (X) and some yarns of binding yarns (Z) traverse without looping the columns of axial yarns (X).
Figure 7:
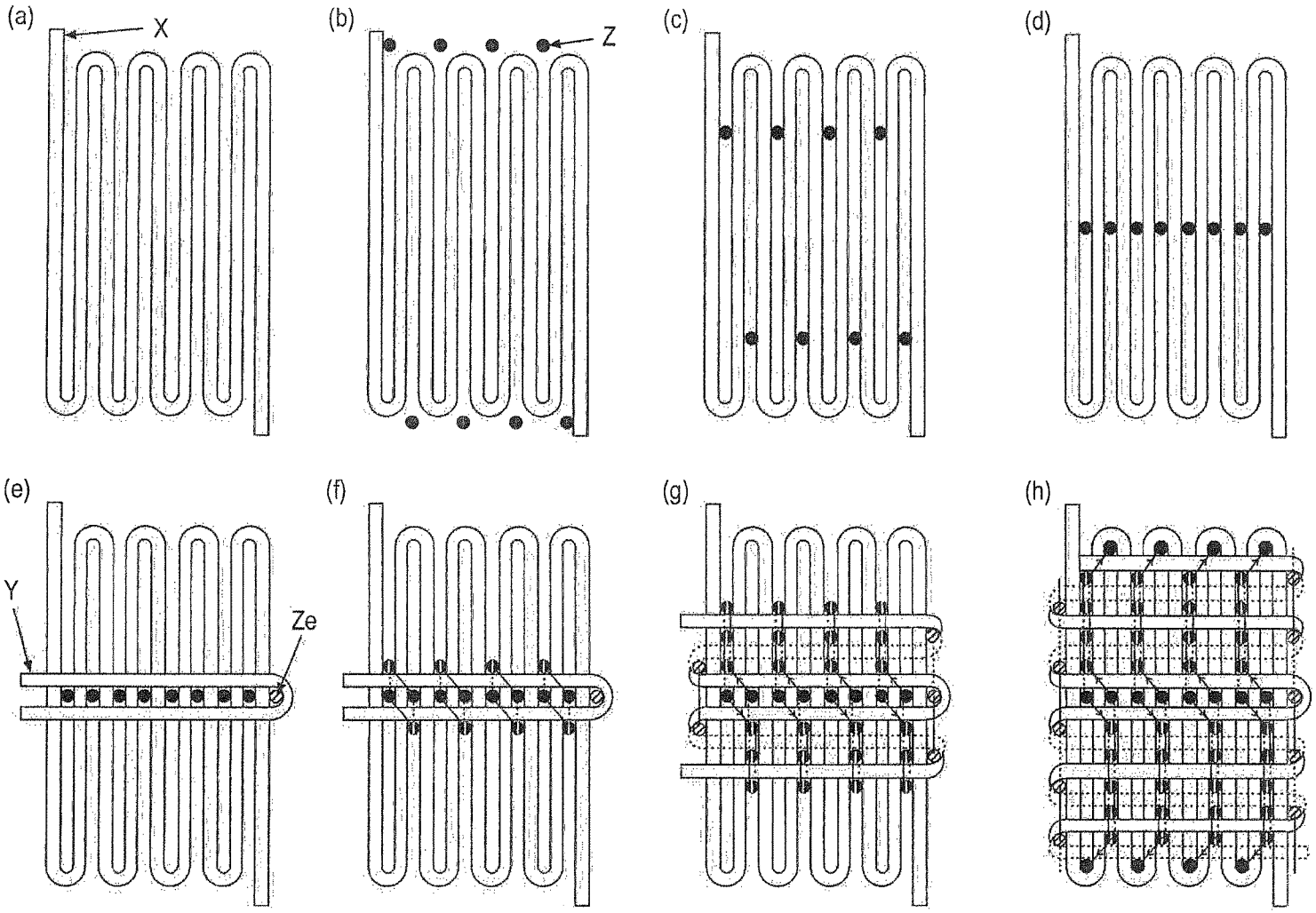
FIGS. 7*a-h* exemplify a construction style of a 3D fabric (top view) when process starts "middle-outwards" with laying of binding yarns (Z) from both the end sides of the set of axial yarns (X) and then binding yarns (Y) laid at either sides of the laid binding yarns (Z), after which the binding yarns of the two sets (Y) and (Z) traverse such that two binding yarns (Z) occur jointly, but traverse oppositely, and proceed towards respective end sides of axial yarns (X) without looping their columns, while binding yarns of set (Y) traverse towards respective end sides of axial yarns (X) looping the corresponding rows of the set of axial yarns (X).
Figure 8:
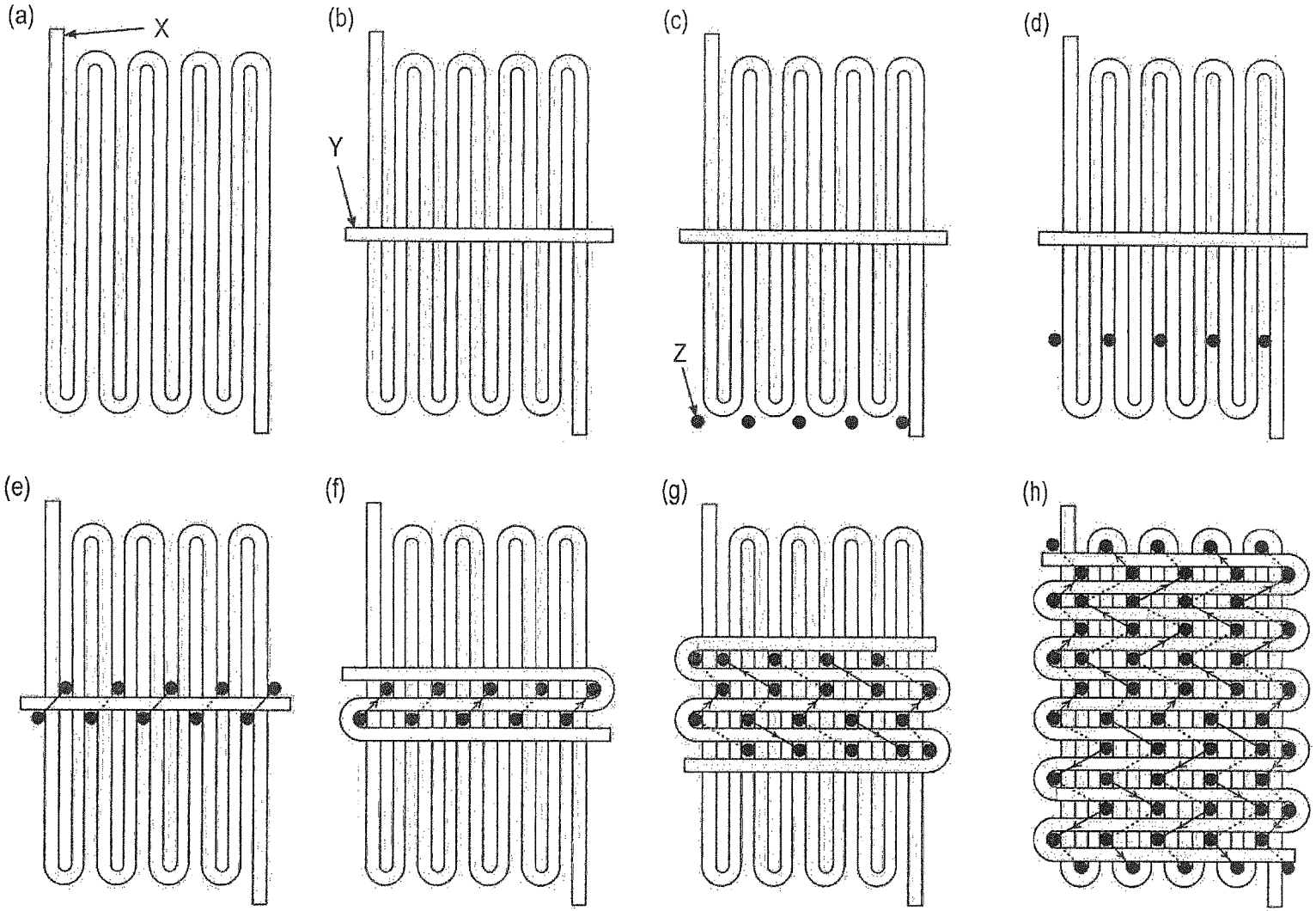
FIGS. 8*a-h* exemplify a construction style of a 3D fabric (top view) when process starts "middle-outwards" with laying of binding yarns (Y) from one end side of the set of axial yarns (X) and then binding yarns (Z) laid at either sides of the laid binding yarns (Y), after which the binding yarns of set (Y) traverse without looping the corresponding rows of the set of axial yarns (X) while the binding yarns of set (Z) traverse looping the corresponding columns of the set of axial yarns (X).
Figure 9:
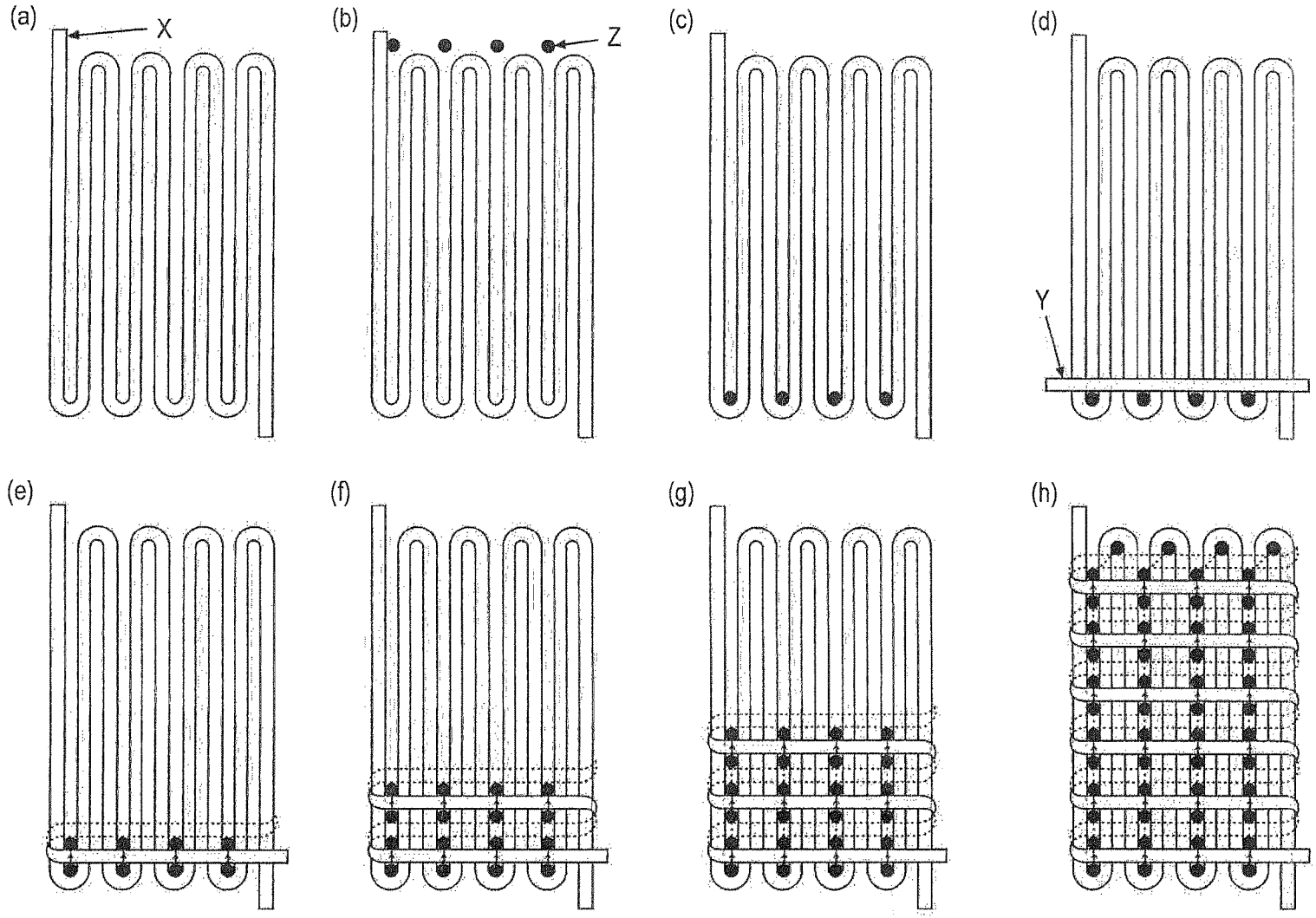
FIGS. 9*a-h* exemplify a construction style of a 3D fabric (top view) when process proceeds end-to-end starting with laying of binding yarns (Z) from one end side of set of axial yarns (X) and then laying binding yarns of set (Y) beside the laid binding yarns (Z), after which the binding yarns of set (Z) traverse without looping the corresponding columns of the set of axial yarns (X) while the binding yarns of the set (Y) loop the corresponding rows of the set of axial yarns (X).

9) Continuing to lay simultaneously the binding yarns (Y and Z) at either sides of the previously laid sets of binding yarns (Y) and (Z), by reversing their corresponding laying directions relative to the previous laying directions, as indicated by directional arrows (FIG. 5*a*), to fold them in suitable sequence (for example, alternating yarns of sets (Y) and (Z) at either sides of the first laid binding yarns (Y and Z), by correspondingly laying them in the openings between the rows and columns of loops of disposed set of yarns (X), from both the end sides, as can be inferred from FIGS. 5*a* and 5*b*. As can be understood now, part of the binding yarns (Y and Z) are laid independently from both the end sides of set of axial yarns (X). These binding yarns (Y and Z) shall be thus laid between the corresponding rows and columns of each of the two halves of the set of axial yarns (X) at the same time whereby two halves of the 3D fabric get produced simultaneously.

10) Pushing the freshly laid sets of binding yarns (Y) and (Z) towards the previously laid and positioned binding yarns (Y and Z) from the two end sides A and B (indicated in FIGS. 2 and 3) of the set of axial yarns (X).

11) Ceasing the bunching pressures from left-right and top-bottom sides of the set of axial yarns (X), which was applied in step 8 above, and also the compressive/packing forces on the laid sets of binding yarns (Y and Z), which was applied in step 10 above to pack them in axial yarns (X) for enabling the now-folded sets of yarns (Y) and (Z) to get tensioned (as explained in step 8).

12) Bunching again the set of axial yarns (X) from four directions as before (i.e. step 8 above), but at a position that is relatively moved slightly outwardly (i.e. towards the respective fabric-end side directions) from the previous bunching positions as some build-up of fabric is realized in the previous cycle.

13) Continuing to cyclically produce the 3D fabric "middle-outwardly" by repeating the steps 9-12 indicated above until either of the sets of binding yarns (Y) and (Z) reaches close to each of the two loop end sides of the set of axial yarns (X) and sufficient amount of binding yarns (Y and Z) have been packed in whence the laid binding yarns (Y and Z) are pressed again towards the previously laid binding yarns so that all the laid binding yarns (Y and Z) get highly packed and compressed.

14) Drawing individually the binding yarns of the last laid set, for example (Z), through respective columns of loops of the set of axial yarns (X) for enabling binding of the end sides of the produced 3D fabric.

15) Ceasing bunching and packing pressure from all directions of the produced 3D fabric comprising the set of axial yarns (X) and the sets of binding yarns (Y) and (Z).

16) Cutting off the binding yarns (Z) that are extending out from the loops of set of axial yarns (X) for tidiness.

17) Temporarily holding the produced 3D fabric for disengaging the loops of the set of axial yarns (X) form their respective supports at both end sides.

18) Depositing directly the produced customized 3D fabric in its packaging container.

Such a manner of producing the 3D fabric may now be referred to as "middle-outwards" because two halves of the 3D fabric is produced simultaneously from its middle towards both the end sides.

In the process described above, certain variations could be made, particularly that relating to which set of binding yarns (Y or Z) is used for commencing the process and in which manner their laying is conducted. Another variation could be to not draw the binding yarns (Z) through the columns of loops of disposed axial yarns (X), especially when the tightly packed fibres constituting the 3D fabric have high friction between them and keep the structure integrated and maintain the disposed axial yarns (X) in tension. Yet another variation could be to include additional binding yarns (either Y or Z or both) that are correspondingly laid at the outer side of the outermost rows (either one of them or both) of disposed axial yarns (X) and/or at the outer side of the outermost columns (either one of them or both) of disposed axial yarns (X). Yet another variation could be to include/lay additional single yarns in zigzag axial yarns (X) to selectively increase the number of fibres in specific areas for achieving certain performance. In any case, 3D fabrics producible by the described process have certain features in common. By way of example, in FIGS. 6 to 9, which are the top views of some of the illustrative 3D fabrics under production, four different fabric structures/architectures producible "middle-outwards" by choosing to start the process with either binding yarns (Y) or (Z), are described below.

(i) FIGS. 6*a*-6*h* show binding yarns (Z) are first laid from only one end side of the set of axial yarns (X) and binding yarns (Y) are laid at either sides of the laid binding yarns (Z) after which the two sets of binding yarns (Z and Y) traverse alternately to loop, and catch in their folds, the corresponding columns and rows respectively of the set of axial yarns (X). The traversal of binding yarns (Y and Z) is in a helical path whereby the columns and rows of axial yarns (X) are entrapped in their folds. As indicated, a binding yarn (Z) can be incorporated either without crossing another binding yarn Z (i.e. traversing in the same column-wise opening between the columns of loops) or crossing another binding yarn (Z) (i.e. traversing in different column-wise openings between different columns of loops). Laying of a binding yarn between different columns of loops causes them to float on surfaces concerned. The floats can be made relatively longer. A 3D fabric comprising floating binding yarns is advantageous for reasons explained earlier. The binding yarns (Z) are shown to be drawn through the loops of axial yarns (X) to obtain a 3D fabric with all its surfaces integrated.

As can be observed, the important characteristic features of the produced 3D fabric structure (FIG. 6*h*) is that a looping doubled axial yarn (X) occurs between two individual adjacent binding yarns (Z). Another important feature is that at the region of "middle-outward" production a given individual binding yarn (Z) occurs at either sides of the section of axial yarn (X) that is occurring between two adjacent opposite loops. Another important feature is that the section of binding yarn (Y) occurring over the surface of axial yarns (X) are held by the loops of individual adjacent binding yarns (Z) that are separated by a looping doubled axial yarn (X). Another important feature is that an individual binding yarn (Z) that is drawn through a loop of axial yarn (X) occurs at opposite side of the section of axial yarn (X) that runs between two adjacent opposite loops.

(ii) FIGS. 7*a*-7*h* show binding yarns (Z) are first laid between the columns of set of axial yarns (X) from both the end sides of the set of axial yarns (X) and binding yarns (Y) are laid at either side of the laid binding yarns (Z) after which only the binding yarns (Y) traverse helically looping and catching in their folds the corresponding rows of the set of axial yarns (X). Binding yarns (Z) do not loop the columns of axial yarns (X) but only loop and catch the outermost binding yarns (Y). It may be noted that two binding yarns (Z) are incorporated together in the openings between the columns of loops (represented as two solid "half dots"). They traverse in mutually opposite directions (one traversing from top to bottom and the other from bottom to top of the set of axial yarns (X)). To produce integrated end sides, it is sufficient if one of the two the binding yarns (Z) is drawn through the corresponding loops of axial yarns (X). Depending on the architecture of 3D fabric required, optional extra yarns (Ze) could be used besides the outer columns of axial yarns (X), as indicated.

(iii) FIGS. 8*a*-8*h* show binding yarns (Y) are first laid from one end side of the set of axial yarns (X) and binding yarns (Z) are laid from the other end side of the set of axial yarns (X). One extra binding yarn (Z) is used beside one of the columns of axial yarns (X) and similarly one extra binding yarn (Y) is used over the row of axial yarns (X). Alternate binding yarns (Z) are then traversed in relatively opposite directions whereby some of them entrap the outermost binding yarn (Y) in the their folds and occur at the other side of binding yarns (Y) while the remaining binding yarns (Z) are brought to the other side of binding yarns (Y) without entrapping them. The binding yarns (Y) are then laid besides the binding yarns (Z) that occur at either sides of first laid binding yarns (Y). The process is continued "middle-outwards" whereby the binding yarns (Z) traverse helically looping and catching in their respective folds the columns of axial yarns (X) and the binding yarns (Y). It may be noted that the binding yarns (Y) do not helically loop and catch the respective rows of axial yarns (X) but loop and catch in their folds the binding yarns (Z) creating integrated surfaces. The binding yarns (Z) are drawn through the loops of axial yarns (X) at the end sides. The extra binding yarn (Z) can be either drawn or left undrawn through one of the loops of axial yarns (X). In FIG. 8*h* the extra binding yarn (Z) is shown to be not drawn through the loop.

As with the 3D fabric structures described in the foregoing examples, it can be observed that an important characteristic feature of the produced 3D fabric structure (FIG. 8*h*) is that a looping doubled axial yarn (X) occurs between two individual adjacent binding yarns (Z), excluding the outermost binding yarns (Z). Another important feature is that at the region of "middle-outward" production the individual binding yarns (Z) do not occur at either sides of the section of axial yarn (X) that runs between two adjacent opposite loops because the binding yarns (Z) are incorporated from only one end side of axial yarns (X). Another important feature is that the section of binding yarn (Y) occurring over the surface of axial yarns (X) are entrapped by the folds/loops of individual adjacent binding yarns (Z) that are separated by two looping doubled axial yarns (X). Another important feature is that an individual binding yarn (Z) that is drawn through a loop of axial yarn (X) occurs at opposite side of the section of axial yarn (X) that runs between two adjacent opposite loops.

(iv) FIGS. 9*a*-9*h* show binding yarns (Z) are laid from one end side of the openings between columns of loops of set of axial yarns (X) to the opposite end side column of loops directly. Accordingly, this 3D fabric is not produced "middle-outwards" but "end-to-end". The traversal of binding yarns (Z), although shown to be between the same respective openings between the columns of loops, can be switched between other openings to create crossing longer floats and changes in directional orientations. Also, whereas the shown binding yarns (Z) do not loop the columns of axial yarns (X), the binding yarns of set (Y) loop the rows of axial yarns (X). The binding yarns (Z) are finally drawn through the corresponding columns of loops of axial yarns (X) at the end side concerned to produce a 3D fabric with integrated end surfaces.

As with the 3D fabric structures described in the foregoing examples, it can be observed that an important characteristic feature of the produced 3D fabric structure (FIG. 9*h*) is that a looping doubled axial yarn (X) occurs between two individual adjacent binding yarns (Z). Another important feature is that the individual binding yarns (Z) do not occur at either sides of the section of axial yarn (X) that runs between two adjacent opposite loops because the binding yarns (Z) are incorporated from only one end side of axial yarns (X) and the fabric production is not "middle-outward". Another important feature is that the section of binding yarn (Y) occurring over the surface of axial yarns (X) are entrapped by the folds/loops of individual adjacent binding yarns (Z) that are separated by two looping doubled axial yarns (X). Another important feature is that an individual binding yarn (Z) that is drawn through a loop of axial yarn (X) occurs at opposite side of the section of axial yarn (X) that runs between two adjacent opposite loops.

These examples amply demonstrate some of constructional/architectural possibilities by the "middle-outwards" and "end-to-end" formations of 3D fabrics. The indicated top view of the self-explanatory sequences of the novel 3D fabric production in FIGS. 6 to 9 require no particular detailing to a person skilled in the art other than mentioning that the dotted lines in FIGS. 6 to 9 indicate the binding yarns (Y) traversing under the corresponding individual rows of the set of axial yarns (X), and binding yarns (Z) traversing either under the corresponding individual columns of the set of axial yarns (X) or under the laid set of binding yarns (Y). Also, in FIGS. 6 to 9 the option of drawing the binding yarns (Z) through the corresponding columns of loops of set of axial yarns (X) is indicated to show all sides of produced 3D fabric are self-closed/sealed. A person skilled in the art will understand now that binding yarns of either one or both sets (Y) and (Z) can be to used in different sequences to produce 3D fabrics with different float lengths, variable yarn density and orientations. Further, such constructions can be made either similar of different in the two halves of the "middle-outwardly" produced 3D fabric. Although in FIGS. 6-9 the top view of 3D fabric production is indicated, it would be apparent to a person skilled in the art that somewhat similar constructions would result when 3D fabric production is viewed from either the left or right sides. The main difference will be that each of the individual adjacent binding yarns (Y) being separated by a plane of axial yarns (X). Also, binding yarns (Z) will occur between folding binding yarns (Y). Further, an individual binding yarn (Y) will not occur at opposite sides of a row of axial yarns (X) at the "middle-outward" production region because the rows of axial yarns (X) have common openings at both end sides. (If axial yarn (X) is laid continuously from one plane to the next, then binding yarns (X) will have a loop at one outer end side and an opening at the opposite end side (i.e. something similar to that explained in reference to FIG. 1*e*)).

Also, although two adjacent axial yarns (X) are shown to be separated and without binding yarn (Z) in between them at certain places, in practice each looped/folded axial yarn (X) is doubled and therefore will appear as a single yarn. Because the 3D fabric is produced uniquely by bunching axial yarns (X) and laterally compressing binding yarns (Y) and (Z), they get tightly packed and therefore the indicated empty spaces will be practically filled whereby a high fibre volume-fraction 3D fabric is obtained. Also, because of such high packing of fibres there is correspondingly greater increase in fibre-to-fibre friction which keeps the fibres of all three sets locked in their respective orientations and prevents them from getting misaligned, pulled-out etc. Due to their mutually perpendicular orientations and tight packing, the laterally compressed yarns of one direction tend to constantly expand causing the yarns of the other two directions to extend longitudinally whereby the yarns of all three sets remain in a state of mutual tension and a pre-tensioned 3D fabric is realized. It may be pointed out here that a pre-tensioned 3D fabric is realized even if either the looped ends of axial yarns (X) are cut open or the binding yarns of one set are not drawn through the corresponding direction's columns or rows of loops of axial yarns (X). The integrated end sides accord relatively higher tension build-up in the involved sets of yarns, improved load-bearing capacity of bonded end sides, close dimensional tolerances, prevention of fibre disorientations during infiltration, ease of handling and minimizing fibre wastage.

It follows from the above descriptions of the different 3D fabric structures producible by the present method that they have a unique feature in that at least some of two individual adjacent binding yarns of set (Z) which pass through the planes of disposed set of zigzag axial yarns (X), have between them at least a doubled axial yarn (X), which is twice that of the initial constitution of axial yarn (X). This feature of the novel 3D fabric holds good whether the binding yarns (Z) is composed of either same or different number of filaments compared to the constitution of axial yarn (X) or laid in single (such as by traversing binding yarn supply spool) or folded/doubled (such as by using needles that draw and lay binding yarn from a stationary supply spool/bobbin). Accordingly and further, this feature of doubled axial yarn (X) occurring between two individual adjacent binding yarns (Z) is independent of whether the individual binding yarns (Z) entrap the columns concerned of axial yarns (X) directly or indirectly to achieve corresponding types of integration of columns of axial yarns (X), and thereby integration of 3D fabric.

Further, when bias-binding yarns (+V and −V) are used, they also pass through the planes of axial yarns (X), but at an angle which is different from that of binding yarns (Z). Nevertheless, between two individual adjacent bias-binding yarns of a given set (+V or −V), there will be at least a doubled axial yarn (X), which is twice that of the initial constitution of axial yarn (X).

Figure 10A:
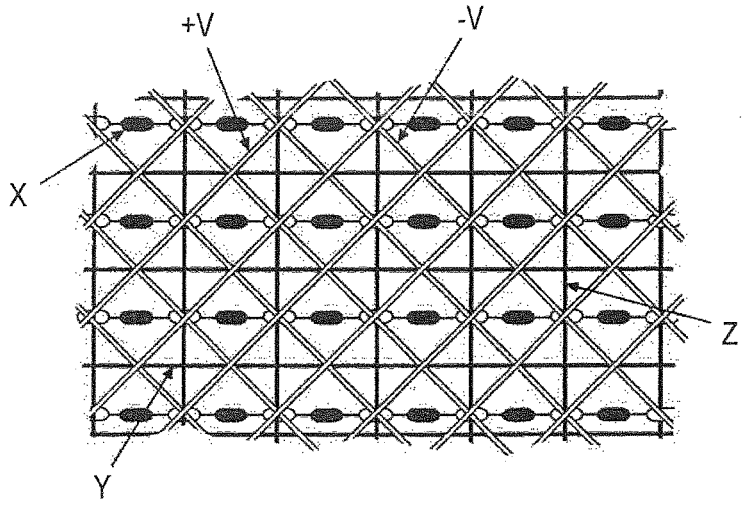
FIGS. 10*a-c* exemplify different 3D fabric constructions (one end view) comprising bias-binding yarns (+V and −V) and different number of binding yarns of set (Y).
Figure 10B:
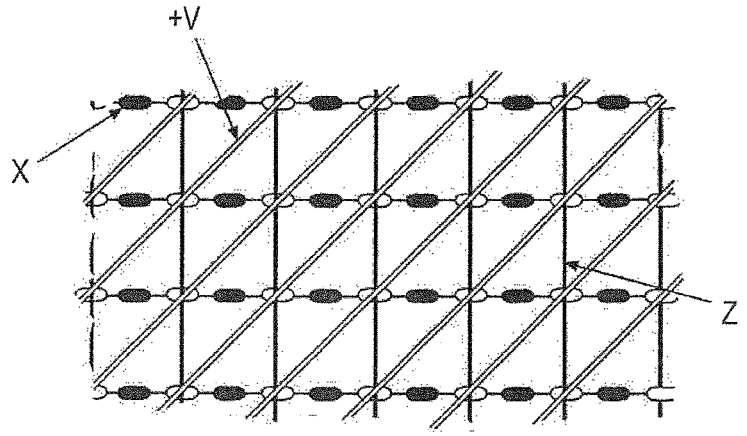
Figure 10C:
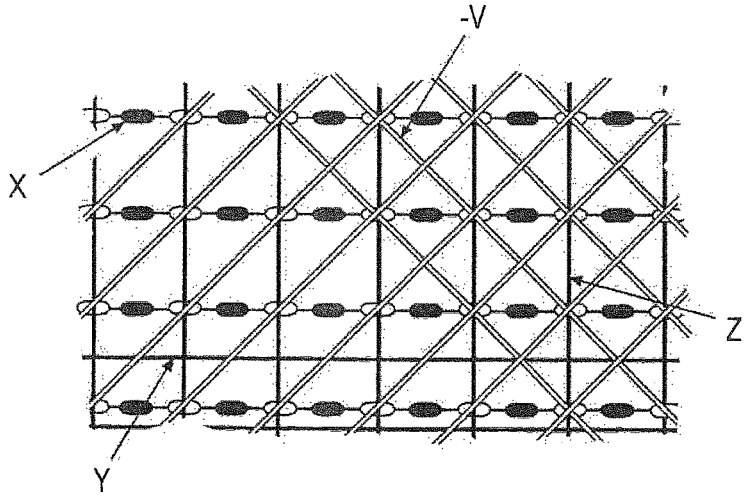

The aspects described above relate to the uniaxial noobing process and uniaxial noobed fabric according to the present invention. A person skilled in the art can realize now that by following the various described aspects of the uniaxial noobing process, additional sets of bias-binding yarns (+V and −V) can be uniquely used whereby they can be laid respectively in two opposite diagonal directions of the disposed set of axial yarns (X). As a consequence, the multiaxial noobing process can be also uniquely performed and a pre-tensioned multiaxial noobed fabric uniquely produced as shown in FIG. 10*a*, which represents the multiaxial noobed fabric's structure as viewed from one of the end sides of the disposed set of axial yarns (X). Further, it will be also obvious now to a person skilled in the art that the noobing process can be modified whereby only one set of binding yarns (for example Z) and only one set of bias-binding yarns (for example +V) are incorporated, together with set of axial yarns (X) in yet another novel noobed fabric which then comprises a set of axial yarns (X), a set of binding yarns (Z) and a set of bias-binding yarns (+V) as shown in FIG. 10*b*. Further, it will be also obvious that a noobed fabric can be produced wherein only some binding yarns of a given direction (for example binding yarns (Y), some bias-binding yarns (−V), all binding yarns of set (Z) and all disposed set of axial yarns (X) are incorporated as shown in FIG. 10*c*. Such constructions of 3D fabrics can be useful as optimized material solutions for certain applications.

Figure 11C:
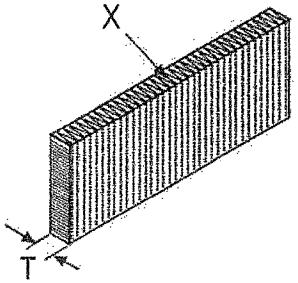
FIGS. 11*a-c* exemplify orientation of set of axial yarns (X) in 3D fabric's length, width and thickness directions respectively.
Figure 11F:
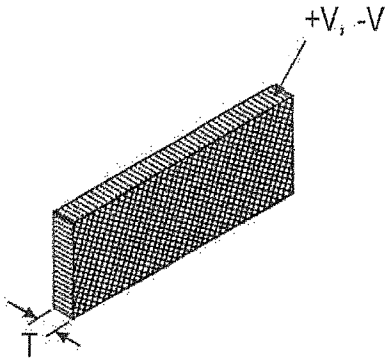
FIGS. 11*d-f* exemplify arrangement of planes of bias-binding yarns (+V and −V) occurring stacked in multiaxial 3D fabric's length, width and thickness directions respectively.
Figure 11B:
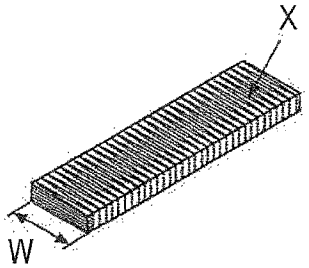
Figure 11E:
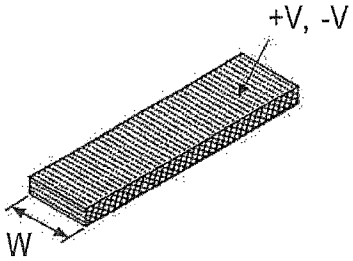
Figure 11A:
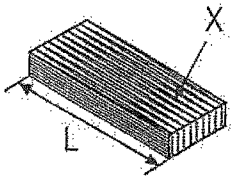
Figure 11D:
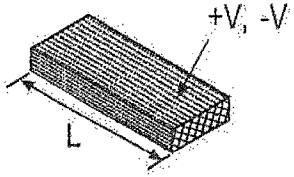

Another novelty that needs to be pointed out here is that the noobing process according to the present invention enables the set of axial yarns (X) to be directly incorporated in the orientation of either 3D fabric's length direction (L) or width direction (W) or thickness direction (T) as shown respectively in FIGS. 11*a-c*. This unique possibility of the noobing process also allows to directly produce corresponding novel multiaxial noobed fabrics wherein the stacked planes of bias-binding yarns (+V and −V) occur respectively in multiaxial 3D fabric's either length or width or thickness directions, without requiring any special changes to the setup. As a consequence, the stack of planes of bias-binding yarns (+V and −V) can be uniquely directly made to occur in either multiaxial noobed fabric's length (L) or width (W) or thickness (T) directions as represented in FIGS. 11*d-f* in which only the bias-binding yarns (+V and −V) are indicated for ease in representing their disposal to bring forward clearly their different arrangements. The disposed set of axial yarns (X) and the sets of binding yarns (Y and Z) are intentionally not shown.

Figure 12:
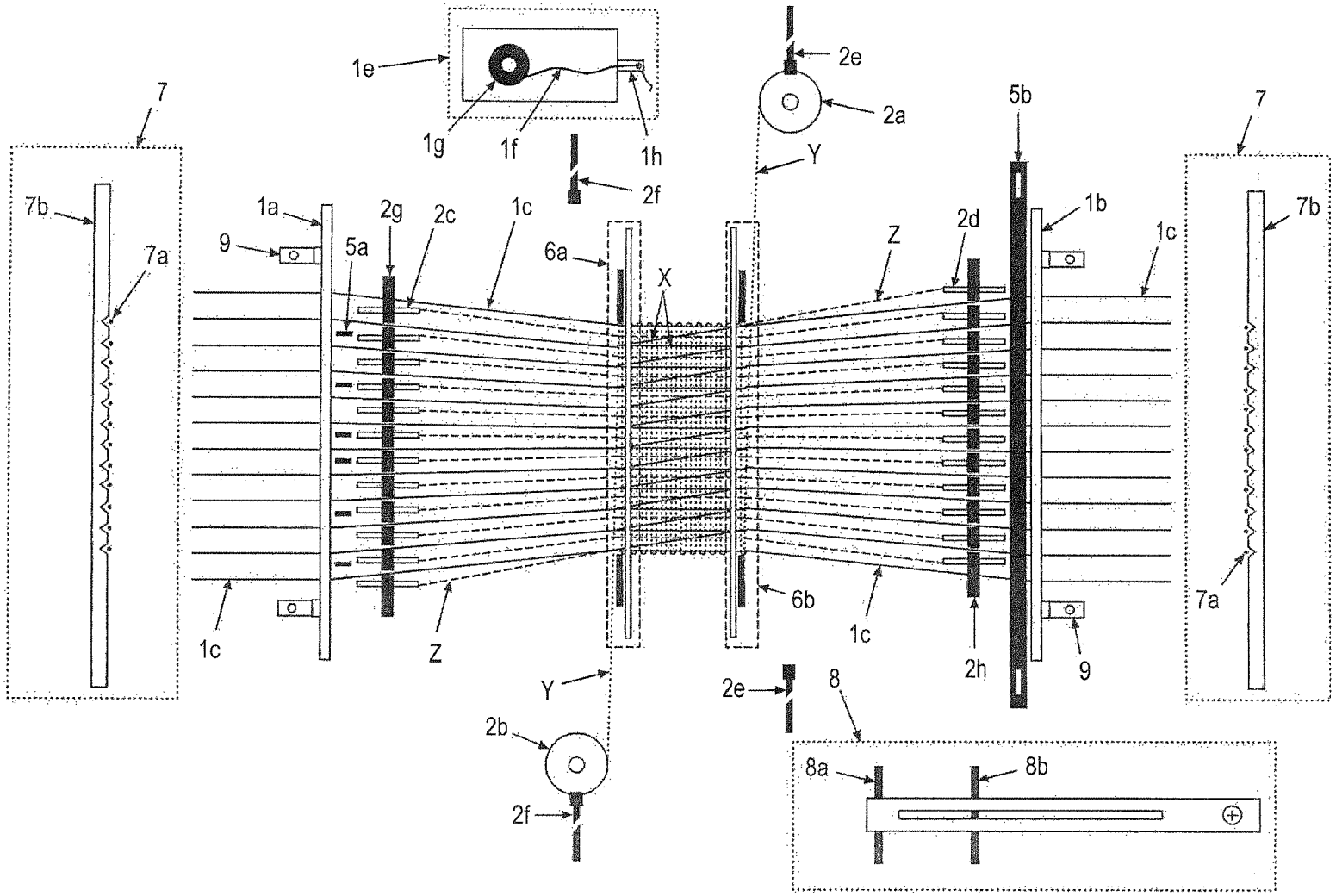
FIG. 12 exemplifies the relative arrangement (top view) of main embodiments of noobing device.

The above described novel noobing process, both uniaxial and multiaxial types, are practically realized through an innovative noobing device. In FIG. 12 are shown the relative arrangements of various preferred embodiments of the novel noobing device from top view, details of which shall become clear in the description that follows next. The same noobing device can be employed to produce directly both the uniaxial and multiaxial noobed fabric types with a basic change relating to inclusion/exclusion of a system for laying bias-binding yarns (or operating/not-operating the system for laying the bias-binding yarns if included in the noobing device). Although in FIG. 12 this unit is not shown, it will be presented where necessary.

Figure 13A:
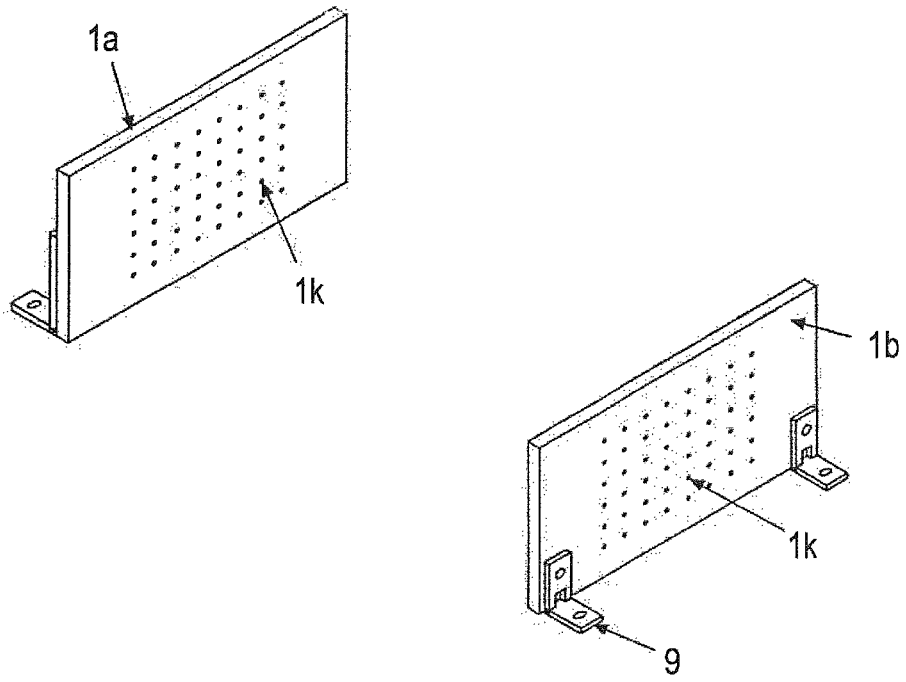
FIGS. 13*a-b* exemplify respectively support walls with hinges for tilting and support walls with slots for laying a set of binding yarns.

The noobing device comprises two walls (1*a* and 1*b*) the relative positions of which are shown in FIG. 12. In FIG. 13*a* are shown two walls (1*a* and 1*b*), which are preferably part of a framework (not shown) and arranged preferably in relatively parallel disposition to each other. These walls (1*a* and 1*b*) are always separated by a certain distance as indicated in FIG. 12 to enable between them production of one of the 3D fabric's dimensions, i.e. either the length or width or thickness. The walls (1*a* and 1*b*) are so arranged in the support framework that they can be relatively displaced and locked in required positions whereby distance between them enables production of required dimensions of either length or width or thickness of 3D fabric. Further, either one or both these walls (1*a* and 1*b*) can be also had in inclined configuration relative to a suitable member of the device's framework if required, for example to produce tapered ends. The said inclined configuration can be in either latitudinal or longitudinal directions of either one or both walls (1*a* and 1*b*). Further, these walls (1*a* and 1*b*) can be also had axially offset from each other, for example when producing a 3D fabric the end surfaces of which are mutually parallel but at an angle other than 90° relative to the longitudinal side surfaces. Further, these walls (1*a* and 1*b*) are so arranged and mounted on the framework that they can be turned relatively axially to a desired angle, for example when producing helix-like and screw-like 3D fabrics. The turning of the walls (1*a* and 1*b*) in the support framework is preferably performed in steps about their central axis. Further, the walls (1*a* and 1*b*) can be also arranged in the support framework whereby these two walls (1*a* and 1*b*) can be slid relative to each other during 3D fabric production, either in left-right directions or up-down directions, for example for producing a 3D fabric with either non-linear longitudinal sides (e.g. sine-wave, saw-tooth etc. forms) or parallelogram form or trapezoidal form etc. Further, each of the two walls (1*a* and 1*b*) can be individually composed of either one or more sections, for example for producing 3D fabrics that have branched/forked constructions etc. These sections of the individual walls (1*a* and 1*b*) can be also arranged in the support framework to be able to turn relatively axially or slide relative to each other or positioned at relatively different angles for purposes just described. Each of these walls (1*a* and 1*b*) can be either produced in single piece or by modular construction so that different sections can be added/removed in accordance with the form/shape and dimensions of 3D fabric to be produced.

Each of the walls (1*a* and 1*b*), the relative positions of which are indicated in FIG. 12, are provided with one or more suitable arrangements, such as holes (1*k*), for receiving and supporting a set of plurality of hook stems (1*c*) as shown in FIG. 13. The set of plurality of hook stems (1*c*) serves to support the axial yarns (X) in zigzag manner between the walls (1*a* and 1*b*). The hook stems (1*c*) are arranged preferably in spaced-apart configuration and in columns and rows, i.e. grid-like formation, whereby they provide passages between any two adjacent columns and any two adjacent rows of the hook stems (1*c*) for enabling passing of corresponding binding yarns (Z) and (Y). Further, the arrangement of said grid-like formation of hook stems (1*c*) also provides passages at an angle relative to either the columns or rows of the arranged hook stems (1*c*), such as in diagonal directions. Through these angular passages the sets of bias-binding yarns (+V and −V) can be passed to produce multiaxial noobed fabrics. The said grid-like arrangement of hook stems (1*c*) could be of either fixed type or variable type. For ease of explaining the idea, in FIG. 13*a* is exemplified the walls (1*a* and 1*b*) to be having holes (1*k*) for representing the fixed type arrangement. A variable type arrangement can be exemplified by an expandable-contractible trellis type, or similar, construction. Walls (1*a* and 1*b*) can be thus made from either a solid plate or a number of mutually arrange-able elements or it could be of modular construction type.

Figure 13B:
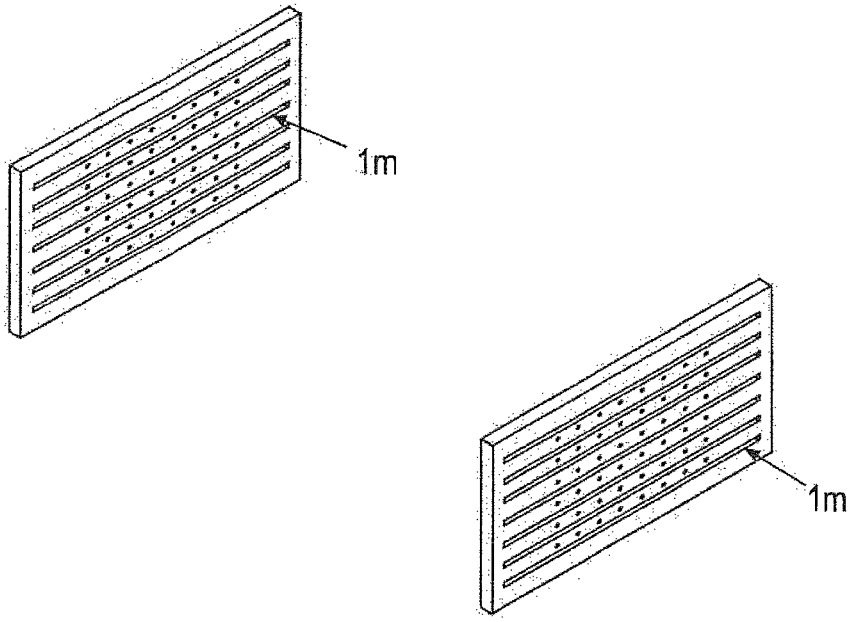

The walls (1*a* and 1*b*) could be also constructed in a manner wherein a series of parallel open slots (1*m*) are provided, as indicated in FIG. 13*b*, which shows the slots (1*m*) to be parallel to the rows of holes (1*k*), in both the walls (1*a* and 1*b*). Each of these slots (1*m*) serve for passing through each one of them, when required, a means for laying binding yarns, for example, the set of binding yarns (Y) in fabric-width direction. Alternatively, the slots (1*m*) could be also had either parallel to columns of holes (1*k*) or diagonally to holes (1*k*). Further, the slots (1*m*) in one wall, for example (1*a*), could be parallel to rows of holes and in the other wall (1*b*) parallel to the columns of holes (1*k*). The walls (1*a* and 1*b*) could be also alternatively constructed modularly using suitable strips/bars with holes. By fixing such strips with some gap between them, horizontal openings (1*m*) can be obtained. Such a novel construction and arrangement of walls (1*a* and 1*b*) uniquely benefits in laying continuously a single yarn, i.e. not the usual doubled/hairpin-like yarn, from large stationary yarn packages stationed at a suitable place in the noobing device.

Further, as shown in FIG. 13*a*, each of the walls (1*a* and 1*b*) are provided, either directly or indirectly, a hinge arrangement (9) the purpose of which is to tilt the walls for a functional purpose that will be explained later. Such a hinge arrangement (9) can be had at one of the sides of the wall, for example at the bottom side of the walls (1*a* and 1*b*). It may be noted that the walls (1*a* and 1*b*) need not be necessarily rectangular as shown in FIGS. 13*a* and 13*b*. They can be of any other suitable shape as well. Further, they need not be necessarily flat; they could be curved as well.

The described construction and arrangement of walls (1*a* and 1*b*) is advantageous not only from the simplicity of functional and operational flexibility they accord, but also its manufacture becomes easier and less expensive whereby the benefit of cost savings can be directly passed to, for example, the buyer of a noobing machine and also the noobing machine operator.

Figure 14A:
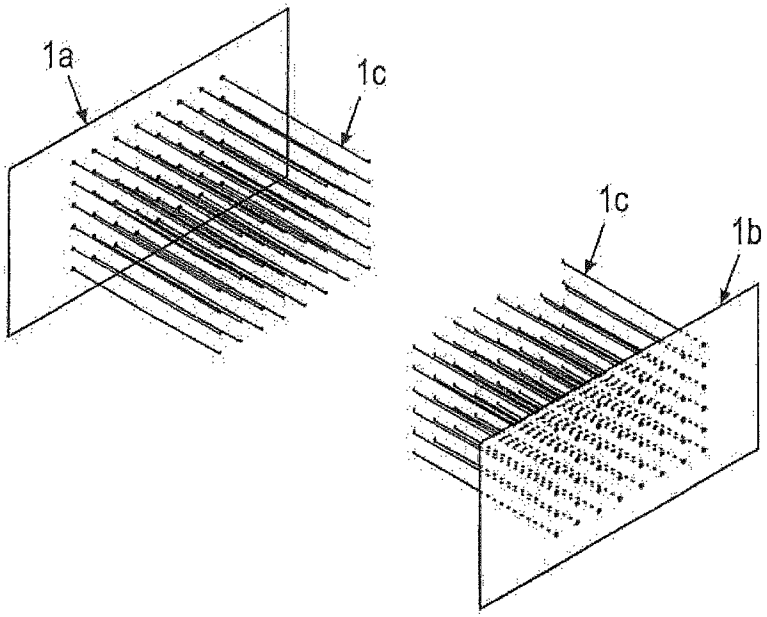
FIGS. 14*a-d* exemplify respectively arrangement of walls bearing hook stems facing each other and their ability to support the zigzag laid set of axial yarns (X) to incorporate them in the orientations of fabric's length, width and thickness.
Figure 14C:
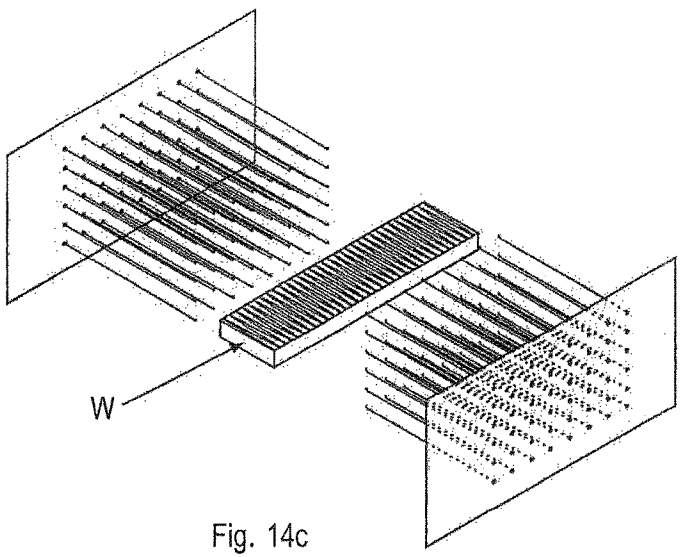
Figure 14D:
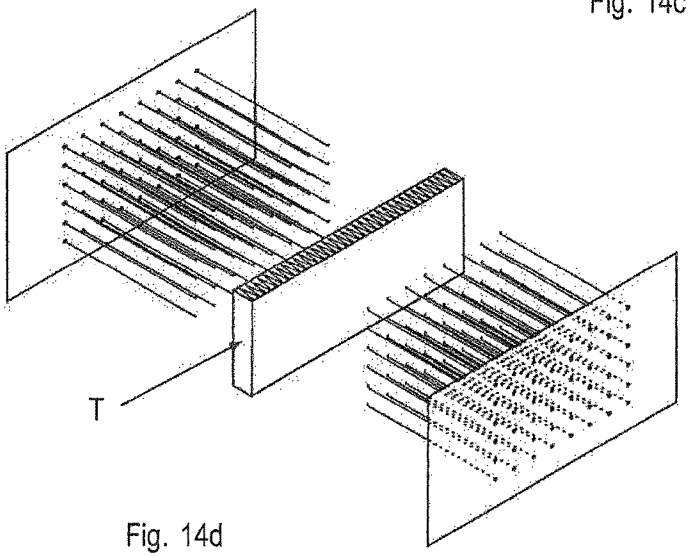
Figure 14B:
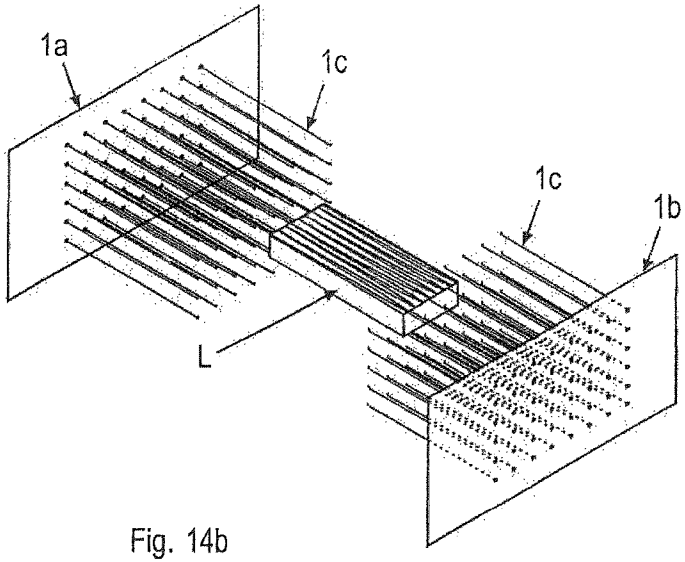

Further, a set of hook stems (1*c*) is supported and held by each of the walls (1*a* and 1*b*) such that their hooking ends are free and face each other as shown in FIG. 14*a*. Each of the hook stems (1*c*) is essentially composed of two parts—the hooking part and the stem part. These two parts can be either attachable-detachable type or unitized type. Only a part of the stem is supported and held by the corresponding wall (1*a* and 1*b*). The 3D fabric is always produced between the two sets of hook stems (1*c*) that face each other as indicated in FIGS. 14*b-d*. Thus, either the 3D fabric's length or width or thickness is directly producible between the two sets of hook stems (1*c*) that face each other. The number of hook stems (1*c*) supported by one of the walls can be either equal or unequal to that supported by the opposite wall, depending on the structural form/shape of the 3D fabric required to be produced. Accordingly, their arrangement can be either same or different. Further, the number of hook stems (1*c*) supported in a unit area of the walls (1*a* and 1*b*) can be either equal or unequal. Further, the relative thickness of the hook stems (1*c*) can be either same or different. Further, the thickness of a hook stem (1*c*) can be different at its hooking part and the stem part. Further, the hooking part and the stem part of hook stem (1*c*) can have a suitable shape or profile which can be either same of different. In any case, either the thickness or the shape/profile of the hooking part provides two spaced-apart surfaces and a certain smooth bending radius for a yarn to loop or fold safely to create an opening or passage in the looping or folding yarn.

Figure 14F:
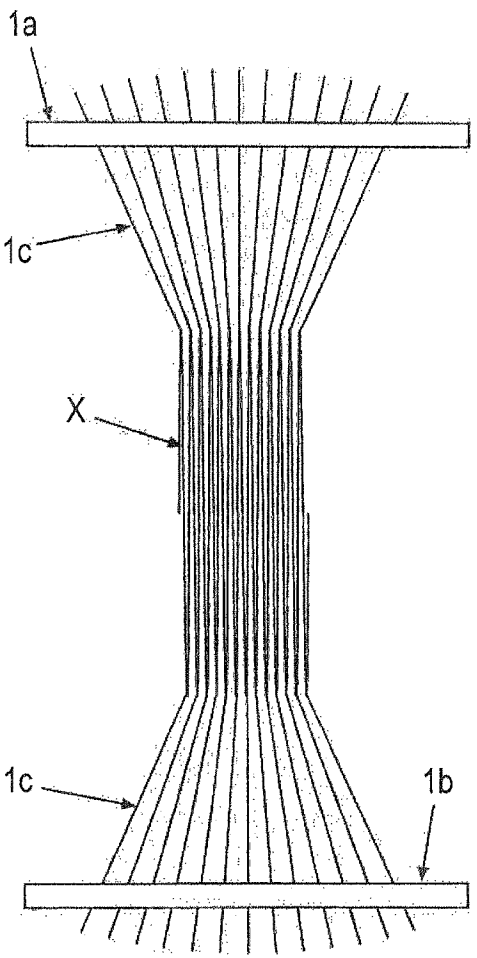
FIGS. 14*e-f* exemplify respectively one type of hook stem and top view of hook stems supporting and keeping the zigzag laid axial yarns (X) relatively closely at one end side while providing passages at the other end side for traversing means for binding yarns (Y, Z, +V and −V).
Figure 14E:
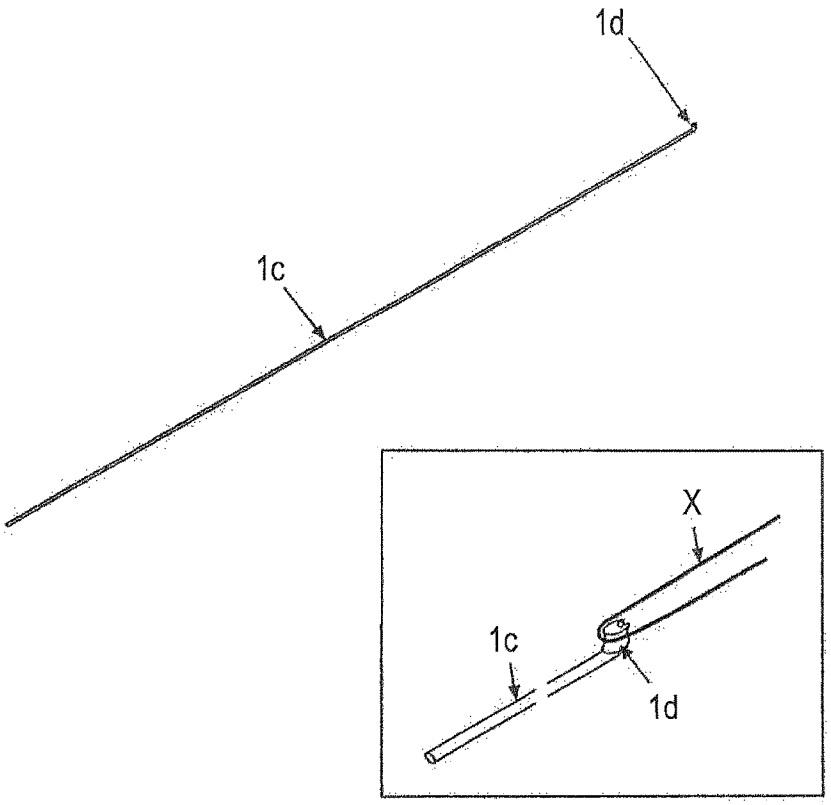

In FIG. 14*e* is exemplified a construction of a hook stem (1*c*). The hooking part of it, (1*d*), in accordance with working of the present invention, is preferably composed of a pair of spaced-apart surfaces that are either flat or non-flat and either projecting type or non-projecting type surfaces. In FIG. 14*e* is exemplified a hooking part (1*d*), which can be, for example, a suitably shaped wire bent at the fore end of the hook stem (1*c*), whereby the two spaced-apart sides of the shaped wire provide a pair of side surfaces for creating an opening/passage between the looping axial yarn (X) as shown in the inset of FIG. 14*e*. The hooking part (1*d*) functions as a yarn holder or supporter or hooker while lending itself to create a loop with certain opening in between the folding axial yarn (X). The stem part (1*c*) and the hooking part (1*d*) are together henceforth referred to as the hook stem (1*c*). The spaced-apart surfaces of hooking part (1*d*) have a certain distance between them to create an opening/passage through which another yarn can be inserted, preferably unhindered. As shall be described further on, the indicated construction of hook part (1*d*) is required for enabling integration of the loops of axial yarns (X) by passing the binding yarns (Y or Z) or bias-binding yarns (+V or −V) through the provided opening/passage. The hooking part (1*d*) is shaped/profiled to prevent the sitting looped/folded axial yarn (X) from slipping out while allowing binding yarns (Y and Z) to be laid unhindered. For example, the pair of projections of hooking part (1*d*) can be a smoothly curving wall, or a suitable hook-like restraint, to ensure that the held yarn will not slip out or get dislodged due to normal vibrations and other movements encountered during fabric production. Such a hooking part (1*d*) is also designed to provide a certain safe bending radius so that the held yarn is prevented from getting easily damaged. This feature is helpful especially when certain fibre types, such as the brittle and creasing types, are to be processed. Needless to state, such a hooking part (1*d*), which could be had in different constructions, for example through use of usual types of hooks and knitting needles employed in different textile processes, has to be highly smooth and rounded, and preferably coated with hardwearing and low-friction material.

Alternative types of hook stem (1*c*) could be also used. For example, it could be either a single metal wire/plastic monofilament having its fore end bent at an angle to the stem part, or a doubled hairpin-like wire that is bent/folded into a hook to provide a passage for yarn to pass through as mentioned earlier, or a peg-like hooking object attached to the stem, or a wire with a folded ring attached to it etc. Further, the hooking part (1*d*) and the stem part (1*c*) can be constructed of either similar or different materials. In any case, the construction of hook stem (1*c*) has the necessary dimensions and/or suitable shape/profile for its hooking part (1*d*) to accord smooth bending radius to a yarn for looping or folding safely and spaced-part surfaces, projecting or not, to help create an opening or passage in the looped or folded axial yarn (X).

Hook stems (1*c*) are preferably of the flexible but inextensible type and have a certain length. The hooking part (1*d*) of hook stem (1*c*) projects out from the surface of the supporting walls (1*a* and 1*b*). The length of each of the hook stems (1*c*) projecting from each of the walls (1*a* and 1*b*) is preferably individually adjustable to enable production of either 3D fabric's length or width or thickness dimensions, in conjunction with the relative positioning of the walls (1*a* and 1*b*). The lengths of each of the hook stems (1*c*) projecting from each of the walls (1*a* and 1*b*) can be either equal or unequal in accordance with the form/shape of the 3D fabric desired to be produced. For example, the relative projecting lengths of hook stems (1*c*) from a given wall (either 1*a* or 1*b*) can be either same or different when producing tapered, stepped, recessed, a curved surface etc. 3D fabric objects. In any case, the 3D fabric is always produced supported between the hooking parts (1*d*) of two sets of hook stems (1*c*) that face each other.

For producing a 3D fabric with uniform yarn distribution and dimensions, it is preferable that the length of each hook stem (1*c*) of a given set projecting out from the wall concerned (either 1*a* or 1*b*) is kept as long as possible (with respect to particular specifications of a noobing device) so that their hooking parts (1*d*) can be brought relatively closer to each other while the stem parts (1*c*), supported at respective walls (1*a* and 1*b*), remain spaced-apart and in column (and row) configuration as can be inferred from FIG. 14*f*. It is preferred that the cross-sectional dimension of the hook stem (1*c*) is relatively less at the hooking part side than that at the wall side to allow their relatively closer packing to produce 3D fabric with satisfactory characteristics. Further, the projecting lengths of the outermost hook stems (1*c*) could be relatively longer than those of the inner hook stems (1*c*) when producing, for example a cube or cuboid shaped 3D fabric. To enable adjustment of projecting lengths of hook stems (1*c*), a suitable arrangement, such as locking screws or nuts or paired sliding plates etc. can be provided in the walls (1*a* and 1*b*). Through such varying projecting lengths of hook stems (1*c*) it becomes uniquely possible to directly produce a 3D fabric, for example one with varying longitudinal length, or one with members projecting from a surface, or one with contoured surface, or one with pit, recess, taper, groove, slot, hole, cut etc.

Further, depending on the particular construction of the noobing device needed, the segment of hook stem (1*c*) passing through the walls (1*a* and 1*b*) can be either temporarily or permanently fixed to the respective walls (1*a* and 1*b*) through suitable arrangements such as adhesive bonding, soldering, welding, screws, mechanical sliding plate locks, magnets, offset plates etc. The hook stems (1*c*) could be also fixed to the respective walls (1*a* and 1*b*) through tensioning arrangements such as suitable springs. While the permanent type fixing is suitable for repeatedly producing one specific shape and dimension of 3D fabrics, the temporary type allows flexibility in increasing-decreasing the projection length of hook stem (1*c*) and addition-removal of hook stems (1*c*), for producing 3D fabrics of different forms, shapes and cross-section dimensions as per different requirements.

It will be obvious now to a person skilled in the art that through suitable construction of walls (1*a* and 1*b*), and in conjunction with incorporation of a suitable programable means for controlling the selection of hook stems (1*c*) to either attach-detach them from the respective walls (1*a* and 1*b*) or engage-disengage them at will, or as and when required, the set of axial yarns (X) can be correspondingly selected/arranged to produce the desired shaped/formed 3D fabrics directly. Such a programable means for controlling selection of hook stems (1*c*) is outside of the present invention and hence not described further.

Nonetheless, it can be indicated here that a noobing device can be operable even without incorporation of the particular programable means for controlling selection of hook stems (1*c*), for example, robotically and manually. The required changes relating to movement of one or more hook stems (1*c*) can be performed, for example, by sliding the hook stems (1*c*) correspondingly either towards or away from the 3D fabric under production, moving them out of positions etc. by known mechanical, electrical, magnetic, pneumatic etc. systems which are unnecessary to detail here. For producing a variety of shaped 3D fabrics either the projecting length of hook stem (1*c*) can be varied during 3D fabric production by moving them axially, or by moving/displacing their hooking parts (1*d*) laterally/sidewards, or by adding-removing them during 3D fabric production, or by operationalizing them to either engage with new yarns or disengage from held looped axial yarns (X) as and when required during production to obtain 3D fabrics that are, for example, of irregular form/shape, dimensions, varying cross-sectional dimensions, varying cross-sectional shapes etc.

It will be obvious now to a person skilled in the art that the arrangement of hook stems (1*c*) in the walls (1*a* and 1*b*) need not be necessarily as indicated in FIGS. 14*a-d*, but can be had in different configurations, for example, arranged in circular, elliptical, polygon, other regular and irregular shapes etc. Further, such arrangements of hook stems (1*c*) in walls (1*a* and 1*b*) could be either similar or dissimilar, for example circle-like in one wall and square-like in the opposite wall to produce a 3D fabric that has its cross-sectional shape at one end changing to another at the other/opposite end.

The described incorporation and arrangement of hook stems (1*c*) and the walls (1*a* and 1*b*) in the noobing device is advantageous in that they at once eliminate the use of creel and associated setting-up work involved, besides according immense flexibility in producing directly, quickly and efficiently a variety of customized uniaxial and multiaxial types of noobed fabrics on the same noobing device whereby such a noobing process and device becomes obviously commercially attractive.

Figure 15:
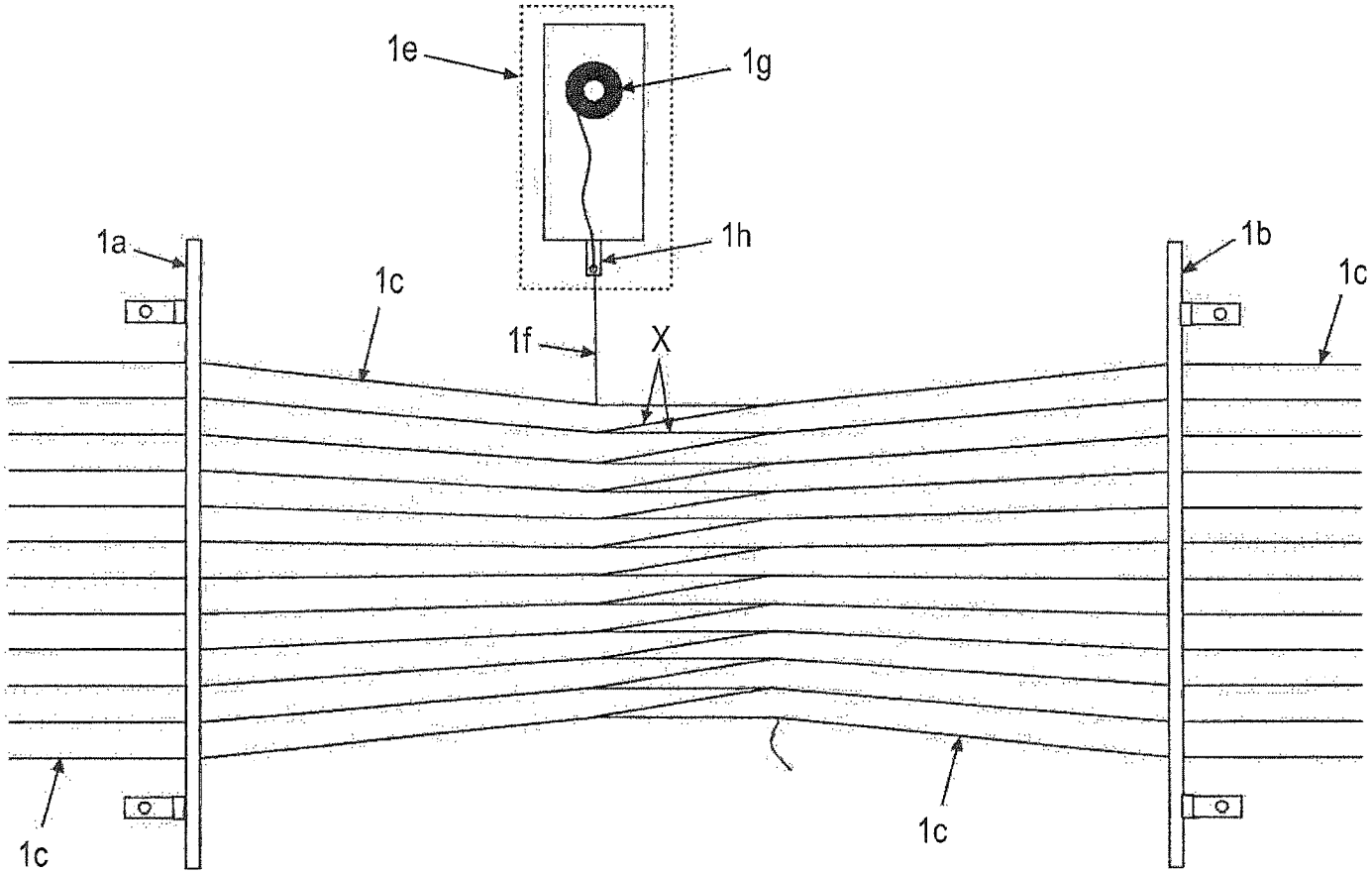
FIG. 15 exemplifies the laying of axial yarns (X) (top view) in zigzag fashion between the two sets of hook stems facing each other by the yarn laying unit.

The noobing device further incorporates a unit (1*e*) for laying axial yarns (X), as represented in FIG. 12. Unit (1*e*) can move in three mutually perpendicular directions (i.e. in XYZ directions). The purpose of unit (1*e*) is to feed and lay the yarn (1*f*) being paid out in tension to setup the set of axial yarns (X) between the hook parts (1*d*) of the hook stems (1*c*) that face each other as indicated in FIG. 15. The unit (1*e*) can be any arrangement, including a robot, that can lay continuously a yarn (1*f*) in tension and in a zigzag manner between the hooking parts (1*d*) of the two sets of hook stems (1*c*). It can lay the set of axial yarns (X) in either one or more than one parallel planes continuously. Working details of such a yarn laying unit are well known and hence unnecessary to describe them further. It may be mentioned here that unit (1*e*) lays the yarn (1*f*) between oppositely facing hook stems (1*c*) one by one. The hook stems (1*c*) are individually brought into the necessary working position successively, either through a suitable means or manually, whereby it gets engaged with the yarn (1*f*) presented by unit (1*e*). The zigzag laid yarn (1*f*) then constitutes the set of axial yarns (X). Nonetheless, unit (1*e*) constitutes a component of the present noobing device and its inclusion uniquely reduces the time and effort required for setting up set of axial yarns (X) between two sets of hook stems (1*c*) that face each other. Inclusion of unit (1*e*), while eliminating the problem of improper or incorrect setting up yarns, uniquely aids automation of the noobing process. For example, the same yarn laying unit (1*e*) can be used to lay and set-up yarns on one noobing device while another noobing device is producing a 3D fabric. All these advantages of unit (1*e*) jointly help in increasing the productivity of a group of noobing devices and reducing the production cost of 3D fabrics.

As can be understood from FIGS. 12 and 15, which are the top views, the yarn laying unit (1*e*) delivers yarn (1*f*) from a suitable package (1*g*) that is preferably suitably held and carried by unit (1*e*). Yarn (1*f*) emanating from the package (1*g*), such as a bobbin, passes through a suitable tensioning exit element (1*h*), which can be, for example, suitably reciprocated at right moments to enable the individually presented hooking parts (1*d*) of hook stem (1*c*) to catch/engage with the paid out yarn (1*f*), in conjunction with assistance of a hook stem (1*c*) selecting and positioning system (not shown), as unit (1*e*) traverses back and forth in a plane. The movement of unit (1*e*) is suitably programmed to move in required distances in X, Y and Z directions/axes whereby the paid out yarn (1*f*) is deposited in a zigzag fashion between two sets of hooking parts (1*d*) of hook stems (1*c*) that face each other as can be inferred from FIGS. 14*f* and 15. The zigzag laid yarn (1*f*) then constitutes the set of axial yarns (X) of the to-be-produced 3D fabric as shown in FIG. 15.

To start with, the leading end of yarn (1*f*) is secured at a suitable place, for example the relevant wall (1*a* or 1*b*), by using adhesive tape, tying, knotting, drawing through a hole in the wall (1*a* and 1*b*) etc. Preferably yarn (1*f*) is then continued to be first laid in a zigzag fashion between the lowest row/level of hook stems (1*c*) as this will make it easier (non-interfering) to lay continuously the yarn in a zigzag manner at the next upper level, and so on, to build as many zigzag stacks of yarn (1*f*) as may be required to realize approximately the length, width and thickness dimensions concerned of the required set of axial yarns (X) for the to-be-produced 3D fabric. The number of zigzags of the yarn (1*f*) in a plane depends on the final dimensions and shapes of the customized 3D fabric to be produced. After laying of yarn (1*f*) is completed, its trailing end is also likewise secured.

Once the yarn (1*f*) has been laid according to the production requirements of 3D fabric, unit (1*e*) is either positioned in a stationary manner at a suitable location in the noobing device or preferably moved to another noobing device for laying another set of axial yarns (X) on that noobing device instead of keeping it idle. Unit (1*e*) can be brought back to first noobing device to lay again yarn (1*f*) when needed, for example, to add extra axial yarns (X). The additional axial yarn (X) could be laid in either singles or doubled at required places along with the laid zigzag axial yarns (X). Another advantage of moving the unit (1*e*) between two or more noobing machines, than keeping it stationary/idle at one noobing device, is that free space is created for the other to-be-described operating systems of the noobing device to work relatively simply whereby the noobing device tends to become relatively compact, easy to operate and less expensive.

As can be inferred now, incorporation of unit (1*e*) uniquely does away with use of creel and thereby drawbacks thereof. Its incorporation as a working organ of the noobing device directly benefits in reducing the setting up time and costs of producing customized uniaxial and multiaxial types of noobed fabrics, besides enabling direct production of shaped and contoured 3D fabrics on the same noobing device. Incorporation of one unit (1*e*) to service a group of noobing devices, in a suitable sequence, reduces the cost of a noobing device besides rendering the production of 3D fabrics cost-effective.

Figure 16:
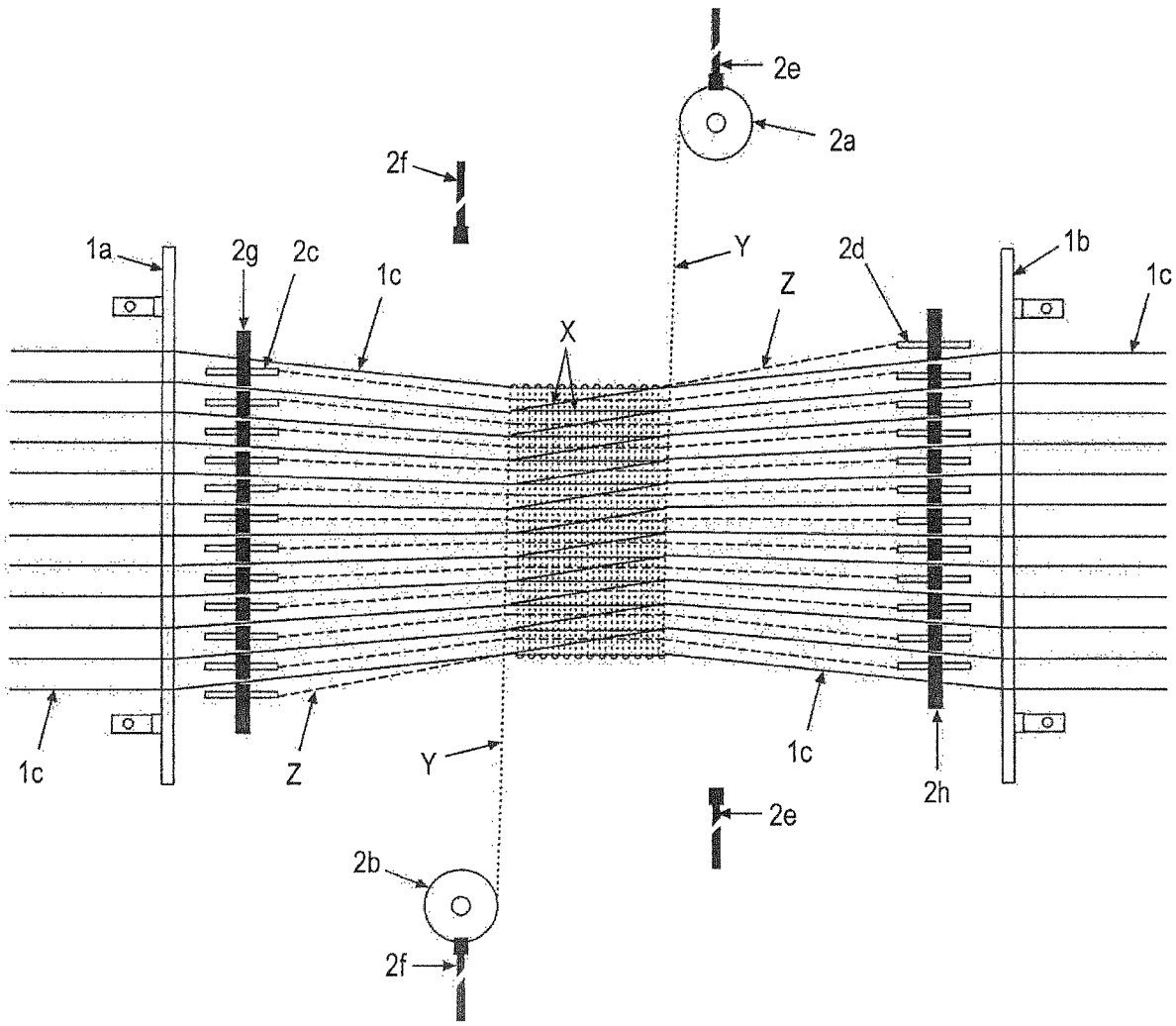
FIG. 16 exemplifies the arrangement (top view) for traversing the binding yarn carriers of the paired sets of binding yarns (Y) and (Z) for simultaneous "middle-outward" production of 3D fabric.

The noobing device further comprises preferably two directionally-paired sets of binding yarn carriers (2*a*-2*b* and 2*c*-2*d*), for carrying binding yarns of the sets (Y) and (Z) respectively (as indicated in the insets of FIGS. 2 and 3), the relative positions (top view) of which are indicated in FIG. 12. Use of two directionally-paired sets of binding yarn carriers (2*a*-2*b* and 2*c*-2*d*) help to produce the 3D fabric "middle-outwards". Their corresponding transporting members (2*e*-2*f* and 2*g*-2*h*), as viewed from top, are indicated in FIG. 16. The binding yarn carriers (2*a*-2*b* and 2*c*-2*d*) are preferably slender/narrow, flanged spools in which a yarn can be wound preferably only in single file/column within the flanges. The binding yarn carriers (2*a*-2*b* and 2*c*-2*d*) can be had preferably in different yarn carrying capacities to suit production of 3D fabrics of different dimensions. For example, to produce relatively thinner 3D fabrics correspondingly smaller capacity binding yarn carriers would be adequate than when producing relatively thick 3D fabric. Likewise if a 3D fabric with thick and thin regions is to be produced, then correspondingly suitable combination of binding yarn carriers could be selected. Use of binding yarn carriers of different capacities is advantageous from the points of reducing yarn wastage and lowering energy requirements for their handling and movement. The binding yarns (Y) and (Z) are paid out under tension through use of a suitable tensioning arrangement in each of the carriers (2*a*-2*b* and 2*c*-2*d*).

Because the 3D fabric is uniquely produced "middle-outwards" by the innovative noobing process considered herein, a pair of binding yarn carriers (2*a*-2*b* and 2*c*-2*d*) are employed for laying each binding yarns (Y and Z) in their respective assigned direction (for example, in width and thickness directions). The cyclical laying of these binding yarns (Y and Z) will gradually cause their getting stacked in the fabric's length direction "middle-outwards" (i.e. from middle towards respective end sides) as the fabric builds up during production. Therefore, the time required for producing a given length of 3D fabric gets halved. Further, by having a binding yarn wound partly in two binding yarn carriers the binding yarn carrying capacity of each carrier is further reduced by half. As a consequence, the binding yarn carriers tend to become further smaller, slender and lighter. These features collectively help in speeding up the noobing process.

Depending on the type of construction employed, either one or both flanges of the binding yarn carriers (2*a*-2*b* and 2*c*-2*d*) are preferably of either solid sheet (with or without ribs) or suitably blanked sheet (such as window, perforated, slotted, spoke-like etc. construction types). All edges of the binding yarn carriers are rounded and smoothened to prevent fibre breakage and fibre pull-out. For similar reasons the internal and external surfaces are preferably flat and polished. Further, the flanges are either circular or polygonal (hexagonal, square and rectangular etc.) or a combination type in shape. Also, the two flanges of the binding yarn carriers (2*a*-2*b* and 2*c*-2*d*) could be relatively either equal or unequal in their dimensions and either similar or dissimilar in their shapes. Also, preferably the construction of binding yarn carriers is such that either one of the flanges of a binding yarn carrier can be turned relative to the other or their core can be turned relative to either one or both flanges. The overall exterior shape and surface of the binding yarn carriers is such that their transportation through the set of axial yarns (X) will not catch yarns, particularly those of the set of axial yarns (X). Further description of a binding yarn carrier (2*a*-2*d*) is unnecessary to detail here as it is outside the scope of present inventions.

The binding yarn carriers (2*a*-2*b* and 2*c*-2*d*) are preferably moved from one position to opposite, in their respective assigned directions, by passing them through the grid-like arranged stems (1*c*) that are supporting the disposed set of axial yarns (X). The binding yarn carriers (2*a*-2*b* and 2*c*-2*d*) are preferably traversed in a positively controlled manner (i.e. they are not thrown or propelled) by corresponding paired sets of transporting members (2*e*-2*f* and 2*g*-2*h*), as shown in FIG. 16. Their transportation is preferably achieved by either gripping or connecting with either one or both of the flanges or other member/s of the carrier. The transportation of binding yarn carriers (2*a*-2*b* and 2*c*-2*d*) is preferably performed by either mechanical or electromechanical or magnetic or pneumatic gripping, or suitable combination etc. methods. All the involved binding yarn carriers (2*a*-2*b* and 2*c*-2*d*) can be moved either collectively or in suitable desired groups or individually. Further, all the binding yarn carriers of a given direction can be traversed either in the same direction or some of them in mutually opposite directions. The binding yarn carriers of a given direction can be traversed in either same path (i.e. between same columns and rows of set of axial yarns) or different paths (e.g. switching between different columns/rows of set of axial yarns (X)) to create binding yarn floats on the 3D fabric's surfaces during production of 3D fabric. Also, the binding yarn carriers (2*a*-2*b* and 2*c*-2*d*) can be traversed either simultaneously or in any desired sequences to produce a 3D fabric with varying concentrations of binding yarns.

The transportation of binding yarn carriers (2*a*-2*b* and 2*c*-2*d*) is actuated by corresponding sets of suitable paired transporting members (2*e*-2*f* and 2*g*-2*h*) indicated in FIG. 16. As indicated, the directionally paired transportation members (2*e*-2*f*) are positioned in device's framework through suitable arrangements (not shown) to transport the binding yarn carriers (2*a*-2*b*) in, for example, 3D fabric's width direction and the directionally paired transporting members (2*g*-2*h*) are positioned to transport the binding yarn carriers (2*c*-2*d*) in 3D fabric's thickness direction. Alternatively, suitable robots could be also installed/employed to transport the binding yarn carriers (2*a*-2*b* and 2*c*-2*d*).

The simultaneous transportation of pair of binding yarn carriers "middle-outwards" in each of their respective directions helps to uniquely speed-up the production without increasing the speed of the machine and also reduces the cost of 3D fabrics' production. The possibility of traversing the binding yarns carriers (2*a*-2*b* and 2*c*-2*d*) in any sequence, and at will, accords high flexibility in producing a wide range of shaped 3D fabrics on the same noobing device. As can be inferred now, the binding yarn carriers (2*a*-2*b* and 2*c*-2*d*) can be moved between any desired adjacent columns (and rows) of the disposed set of axial yarns (X) whereby the binding yarns can be floated on the 3D fabric's surfaces in suitable directions for improving the mechanical performance and surface smoothness of composite materials as discussed earlier. By such traversal, binding yarns (Y and Z) can be floated on 3D fabric's surface/s in different directions relative an edge of 3D fabric to directly obtain novel partial multiaxial structures.

The noobing device according to the present invention also uniquely allows either the set of binding yarns (Y or Z) to be laid through the set of axial yarns (X) "middle-outwards" by an alternative arrangement wherein a select set of binding yarn carriers is not used. In this novel arrangement the selected set of binding yarns are drawn from externally stationed spools. Such binding yarns are uniquely laid in singles, and not as doubled/hairpin-like when using needles. For example, when producing a wide 3D fabric, the set of binding yarns (Y) can be laid in singles through the horizontal slots (1*m*) in the walls (1*a* and 1*b*) shown in FIG. 13*b*.

To lay the binding yarns of a set in singles from a stationary source, preferably a set of suitable tubes or strips with guides or the like is used through which the chosen set of binding yarns, drawn from respective stationary spools, are passed. For every horizontal opening (1*m*) in the walls (1*a* and 1*b*), a corresponding tube/strip is used. The tubes of this set are partly inserted in the horizontal openings (1*m*). While the binding yarn exit side of the tubes lie facing the 3D fabric production side freely, the binding yarn entry side of the tubes lie at the outer side of the respective walls (1*a* and 1*b*) and are suitably fixed to an arrangement, such as a vertical bar connected to a pneumatic cylinder, so that all the tubes/strips can be collectively traversed back and forth in the respective horizontal opening (1*m*). As the set of tubes/strips is reciprocated, the binding yarns of the corresponding set get individually laid in singles between the rows (and possibly even above and below the rows, if horizontal openings (1*m*) are provided there) of the set of axial yarns (X). As the sets of vertical and horizontal binding yarns (Y) and (Z) are laid, preferably alternately, as indicated in FIGS. 6-9, the structural integrity of the 3D fabric is achieved directly by the binding yarns (Y and Z) which fold and integrate with the set of axial yarns (X). Through this arrangement it becomes easier and quicker to produce certain 3D fabrics, such as relatively wide and thin flat 3D fabrics. Such novel arrangement also renders their production highly cost effective.

A special feature of either described arrangement is that because the 3D fabric is produced simultaneously "middle-outwards" towards the two end sides of the set of axial yarns (X), the fabric's constructional architecture can be made differently at either sides of the middle starting point to advantage. For example, while one half of 3D fabric is produced with one type of yarn spacing arrangement, the other half of the 3D fabric could be produced with entirely different yarn spacing arrangement. Such a 3D fabric with different architectural constructions can be regarded as adequately optimized solution for a given application, i.e. engineered suitably for required performance. Further, it also becomes possible with the described arrangements to produce a 3D fabric, for example with different cross-sectional shapes at two ends and different dimensions at two ends, as mentioned earlier.

Figure 17A:
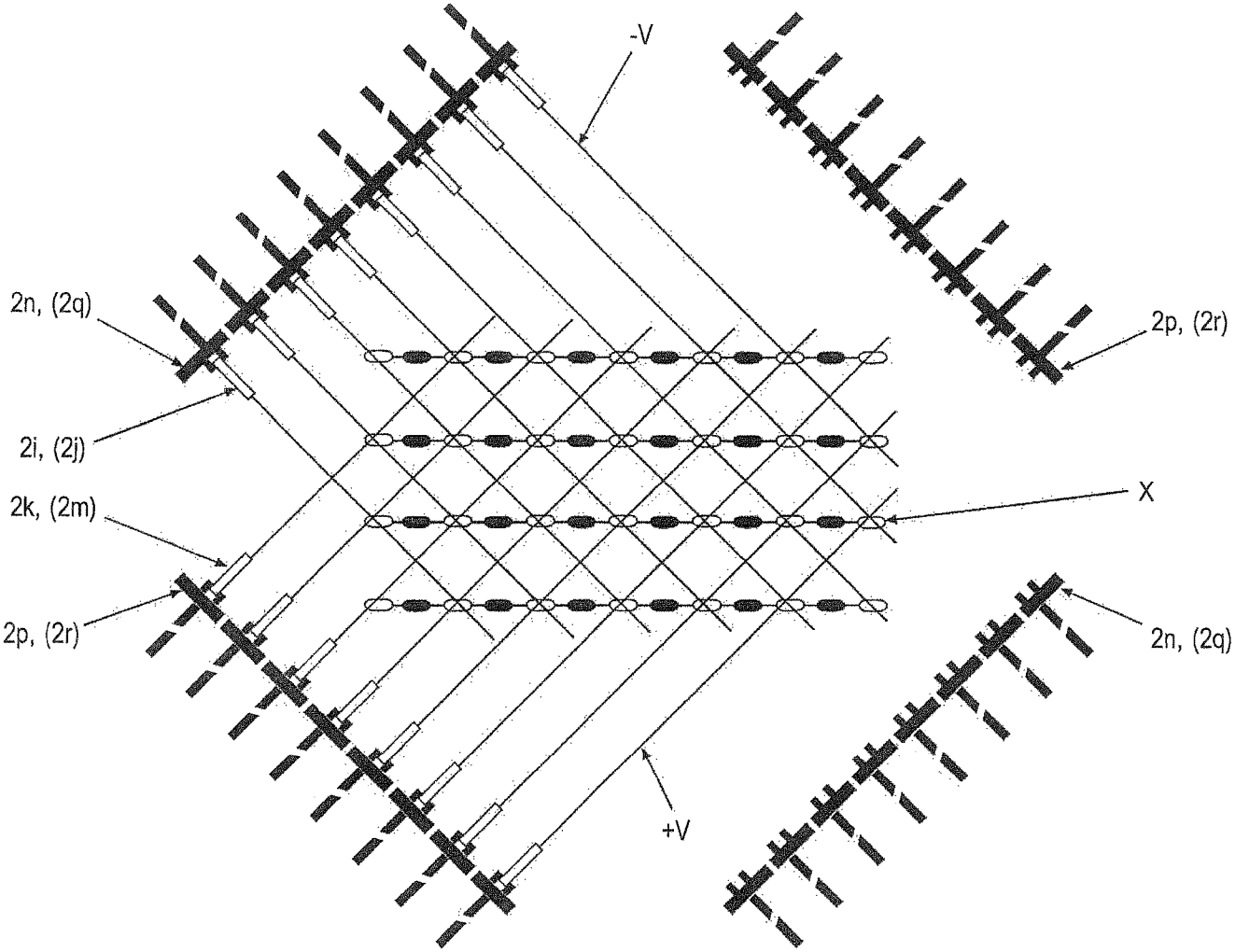
FIGS. 17*a-b* exemplify respectively normal and 'turned' arrangements (end views) of axial yarns (X) and corresponding arrangements for traversing bias-binding yarn carriers.

A person skilled in the art will realize now that another set of similar binding yarn carriers (2*i*-2*j* and 2*k*-2*m*) could be similarly advantageously employed for laying the set of bias-binding yarns (+V and −V) in two opposite diagonal or bias directions of the set of axial yarns (X) whereby production of another type of novel multiaxial noobed fabrics could be directly obtained as indicated in FIG. 17*a*. Because the set of axial yarns (X) could constitute the yarns of the 3D fabric's either length or width or thickness directions, as shown in FIGS. 11*a*-*c*, by laying bias-binding yarns (+V and −V) from bias-binding yarn carriers (2*i*-2*j* and 2*k*-2*m*) in diagonal or bias directions of the set of axial yarns (X) through incorporation of corresponding directionally paired sets of transporting arrangements (2*n*-2*p* and 2*q*-2*r*), as shown in FIG. 17*a* (which shows one of the end views of the set of axial yarns (X)), a range of novel multiaxial noobed fabrics can be directly produced. The uniqueness of such a multiaxial noobed fabric is that the planes of bias yarns (+V and −V) occur stacked directly in either 3D fabric's length or width or thickness direction as shown in FIGS. 11*d*-*f*. As is possible with binding yarns (Y and Z), the "middle-outward" 3D fabric production can be achieved with bias-binding yarns (+V and −V) as well.

Further, because the 3D fabric is producible "middle-outwards", the bias-binding yarns (+V and −V) can be included in either one or both the halves of 3D fabric being produced to obtain a further optimized structure. Further, an arrangement similar to the described arrangement for laying the binding yarns (Y) and (Z) can be similarly used to lay the bias-binding yarns (+V and −V) in desired/selected regions of the 3D fabric as shown in FIGS. 10 *b*-*c*, and not compulsorily in the entire cross-section areas being produced (as in FIG. 10*a*). Such areas could be any of the two opposite surfaces, and not limited to only the end surfaces of the 3D fabric. Production of such novel optimized high-performance multiaxial fabrics have not been known yet and stand clearly differentiated from the existing ones wherein the planes of bias direction yarns occur stacked in only the thickness direction of 3D fabric.

Figure 17B:
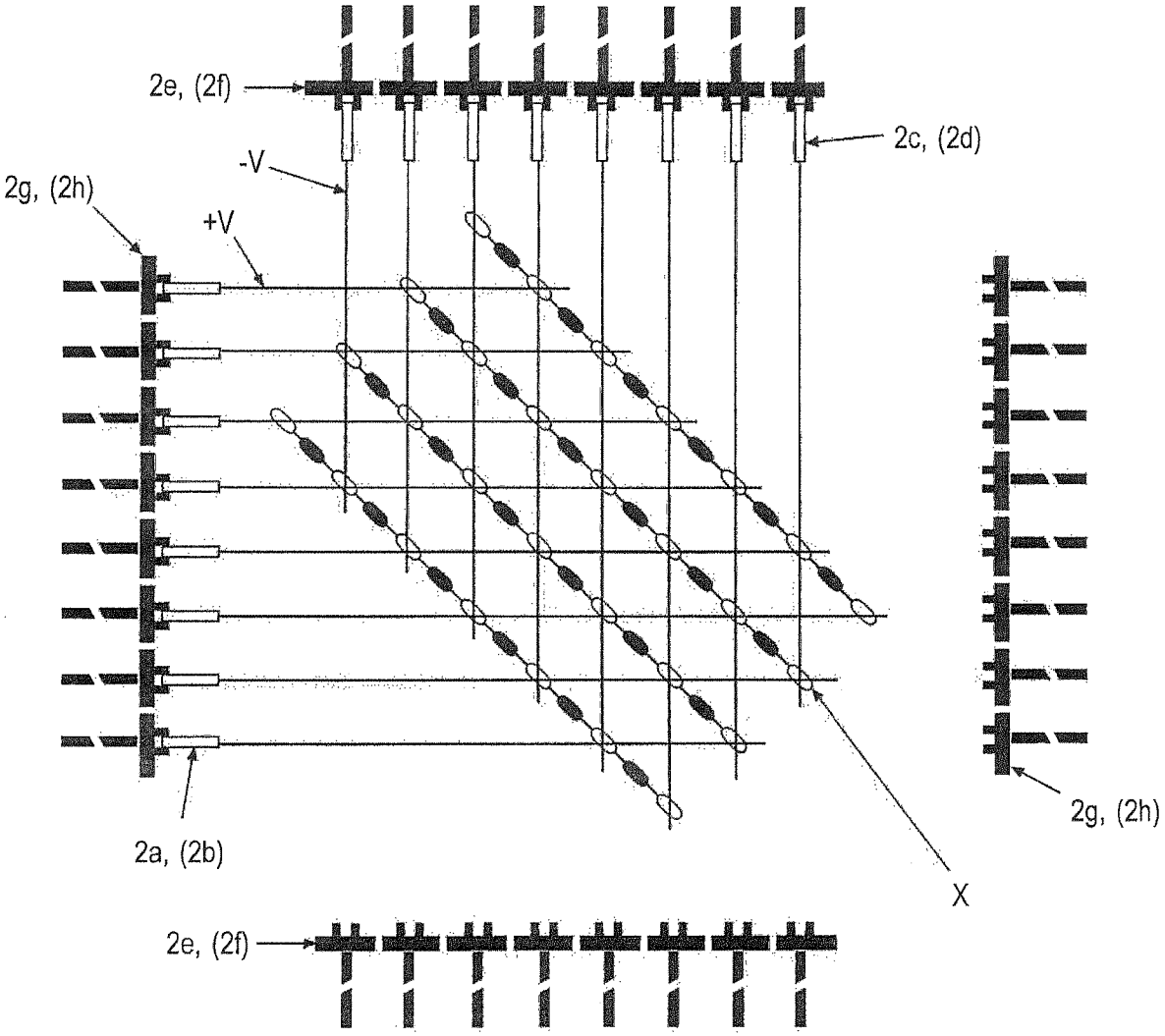

A novel feature of the described arrangement of transporting binding yarn carriers (2*e*-2*f* and 2*g*-2*h*) is that they can be also used to transport the binding yarn carriers (2*a*-2*b* and 2*c*-2*d*) to lay bias-binding yarns (+V and −V) as shown in FIG. 17*b* (which is a view of one end side of set of axial yarns (X)). To realize this, the walls (1*a* and 1*b*), which are supporting the set of axial yarns (X), are turned about their central axis in the frame of the noobing device (not shown) to correspondingly turn the set of axial yarns (X), as shown in FIG. 17*b*. This way the produced 3D fabric will constitute only the set of axial yarns (X) and bias-binding yarns (+V and −V). It may be also pointed out here that the means for transporting the binding yarn carriers (2*e*-2*f* and 2*g*-2*h*) and (2*n*-2*q* and 2*p*-2*r*) can be suitably arranged octagonally in two respective parallel planes whereby their working to lay the corresponding binding yarns (Y) and (Z), and bias-binding yarns (+V and −V), can be achieved without mutual interference to produce the multiaxial noobed fabric.

The noobing device further incorporates a novel dual-acting binding yarn packing arrangement (5*a* and 5*b*), the relative top view positions of which are indicated in FIG. 12. They are incorporated for controlled packing of binding yarns (Y) and (Z), as well as bias-binding yarns (+V and −V), that are laid through the set of axial yarns (X). This dual-acting binding yarn packing system (5*a* and 5*b*) comprises preferably two sets of stack-like arranged slats, each set of which is preferably located during its idle position close to the corresponding inner side of the walls (1*a* and 1*b*), as indicated in FIG. 12. While one set of the slats (5*a*) exists between respective columns of stem hooks (1*c*) (and hence columns of set of axial yarns (X)), the other set (5*b*) exists between rows of stem hooks (1*c*) (and hence rows of set of axial yarns (X)) as further explained below in reference to FIG. 18*a*. These sets of slats (5*a* and 5*b*) thus have different mutual orientation.

The slats of the two sets (5*a* and 5*b*) are moved simultaneously from two end sides of the 3D fabric (F) under production, preferably in alternate process cycles, to connect well with the last laid binding yarns tows (either Y or Z or +V or −V) to press/pack them laterally towards each other. As the slats (5*a* and 5*b*) simultaneously pack the respective last laid sets of binding yarns (Y) and (Z), and also the bias-binding yarns (+V and −V) when laid, from two opposite end sides of set of axial yarns (X), their dual packing action compresses the laid binding yarns laterally and packs them close to each other tightly to produce the 3D fabric (F) with high fibre volume-fraction.

Figure 18A:
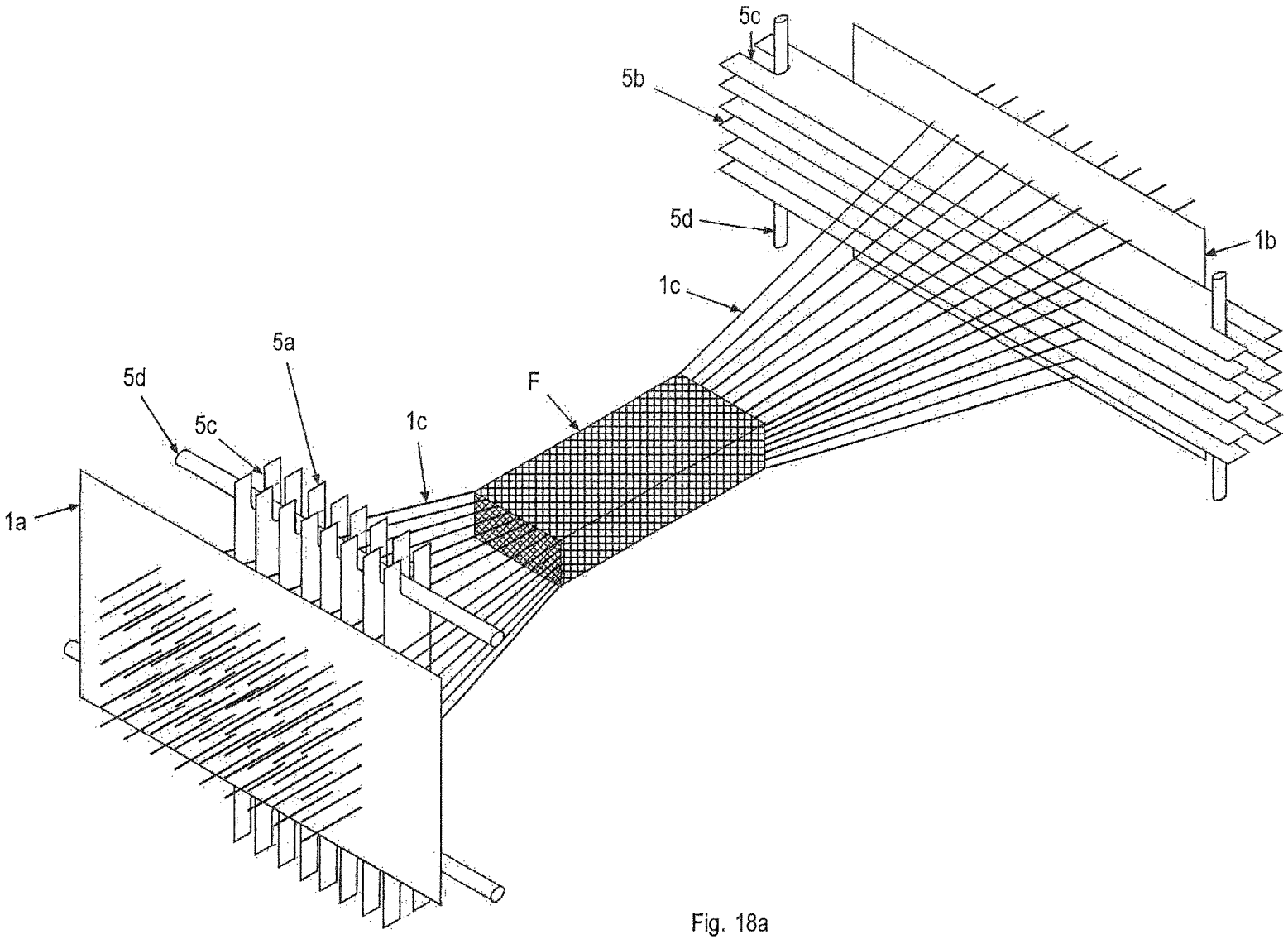
FIG. 18*a* exemplifies the arrangement for packing the laid sets of binding yarns in 3D fabric using mutually oriented sets of slats.

As indicated in the foregoing, these two sets of slats (5*a* and 5*b*) are preferably oriented dissimilarly relative to each other, for example one set being oriented 90° relative to the other set, as indicated in FIGS. 12 and 18*a*. Thus, while one set of slats is longitudinally oriented in fabric's thickness direction, the other is longitudinally oriented in fabric's width direction. Such a working orientation of slats (5*a* and 5*b*) benefits in providing directly an efficient balanced mutual physical support for their simultaneous yarn packing/pressing actions. The set of slats oriented in fabric's width direction is employed preferably for connecting properly with the set of binding yarns that have been laid in fabric's thickness direction, and vice versa. Depending on the type of 3D fabric being produced, one of the sets of slats (5*a* and 5*b*) can comprise only one slat, while the other set can comprise more than one slat.

As indicated in FIG. 18*a*, each of the slats of the two sets (5*a* and 5*b*) respectively occur between corresponding columns and rows of the stem hooks (1*c*). It is not necessary for a slat of a given set to exist between all rows, or columns, of stem hooks (1*c*).

For certain production necessities additional slats can be had over-below the rows of stem hooks (1*c*) and also beside the outer columns of stem hooks (1*c*). The dual-acting sets of slats (5*a* and 5*b*) are held preferably in a manner whereby they can easily move/slide in their thickness direction, such as through provision of cuts, pair of holes (either circular or some other suitable shape) etc. (5*c*), so that they can be suitably mounted on correspondingly shaped support rods, bars etc. (5*d*) as indicated in FIG. 18*a*. Each set of slats (5*a* and 5*b*) with their supporting rods/bars (5*d*) are respectively connected to independent suitable links (not shown) for moving them towards and away from the 3D fabric being produced through the respective end sides the set of axial yarns (X) as can be inferred from FIG. 18*a*. Thus, when the set of slats (5*a* and 5*b*) are moved towards the 3D fabric (F) under production for packing/pressing the last laid sets of binding yarns concerned (either Y or Z or +V or −V) towards each other, the slats constituting each set tend to slide on the supporting rods/bars (5*d*) and come closer to each other. Likewise, as the set of slats (5*a* and 5*b*) are retracted they tend to distance/space out from each other. This 'closing-distancing' movement of the slats of sets (5*a* and 5*b*) comes mainly from the lateral pressure exerted by the tension in the set of axial yarns (X) and the stem hooks (1*c*). Further, the arrangement provides for a suitable construction, such as open ended slots (5*c*), whereby required number of slats from sets (5*a* and 5*b*) may be added/removed depending on the cross-sectional dimensions of the 3D fabric being produced. This way the slats can be simply and quickly removed to reduce the weight of system to save on energy.

The two relatively oriented sets of slats (5*a* and 5*b*) are moved from opposite locations, as indicated in FIG. 18*a*, preferably simultaneously, towards each other to pack/press between them laterally the last laid respective set of binding yarns concerned (either Y or Z or +V or −V) in the set of axial yarns (X). The dual packing action of two sets of mutually differently oriented slats (5*a* and 5*b*) from two end sides of the set of axial yarns (X) directly and uniquely helps in reducing the production time of a 3D fabric by half. It needs to be pointed out here that as the 3D fabric gets produced "middle-outwards", the distance that the sets of slats (5*a* and 5*b*) have to be moved for pressing laterally the laid binding yarns get reduced corresponding to the length (or width, or thickness) of the fabric produced. There is thus provided a suitable drive, such as through known servo motors and pressure regulating devices, to precisely control the distance of reciprocation of each of the two sets of slats (5*a* and 5*b*), and thereby exert a constant predetermined pressure on the last laid respective sets of binding yarns (either Y or Z or +V or −V). Also, because the reciprocating distance of slats' movement gets reduced as the 3D fabric builds up, there is corresponding saving of operation time, which again contributes in making the noobing process and device efficient and productive.

Through this novel dual-acting binding yarn packing arrangement of the sets of slats (5*a* and 5*b*) the last laid set of respective binding yarns concerned (either Y or Z or +V or −V) are advantageously packed/pressed laterally towards each other from two end sides of axial yarns (X) simultaneously and packed suitably according to requirement specifications, i.e. the density of binding yarns per unit length of 3D fabric could be varied either uniformly or non-uniformly throughout the noobed fabric (F) in a controlled manner. The described arrangement thus directly influences control on the fibre volume-fraction of the produced 3D fabric. It will be obvious now to a person skilled in the art that through the described dual-action packing arrangement of sets of slats (5*a* and 5*b*), a 3D fabric (F) can be produced wherein distribution of binding yarns can be suitably varied in a controlled manner to create optimized fabric structures and different functionalities to suit a given application need.

Figure 18B:
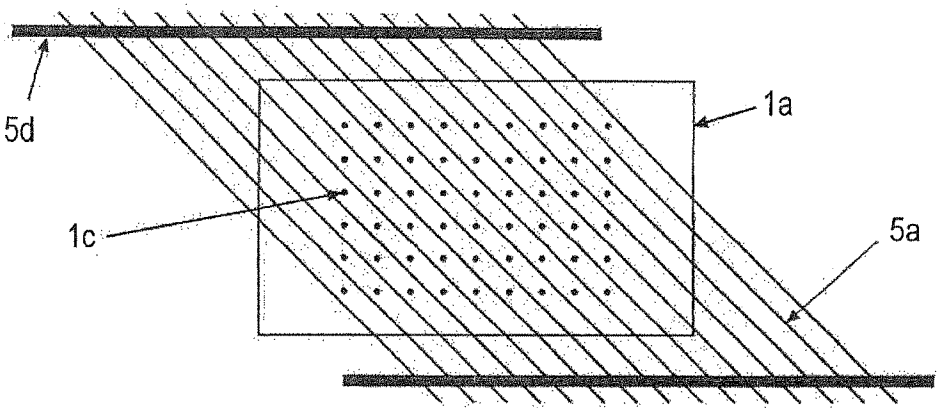
FIGS. 18*b-c* exemplify respectively arrangement (one end view) for packing either the laid sets of bias-binding yarns (+V and −V), or binding yarns (Y and Z), or both these sets of binding yarns in 3D fabric using mutually diagonally oriented two sets of slats from respective sides of walls.
Figure 18C:
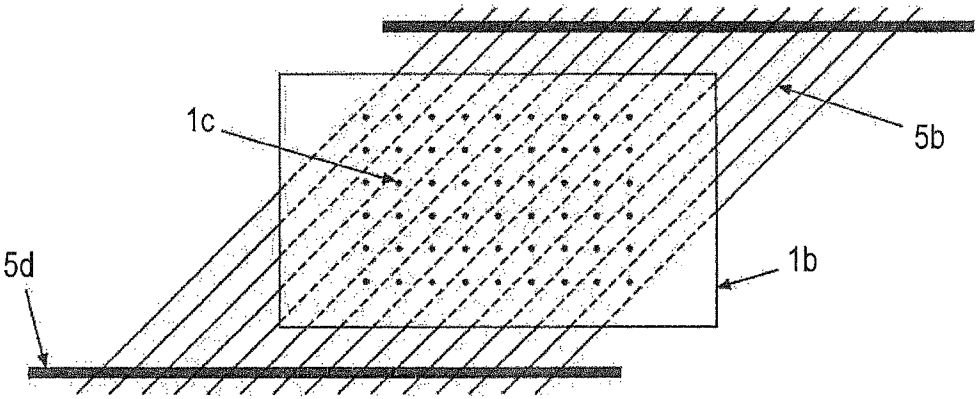

In an alternative but similar arrangement, the dual-acting packing slats of two sets (5*a* and 5*b*) can be positioned in angular orientations, i.e. in bias/diagonal directions, as shown in FIGS. 18*b* and *c*, the latter showing the bias arrangement of slats (5*b*) as viewed in the direction of wall (1*b*). Preferably the angular orientation of the two sets of slats (5*a* and 5*b*) is mutually equal and opposite. Their dual packing action remains similar to that described in the foregoing and requires no further detailing for a person skilled in the art. This mutually angular arrangement of sets of slats (5*a* and 5*b*) can be used for packing into the columns and rows of axial yarns (X) the laid binding yarns (Y) and (Z), and also bias-binding yarns (+V and −V).

The slats of the sets (5*a* and 5*b*) can be of either rectangle-like shape or other shapes such as trapezoid, convex/concave, toothed/stepped etc. to help produce directly a 3D fabric with corresponding shapes of either surfaces or body (for example, a 3D fabric with recess, hole, slot etc.). Further, the shape of the leading longitudinal edges (that which will come in contact with and press the binding yarns) of the slats of the two sets (5*a* and 5*b*) can be either similar or dissimilar. The edges of slats are round and smooth, and its surfaces flat and even, possibly coated with non-stick coating. The slats could be either ribbed or non-ribbed.

Figure 19A:
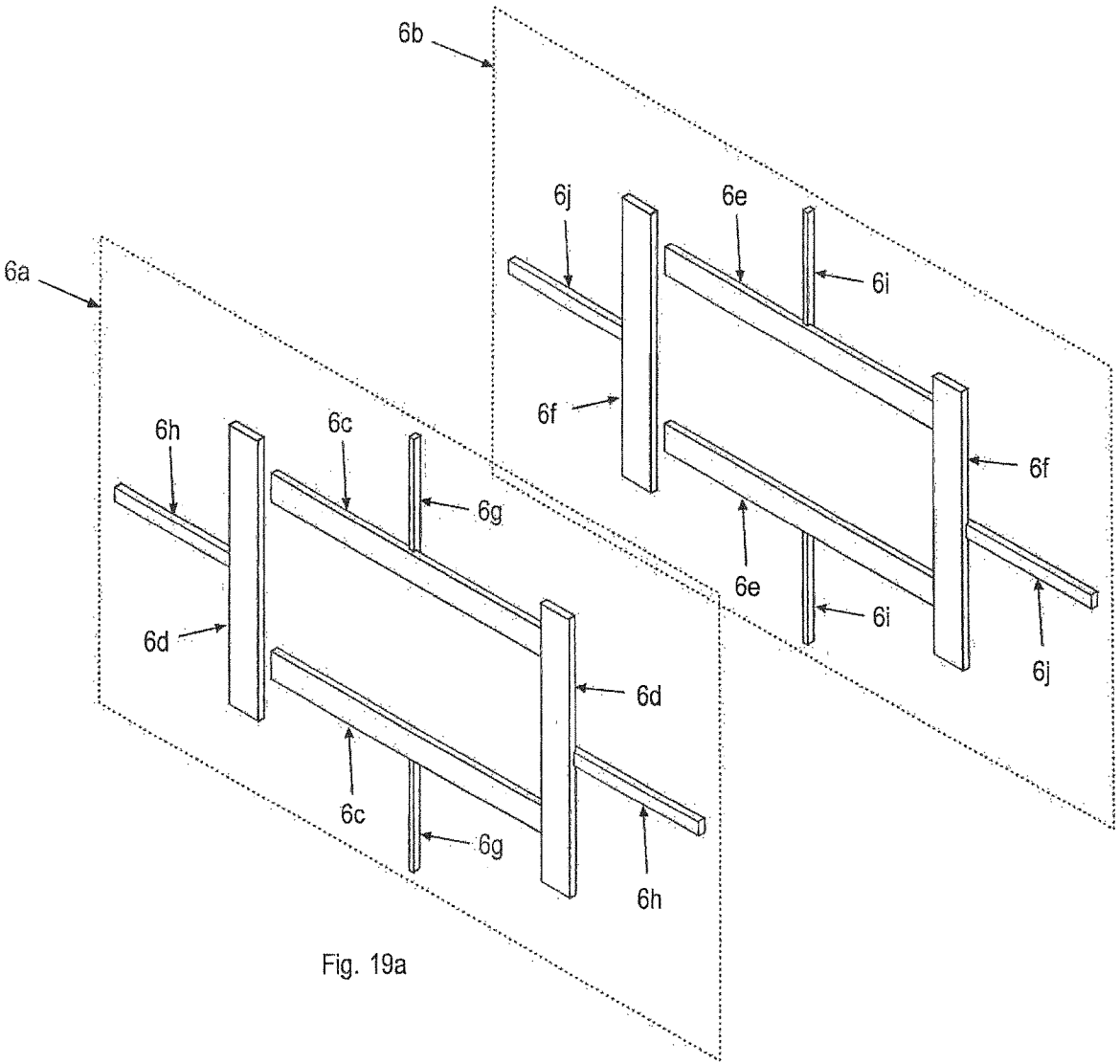
FIGS. 19*a-f* exemplify the important constructional features of unit for bunching the set of axial yarns (X), their working principle and use in "middle-outward" production, and a possible alternative construction.
Figure 19B:
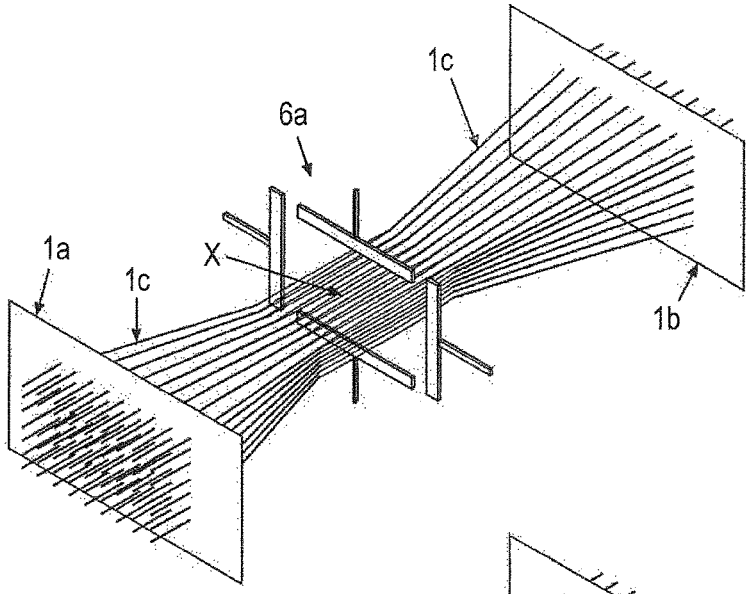
Figure 19C:
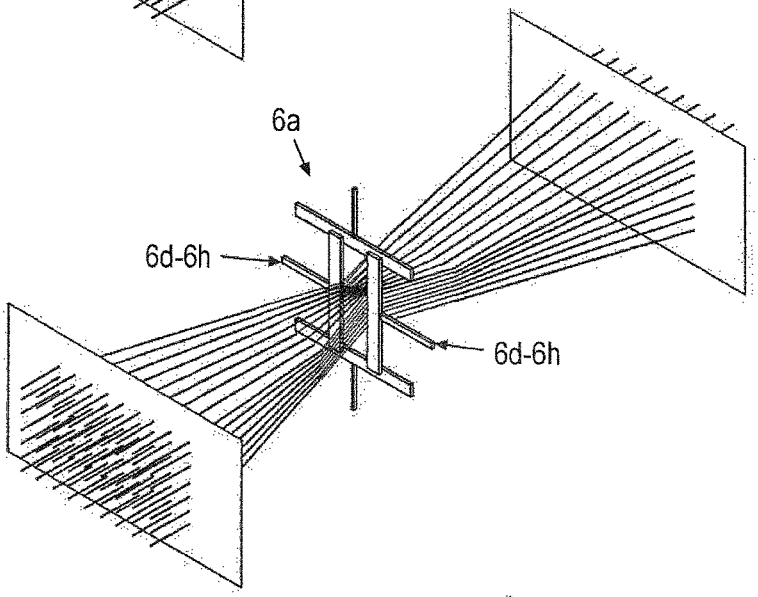

The noobing device further comprises a novel system to bunch/converge the set of axial yarns (X) for uniquely enabling controlled production of 3D fabric with relatively higher fibre volume fraction, well defined cross-sectional shape and precise cross-sectional dimensions. This system essentially comprises two bunching/converging units (6*a* and 6*b*), the relative working positions of which are indicated in FIG. 12. These bunching units (6*a* and 6*b*) aid 3D fabric production "middle-outwards". Each of these bunching units (6*a* and 6*b*) are composed of preferably two oppositely paired suitably shaped fingers (6*c*-6*d* and 6*e*-6*f*) respectively as shown in FIG. 19*a*. The shaped fingers (6*c*-6*d* and 6*e*-6*f*) of bunching units (6*a* and 6*b*) surround the set of axial yarns (X) from four sides/directions to confine it to cross-section dimensions and shape of 3D fabric to be produced. Each finger is provided with a connector (6*g*-6*h* and 6*i*-6*j*) to operate them. In FIG. 19*b* is shown only the bunching unit (6*a*) positioned around axial yarns (X) for ease of representation. In practice both units (6*a* and 6*b*) are used side-by-side to aid "middle-outwards" production of the 3D fabric. As the 3D fabric builds up, the two units (6*a* and 6*b*) move away from each other correspondingly. Each of these units (6*a* and 6*b*) are positioned close to the plane of fabric formation from four directions. The oppositely paired fingers (6*c*-6*d* and 6*e*-6*f*) of bunching units (6*a* and 6*b*) respectively pack/push the set of axial yarns (X) laterally inwards from the four longitudinal sides as was explained in reference to FIG. 4 and can be inferred now from FIG. 19*c*. For ease of representation, only the bunching unit (6*a*) is indicated in FIG. 19*c*, wherein only the fingers (6*d*) with its connecting rod (6*h*) are shown packing/pushing the axial yarns (X) from two directions. The bunching of axial yarns (X) is performed mechanically at suitable moments of the production cycle by actuating the oppositely paired fingers (6*c*-6*d* and 6*e*-6*f*), which are preferably individually connected through their connecting rods (6*g*-6*h* and 6*i*-6*j*) to their respective driving units, such as pneumatic cylinders, cams, electromagnets etc., through suitable links (not shown). Such connecting rods (6*g*-6*h* and 6*i*-6*j*) are preferably telescopic in construction to keep the space requirements low.

Each of the oppositely paired fingers (6*c*-6*d* and 6*e*-6*f*) of the bunching units (6*a* and 6*b*) move towards each other when actuated, called closing action, as indicated in FIG. 19*c*, to bunch the set of axial yarns (X) from all four sides during suitable moment in each production cycle. The stroke lengths of these oppositely paired fingers (6*c*-6*d* and 6*e*-6*f*) for the closing action are preset in accordance with the production requirements relating to cross-sectional shape, dimensions and fibre volume-fraction of the 3D fabric to be produced. When the fingers (6*c*-6*d* and 6*e*-6*f*) are retracted, called the opening action, the pressure on axial yarns (X) ceases. The closing and opening actions of the individual fingers (6*c*-6*d* and 6*e*-6*f*) is preferably suitably programmed to realize the specified 3D fabric characteristics. It is not necessary for all the paired fingers (6*c*-6*d* and 6*e*-6*f*) of each bunching unit (6*a* and 6*b*) to work simultaneously. For example, only fingers (6*d* and 6*f*) of each set (6*a* and 6*b*) could be operated to bunch the set of axial yarns (X) after binding yarns of set (Y) have been laid so that axial yarns (X) get tightly packed in the folds of binding yarns (Y).

During closing action, the oppositely paired fingers (6*c*-6*d* and 6*e*-6*f*) move closer to each other and create an open space between them which closely defines the cross-sectional shape and area of the 3D fabric being produced. The set of axial yarns (X) get laterally bunched and packed from all four directions and get contained within the defined space created by the closing fingers (6*c*-6*d* and 6*e*-6*f*). The set of axial yarns (X) is thus dimensionally confined in the space created within the paired fingers (6*c*-6*d* and 6*e*-6*f*). Such bunching of set of axial yarns (X) causes the binding yarns (Y) and (Z), as also the bias-binding yarns (+V and −V) when used, to directly lock within their binding folds the dimensionally confined bunch of axial yarns (X) in predefined positions. The incorporation of oppositely paired fingers (6*c*-6*d* and 6*e*-6*f*) thus uniquely enables direct production of 3D fabrics with consistent cross-sectional dimensions and shape, as also the fibre volume-fraction. During opening action, as the pressure on the bunched axial yarns (X) ceases, they tend to decompress and move outwardly. Because the set of axial yarns (X) is now contained within the folding binding yarns (Y) and (Z), the lateral expansion of axial yarns (X), together with frictional forces between the all sets of yarns, causes the laid relatively perpendicular laid sets of binding yarns (Y) and (Z) to get stretched longitudinally and thereby get tensioned. As the lateral expansion of set of axial yarns (X) is restricted and contained by the folding binding yarns of the sets (Y) and (Z), throughout the produced length of 3D fabric, the sets of binding yarns (Y) and (Z) are always maintained in a pre-tensioned or pre-stressed condition and hence linear or straight. The bias-binding yarns (+V and −V), when used, similarly remains in a pre-tensioned state. As can be inferred now, the incorporation of bunching units (6*a* and 6*b*) in the noobing device uniquely leads to production of 3D fabrics incorporating pre-stressed or pre-tensioned binding yarns (Y) and (Z), and also bias-binding yarns (+V and −V) when used.

Figure 19D:
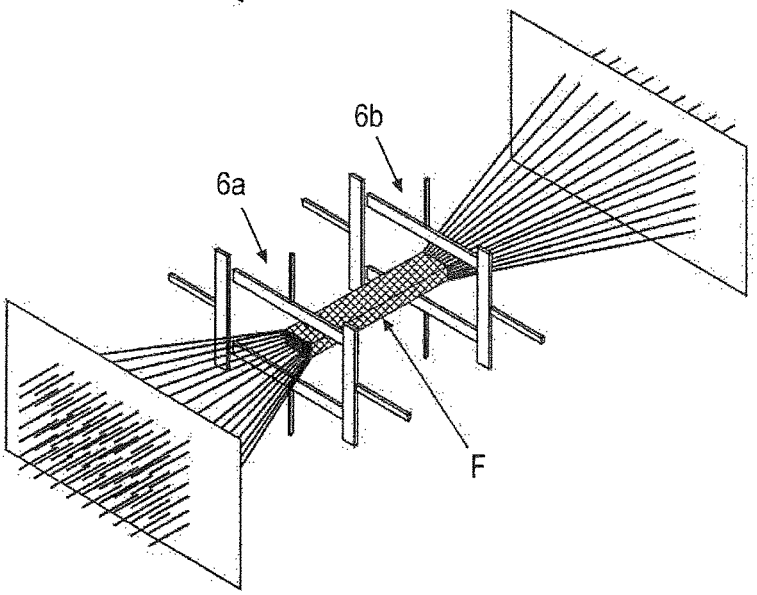

As indicated earlier, the bunching units (6*a* and 6*b*) are moved "middle-outwards", step by step, to correspond with the simultaneous production of 3D fabric in two directions. FIG. 19*d* shows the two bunching units (6*a* and 6*b*) having moved to their end positions at the completion of a 3D fabric's (F) production. The fingers (6*c*-6*d* and 6*e*-6*f*), which pack/push laterally the axial yarns (X) and bunch them, are maintained in their required bunching positions until the laid binding yarns (Y) and (Z) have fully folded to restrain the axial yarns (X) in confined dimensions and to create the necessary binding for realizing the 3D fabric's structural integrity. Preferably the individual pairs of fingers (6*c*, 6*d*, 6*e* and 6*f*) bunch the axial yarns (X) in their respective directions after the corresponding binding yarns (Y) and (Z), as also bias-binding yarns (+V and −V) when used, have been laid and packed into fabric by the sets of slats (5*a* and 5*b*) so that in the next cycle of operations the axial yarns (X) are again correctly confined in the required dimensions to obtain a 3D fabric with consistent dimensions, shape and fibre content.

Because two sets of bunching units (6*a* and 6*b*) work independently and function "middle-outwards", it becomes possible to even directly produce 3D fabric types such as those having same cross-sectional shape but varying dimensions (e.g. pyramid/cone-like), and different cross-sectional shapes (e.g. square at one end side and rectangular at the other end side).

The working of each of the two bunching units (6*a* and 6*b*) is preferably in parallel planes so that the oppositely paired fingers (6*c*-6*d* and 6*e*-6*f*) can bunch the set of axial yarns (X) equally every time to eliminate tension variations in them. Depending on the shape of 3D fabric to be produced, the respective stroke lengths of oppositely paired fingers (6*c*-6*d* and 6*e*-6*f*) can be suitably controlled to be either constant or varying, such as when producing flat surfaced and contoured surfaced 3D fabrics.

Further, the surfaces of the oppositely paired fingers (6*c*-6*d* and 6*e*-6*f*) that contact and bunch the set of axial yarns (X) are not sharp and rough. Further, the contact surface of the fingers (6*c*-6*d* and 6*e*-6*f*) can be had either straight or curved or differently shaped, to aid uniform production of 3D fabric's cross-sectional dimensions and shapes accurately. Also, the relative angle between the oppositely paired fingers (6*c*-6*d* and 6*e*-6*f*) of either set (6*a* and 6*b*) need not be necessarily right angled, as depicted in FIGS. 19*a*-*d*. The angle between them could be as well either acute or obtuse to suitably produce the shape of the 3D fabric. Further, each of the fingers can be produced combining similar or different sheets/plates of different materials to suit different fibre requirements, for example when producing a 3D fabric with different fibres.

To render the noobing device versatile, the bunching units (6*a* and 6*b*) is mounted in a manner whereby their positions can be changed as and when desired. Through such an arrangement 3D fabrics of irregular and asymmetric cross-sectional dimensions and shapes could be directly produced on the same noobing device. Whereas the production of 3D fabrics described in the foregoing indicates working of bunching units (6*a* and 6*b*) for linear incorporation of set of axial yarns (X), it is possible that the working of bunching units (6*a* and 6*b*) can be further exploited to produce a 3D fabric in which the set of axial yarns (X) are incorporated in a non-linear configuration. To exemplify, by having suitable arrangements for altering the stroke lengths of one oppositely paired fingers at every cycle of the process, a 3D fabric could be produced with non-linear set of axial yarns (X), such as sine-curved web of a T profile and asymmetrically offset shapes about the central longitudinal axis. A person skilled in the art will understand now that together with axially turnable walls (1*a* and 1*b*) and variable working of bunching units (6*a* and 6*b*) a twisting or helix-like 3D fabric could be also produced.

To ensure that the sets of binding yarns (Y) and (Z), as also bias-binding yarns (+V and −V) when used, remain in a pre-tensioned condition, it is preferable that the closing action of oppositely paired fingers (6*c*-6*d* and 6*e*-6*f*) creates a slightly smaller space between them than the final required cross-sectional dimensions/area of the 3D fabric. This way the compressive forces in the set of axial yarns (X) will cause slight cross-sectional expansion of the 3D fabric to achieve the required dimensions, and thereby stretching and tensioning of the binding yarns (Y) and (Z), as well as bias-binding yarns (+V and −V) when used, as explained earlier. Also, at the same time, a 3D fabric with relatively high fibre volume-fraction will be obtained. A robust/high fibre volume-fraction 3D fabric structure such as this will ensure incorporation of straight or linear fibres during matrix infiltration/impregnation process and thereby improved mechanical properties of the final composite materials can be achieved.

Figure 19E:
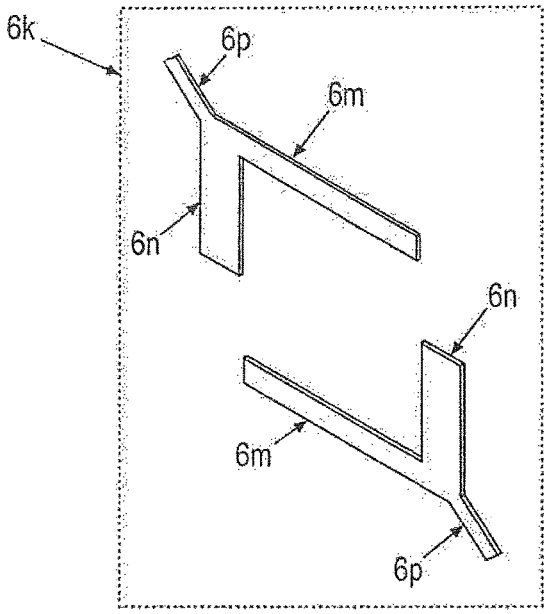
Figure 19F:
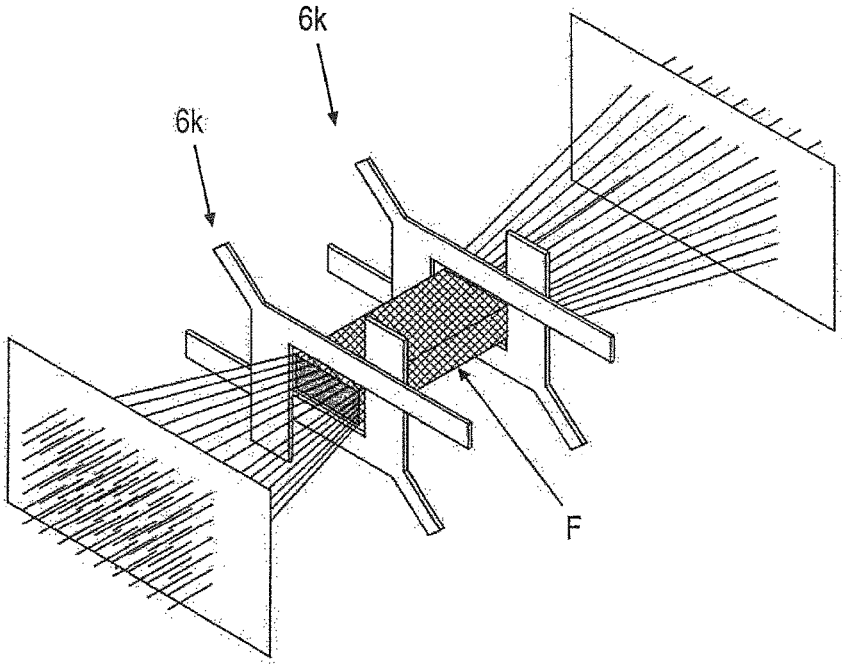

On the lines of the bunching unit (6) described above, In FIG. 19*e* is depicted another type of bunching unit (6*k*) that can be employed, for example, when axial yarns (X) are to be bound using only bias-binding yarns (+V and −V). This unit (6*k*) comprises a pair of similar but oppositely facing upper and lower plates each having an arm (6*p*) bearing two combined fingers (6*m* and 6*n*), which are mutually arranged at an angle (90° is indicated in FIG. 19*e*), similar to opened thumb and index fingers. A person skilled in the art will understand that this unit (6*k*) will bunch/compress the axial yarns (X) in lateral diagonal directions when they are moved towards each other through their arms (6*p*). Again, two such paired bunching units (6*k*) are employed to produce 3D fabric "middle-outwards" as represented in FIG. 19*f*.

Figure 20A:
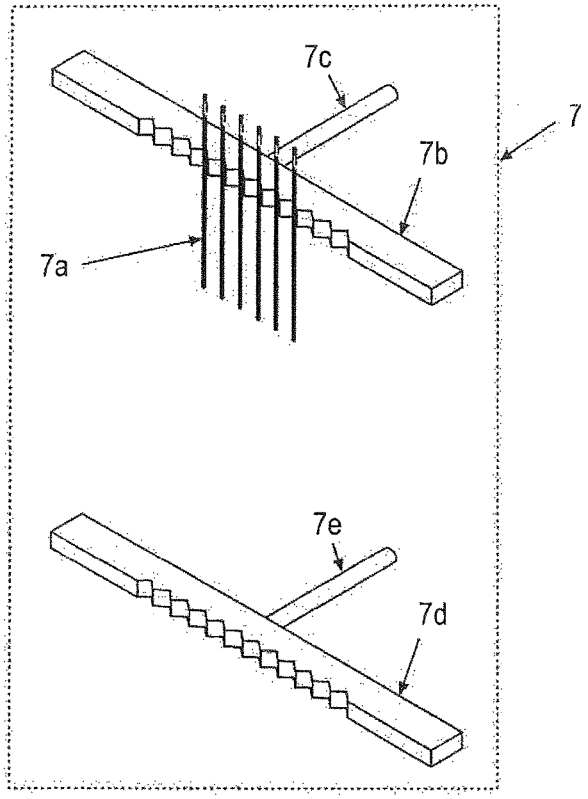
FIGS. 20*a-d* exemplify the important constructional features of the unit for integrating the loops of axial yarns (X) with binding yarns (Y or Z or +V or −V), and its working principle, for creating closed/sealed end surfaces of 3D fabric.

The noobing device further comprises a novel pair of arrangements (7) for integrating or binding the loops of set of axial yarns (X) at the two end surfaces of the 3D fabric with at least one of the sets of binding yarns (Y) and (Z), or bias-binding yarns (+V and −V) when used, or additional yarns, to create closed end surfaces of the 3D fabric. By binding the loops of axial yarns (X), the compressed binding yarns (Y and Z), as also bias-binding yarns (+V and −V) when used, are prevented from coming out of the axial yarns (X). As a consequence, they exert forces on axial yarns (X) to stretch them longitudinally. The fully bound 3D fabric thus has its constituent set of axial yarns (X) remaining in tension, or pre-tensioned condition as explained earlier. The relative location of each of the arrangements (7), during its non-operational or stand-by phase, as viewed from top, is indicated in FIG. 12. As can be observed, each unit (7) is stationed at the respective outsides of the walls (1*a* and 1*b*). The necessary details of arrangement (7) are shown in FIG. 20*a*.

The loops binding arrangement (7) comprises essentially a set of needles (7*a*), a pair of upper and lower needle holders (7*b*-7*d*) for supporting the needles (7*a*) in required positions and orientation, a driving connector (7*c* and 7*e*) for each needle holder (7*b* and 7*d*) respectively. The driving connectors (7*c* and 7*e*), besides moving the respective holders (7*b* and 7*d*) in the direction of fabric when required and retracting them back, also function to turn the holders (7*b* and 7*d*), by at least 180°, so that the held needles can be directly correspondingly turned and kept ready for subsequent use. Each of the arrangements (7) also includes a conventional clamping unit to grip either set of binding yarns (Y) or (Z), depending on which set of yarns is to be used in a given machine, and a usual cutting unit (e.g. shears, rolling blades, laser etc.) to cut the binding yarns of sets (Y) and (Z) emanating from their respective binding yarn carriers (2*a*-2*b* and 2*c*-2*d*). These usual clamping units are not necessary to indicate in FIGS. 20*a*-*d*. When bias-binding yarns (+V and −V) are also involved, either the same pair of fabric-ends binding arrangement (7) is used or additional similar arrangement is incorporated in corresponding orientations. For ease of explaining here the working of loops binding arrangement (7), only the binding of column-wise loops of set of axial yarns (X) with the binding yarns of set (Z) is considered. A person skilled in the art will be able to perform correspondingly similarly with binding yarns (Y) and bias-binding yarns (+V and −V).

Needles (7*a*) are preferably of the usual self-threading type whereby a yarn can be urged in its eye without passing the end. The self-threading eye of needle (7*a*) is preferably of the type that will not catch fibres either internally or externally, either when the needle is moving in contact with fibres or fibre is moving in contact with needle. The tip of the needle is preferably not pointed but rounded to avoid fibre damage. Needles (7*a*) of suitable length are selected in relation to the thickness of the 3D fabric being produced. The number of needles (7*a*) required correspond with the number of columns of loops constituting the 3D fabric under production. Alternatively, needles (7*a*) could be substituted with hairpin-like wires, hooks, other usual textile processing elements etc. Preferably needles (7*a*) are made of suitable steel when its holders (7*b* and 7*d*) are of electromagnet type. Needles (7*a*) could be also made of a suitable plastic, or even composite material, when its holder is of the mechanical type. The needles (7*a*) need not necessarily be of the usual cylindrical type; they can be of either some prismatic shapes or entirely different constructions such as part steel and part plastic/other metal.

The pair of needle holders (7*b* and 7*d*), designated upper and lower for describing their working here, are preferably of either magnetic or mechanical type. The magnetic type holders (7*b* and 7*d*), preferably electromagnetic, are provided with a saw-tooth-like design to hold needles in required fixed spacing, or centre-to-centre distance, at one of its sides as indicated in FIG. 20*a*. Thus when a holder is energized, the needles (7*a*) attach to it and vice-versa. The required number of needles, all of which are preferably similar in their dimensions, are preferably arranged with their eyes at the same level and orientation as shown, for example, held by the upper holder (7*b*). Either of the holders, upper (7*b*) or lower (7*d*), does not hold the entire length of the needles but only a middle part whereby the eyes and substantial length with their tips remain free. Needles (7*a*) are held by either the upper (7*b*) or lower (7*d*) holder and transferred from one to the other. The holders (7*b* and 7*d*) are preferably constructed of the type whereby transference of either all of the needles (7*a*) or a select group of needles (7*a*) or individual needles (7*a*) is accomplished as per requirements of the 3D fabric being produced.

A mechanical needle holder (7*b* and 7*d*), by way of example, is composed of a set of preferably three stacked plates, each having a series of identical holes or open ended slots at one of the sides and close to the edge facing the 3D fabric. These holes/open ended slots face the fabric under production. All the holes/slots in three plates match at one particular position, the mean position. While the top and bottom plates in the stack are suitably arranged to be unmovable relative to each other, the middle plate can be slid between the top and bottom plates. Thus, a slight displacement of the middle plate from the mean position will cause the needles in the holes/slots to get locked with the top and bottom plates, and they will be held similarly as indicated in FIG. 20*a*. A suitable usual mechanical arrangement is provided for causing displacement of the middle plate for activating the locking and releasing of the needles as and when required. The diameter/width dimensions of each of the holes/slots are preferably slightly larger than the maximum diameter/width of the needle (7*a*) to be used so that they can pass through the holes/slots easily. The centre-to-centre distance required between the needles corresponds with that of the columns of loops of the 3D fabric being produced.

Whichever type of paired needle holders (7*b* and 7*d*) is used, it is preferably brought into its active or operational position, from a suitable stand-by position as its operation is required once the laying of binding yarns has reached the respective end sides of the set of axial yarns (X) and further laying of binding yarns is not required. This way needle holders (7*b* and 7*d*) will not be in the way to hinder/obstruct the operation of laying the binding yarns (Y and Z) during production of the 3D fabric.

The clamping unit (not shown), used to clamp the set of binding yarns, is preferably one of the usual arrangements used in textile manufacture. The clamping unit is moved from a side direction with its mouth open towards the array of binding yarns that have to be clamped. Once positioned, it clamps between its jaws the set of binding yarns extending between the fabric and the binding yarn carriers (2*a*-2*b* and 2*c*-2*d*). The binding yarns (Z) are clamped at a suitable position (it must be remembered that the binding yarns are relatively more spaced apart at their carrier side than at the fabric side) by the clamping unit to present them steadily in a tensioned state to the approaching needles (7*a*) so that the binding yarns of the set (Z) get directly and easily self-threaded into the eyes of the needles (7*a*). Thus, the clamping unit collectively positions each of the individual yarns of set (Z) for corresponding self-threading into the eyes of needles (7*a*). Alternatively, the clamping unit could be moved with the clamped binding yarns of the set (Z), in tension, towards the needles (7*a*) that are already held either in or above the loops of axial yarns (X) by the needle holder concerned (7*b* or 7*d*) and urge the binding yarns (Z) to self-thread into the respective eyes of needles (7*a*).

Figure 20B:
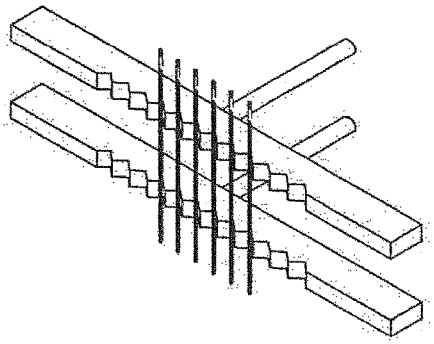
Figure 20C:
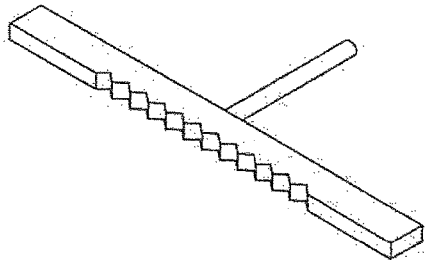
Figure 20C:
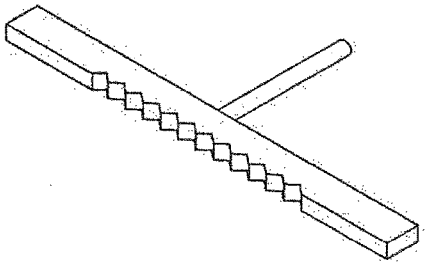
Figure 20C:
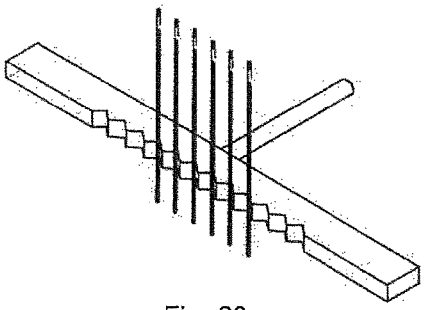
Figure 20D:
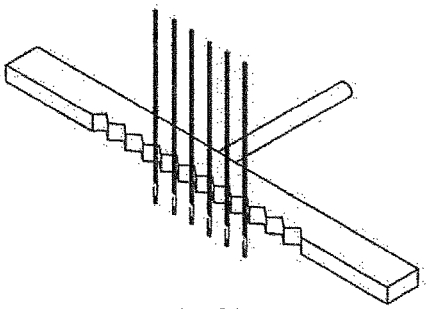

A representative working sequence of the novel 3D fabric-end binding arrangement (7) is indicated in FIGS. 20*a*-*d*. Needles (7*a*) are held by the upper holder (7*b*) (FIG. 20*a*). The upper (7*b*) and lower (7*d*) holders are moved towards each other in alignment whereby the relative positions of needles (7*a*) remain same with respect to the two holders (7*b* and 7*d*) as shown in FIG. 20*b*. The two holders (7*b* and 7*d*) remain distanced/separated when transference of the needles (7*a*) takes place from upper holder (7*b*) to lower holder (7*d*). After the needles (7*a*) have been held by the lower holder (7*d*), the two holders are relatively moved apart (FIG. 20*c*). The lower holder (7*d*), now bearing needles (7*a*), is subsequently turned by 180° and the needles adjusted, if required, e.g. to hold at a suitable middle part, to repeat the described working sequence in the opposite direction for closing the end surfaces of the next 3D fabric.

Figure 21:
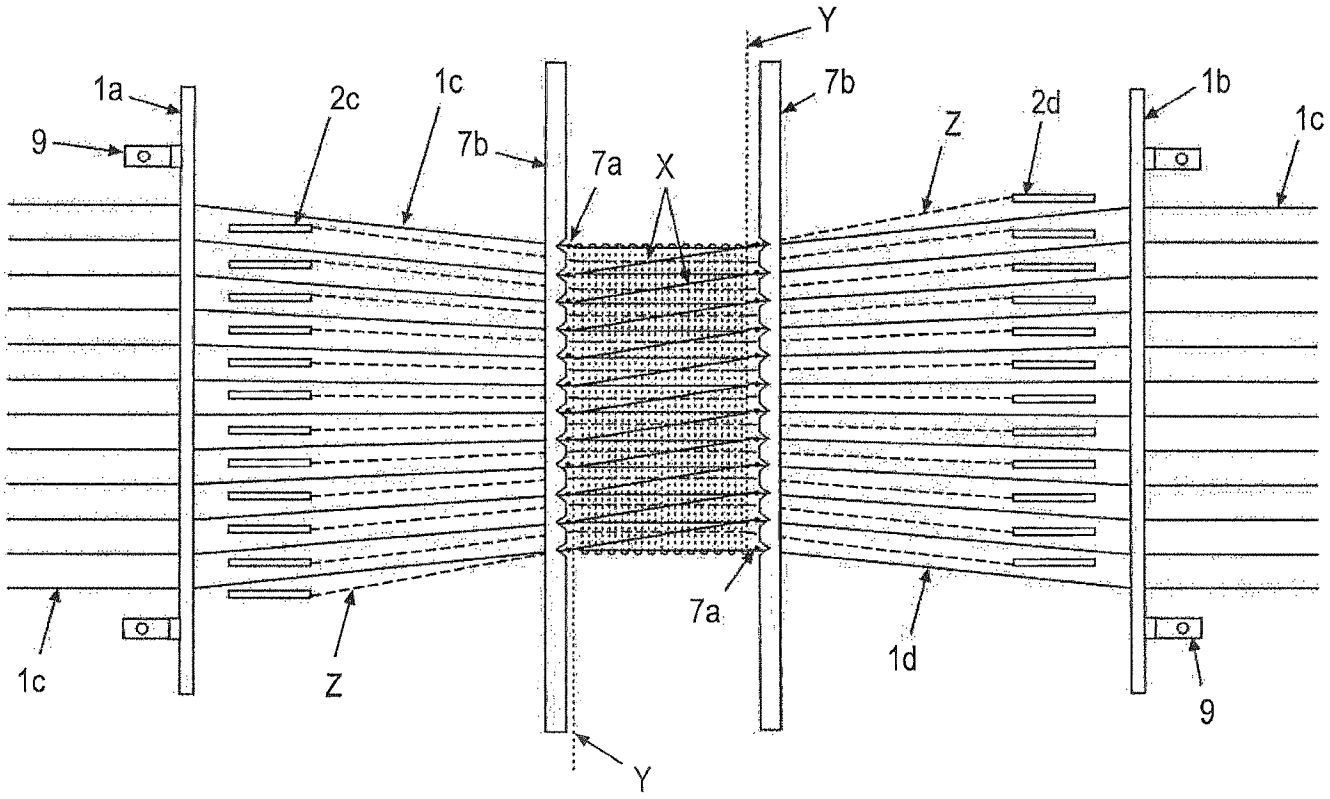
FIG. 21 exemplifies the relative working position of the unit (top view) for integrating the loops of axial yarns (X) with binding yarns (Y or Z or +V or −V) when creating closed/sealed end surfaces of 3D fabric.

To achieve the objective of producing a 3D fabric with closed end surfaces, and its constituent set of axial yarns (X) remaining in tension, the pair of arrangements (7) function in conjunction with the hook stems (1*c*), the hook part (1*d*) of which provides clear channels in the looping axial yarns (X). As can be inferred now from the working sequence described above, once the needles (7*a*) have been threaded with binding yarns of the set (Z) by the clamping unit, these yarns are cut at a suitable point by the yarn cutting unit to free them from the respective binding yarn carriers (2*c* and 2*d*). The pairs of upper (7*b*) and lower (7*d*) holders, at either end sides of 3D fabric, are moved, preferably simultaneously, towards the respective end sides of the 3D fabric being produced. Each of the holders at the two end sides of 3D fabric are positioned at a point where tips of each of the needles (7*a*) are directly over and in line with the respective columns of the loops of axial yarns (X), as can be inferred from FIG. 21, which is the top view of the noobing device. The upper and lower holders (7*b* and 7*d*) at each end side of 3D fabric are moved closer to each other. In the process the upper holder (7*b*) inserts the needles (7*a*) into, and pushes them through, the corresponding channels of loops formed by the spaced apart surfaces (1*d*) of hook stems (1*c*). The length of needles (7*a*) emerging from the columns of loops are held at a suitable middle part by the already positioned lower holder (7*d*) when activated. As the upper and lower holders (7*b* and 7*d*) move apart, the needles (7*a*) draw out the cut binding yarns of set (Z) through respective columns. As the holders continue moving apart further, the binding yarns of set (Z) slip out from the respective eyes of needles (7*a*). The two holders (7*b* and 7*d*) are retracted to their stand-by positions and the lower holder (7*d*) turned 180° to keep the needles readily positioned for next use.

As already explained, the compressive forces in the two sets of laid binding yarns (Y) and (Z), which were laterally compressed and packed between the set of axial yarns (X) by slats (5*a* and 5*b*) during 3D fabric production, combined with frictional forces between the fibres, tend to collectively exert pressure in respective lateral directions and the set of axial yarns (X) begin to get longitudinally tensioned (because set of axial yarns (X) is in mutual perpendicular orientation to sets of yarns (Y and Z)). This tensioning of set of axial yarns (X) gets further enhanced when the loops of axial yarns (X) are integrated with the corresponding binding yarns (Z) as the laterally expanding/uncompressing binding yarns of sets (Y) and (Z) cannot come outside of the integrated loops. As all the surfaces of the produced 3D fabric are fully bound, the tightly packed laterally expanding/uncompressing yarns of each set causes the yarns of the other two sets to extend longitudinally whereby all sets of yarns (X, Y, Z) always remain in a pre-tensioned state, and thereby also straight or linear during matrix infiltration/impregnation process, and contribute in improving the mechanical properties of the final composite material.

Alternatively, instead of using binding yarns of any set, extra/additional yarns can be used to integrate the loops (either column-wise or row-wise) of axial yarns (X). Since the loops will be locked by the extra yarns, the binding yarns (Y) and (Z), packed in the fabric, cannot come outside of the integrated loops of axial yarns (X) and thereby keep the axial yarns (X) in tension or pre-stressed condition as explained earlier. Such extra yarns can be also used when bias-binding yarns (+V and −V) have been incorporated in the 3D fabric. In any case, whether using either binding yarns (Y) or (Z), or bias-binding yarns (+V) or (−V), or extra yarns for integrating the loops of axial yarns (X), it is not necessary to pass them through all the corresponding loops of axial yarns (X). If required these binding yarns, and also the extra yarns, can be drawn through only select loops of axial yarns (X), in suitable directions, whereby either these binding yarns, or the extra yarns, can be made to directly float on the end surfaces of the 3D fabric to improve the bonding characteristics of the composite materials as discussed earlier.

In another approach, when laying of binding yarns (Y and Z)/bias-binding yarns (+V and −V) have been completed, the needles (7*a*) could be first directly placed in the corresponding column-wise channelled loops of axial yarns (X) with the eyes of all the needles oriented in the same direction. Subsequently, the clamping unit holding the binding yarns of set (Z), which is cut at a suitable point, is moved towards the needle eyes to directly urge the binding yarns to self-thread into the eyes of the positioned needles. By drawing out the needles from the channel of loops, the binding yarns get laid in the loops and integrate with the loops of axial yarns (X). The extending yarns can be either subsequently cut by the cutting unit or just left like that. In another approach, a robot could be used to bind the loops of axial yarns (X) with either the binding or extra yarns by drawing them through the loops. Alternatively pre-threaded needles could be directly used. The passing of needles through the channelled loops of axial yarns (X) could be also performed either manually or robotically.

Alternatively, an extra yarn, such as thermoplastic, could be laid as the outermost binding yarn, i.e. without passing through the columns of loops. By applying required heat the fusing thermoplastic yarn will seal the ends of 3D fabric. This approach is advantageous when the loops of axial yarns (X) are to be cut open. The fused yarn will restrain the binding yarns of sets (Y) and (Z) from coming out of the axial yarns (X) whereby a pre-tensioned 3D fabric will be produced. Alternatively, by using thermoplastic hooks (1*d*) on hook stems (1*c*), they could be fused into the loops and connect them whereby the laid binding yarns are restrained from coming out and thereby a pre-tensioned 3D fabric is obtained. Alternatively, once the laying of binding yarns (Y and Z) is completed, a suitable adhesive can be sprayed on the loops of axial yarns (X) to join them whereby the laid binding yarns are restrained from coming out and thereby a pre-tensioned 3D fabric is obtained.

It may be noted that because of the novel incorporation of bunching units (6*a* and 6*b*) in the noobing device and pressing the laid binding yarns against each other from opposite directions by slats (5*a* and 5*b*), the set of axial yarns (X) are uniquely held tightly by the sets of binding yarns (Y) and (Z), as also bias-binding yarns (+V and −V) when used. As a consequence, there is high yarn-to-yarn friction between all the involved yarns whereby the compressive forces of the laid sets of binding yarns (Y) and (Z) cause the set of axial yarns (X) to remain uniquely linear in a tensioned state. Therefore, in another alternative arrangement, the loops of the axial yarns (X) need not be integrated with either the binding yarns of the sets (Y) and (Z) or the extra yarns. In this case the loops of axial yarns (X) may be left either as they are or they could be cut with certain length protruding from the end surfaces of the 3D fabric. Whether left as they are or cut, the loop-forming axial yarns (X), due to their corresponding obtaining either bulb-like or shaving brush-like forms, provide some resistance to the laterally expanding binding yarns of the sets (Y) and (Z), as also bias-binding yarns (+V and −V) when used, and thereby prevent them to come outside of the end sides of the set of axial yarns (X), and hence outside of the produced 3D fabric's end surfaces. Such a 3D fabric also comprises pre-tensioned yarns and can be used to produce composite materials that do not require its end surfaces sealed/bonded.

Figure 22A:
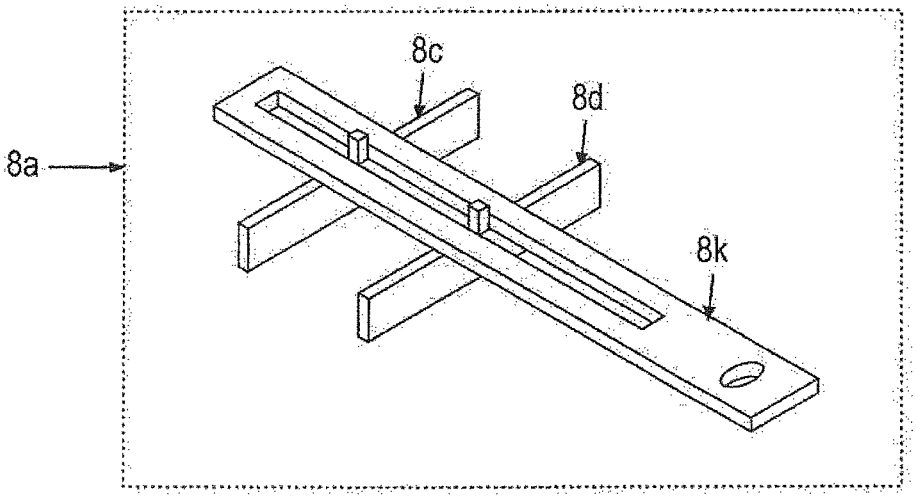
FIGS. 22 *a-b* exemplify respectively the clamp and prong type constructions of the 3D fabric doffing unit.
Figure 22B:
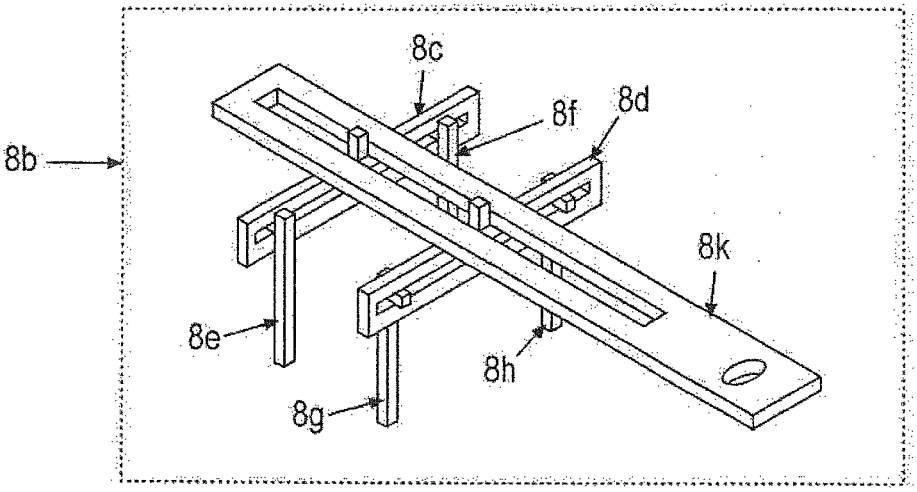

The noobing device further comprises a 3D fabric doffing unit (8), the relative top view stand-by position of which is indicated in FIG. 12. Doffing unit (8) is preferably of either type (8*a*) or (8*b*) as exemplified respectively in FIGS. 22*a* and *b*. The former type (8*a*) is essentially composed of movable clamping jaws (8*c* and 8*d*) and the latter type (8*b*) comprises prongs, for example (8*e*-8*h*), that could be additionally attached to jaws (8*c* and 8*d*) in known different sliding ways. In any case, the jaws/prongs are suitably mounted on an arm (8*k*) that can be brought into position by suitable links (not shown) for clamping and supporting the 3D fabric when its production is completed. The clamping action of either of these units (8*a*) and (8*b*) is preferably gentle but firm to maintain the produced 3D fabric in place without causing its deformation, fibre breakage, fibre misalignments etc. The preferred doffing unit, either (8*a*) or (8*b*), is preferably positioned to hold the produced 3D fabric from above, as can be inferred from FIGS. 12 and 22*a* and *b*. As will become known further on, such a holding position is preferable to make it easy for either the holder's clamping jaws (8*c* and 8*d*), or prongs (8*e*-8*h*), to directly deposit the produced 3D fabric into its packaging container that will be positioned below the 3D fabric.

After the production of 3D fabric (F) is completed, the 3D fabric (F) needs to be fully disengaged from the hook stems (1*c*) before it can be placed in its packaging container. Accordingly, either type of doffing unit (8*a*) or (8*b*) is suitably brought into position over the produced 3D fabric (F) by moving arm (8*k*). Positioning of either unit (8*a*) or (8*b*) over 3D fabric (F) depends on which sides/surfaces of 3D fabric (F) can be used conveniently to clamp the 3D fabric (F). Hence, both units (8*a*) and (8*b*) are also provided with either a suitable orientating capability or ability to clamp fabric (F) in more than one direction (not shown). Whereas the former type of unit (8*a*) will clamp the 3D fabric (F) between the jaws (8*c* and 8*d*), the latter type (8*b*) will clamp the 3D fabric (F) between paired prongs, either (8*e*-8*f* and 8*g*-8*h*) or (8*e*-8*g* and 8*f*-8*h*). The clamping jaws and prongs are of suitable dimensions and shapes. Suitable jaws/prongs are selected in accordance with the dimensions and shape of the produced 3D fabric, and not limited to the shape shown in FIGS. 22*a* and *b*. The selected clamps/prongs are attached to the clamping mechanism, such as pneumatic cylinders, threaded rods, springs etc. (not shown). The surface/s of each of the two jaws (8*c*-8*d*) and prongs (8*e*-8*h*) that will come in contact with 3D fabric are provided with suitable material/s that can hold firmly the 3D fabric (F) without deforming and damaging.

Figure 23A:
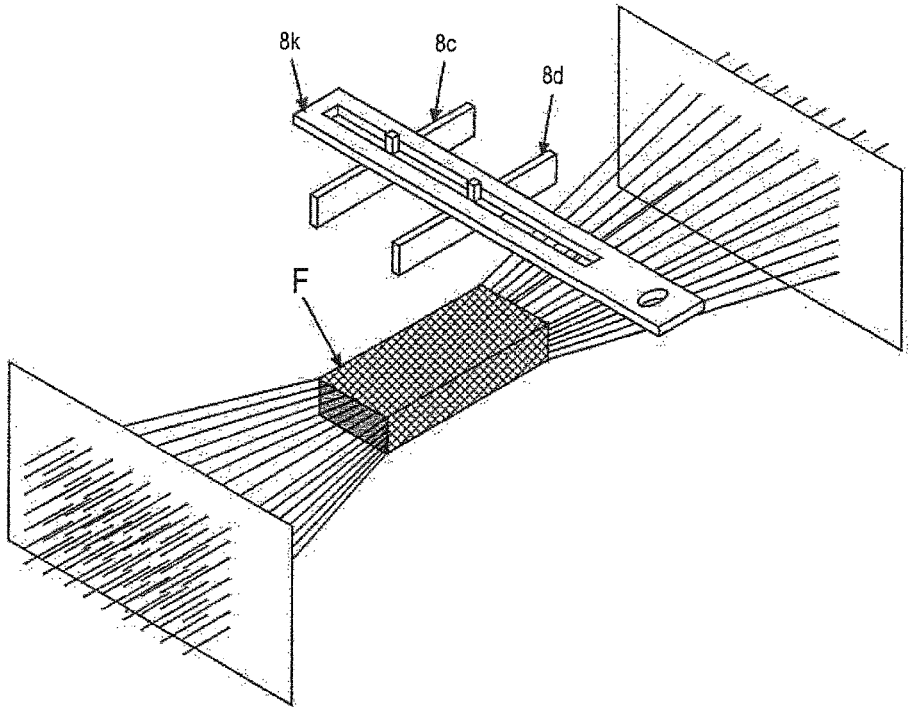
FIGS. 23*a-b* exemplify respectively the working positions of the 3D fabric doffing unit before clamping the 3D fabric from above and with clamped the 3D fabric.
Figure 23B:
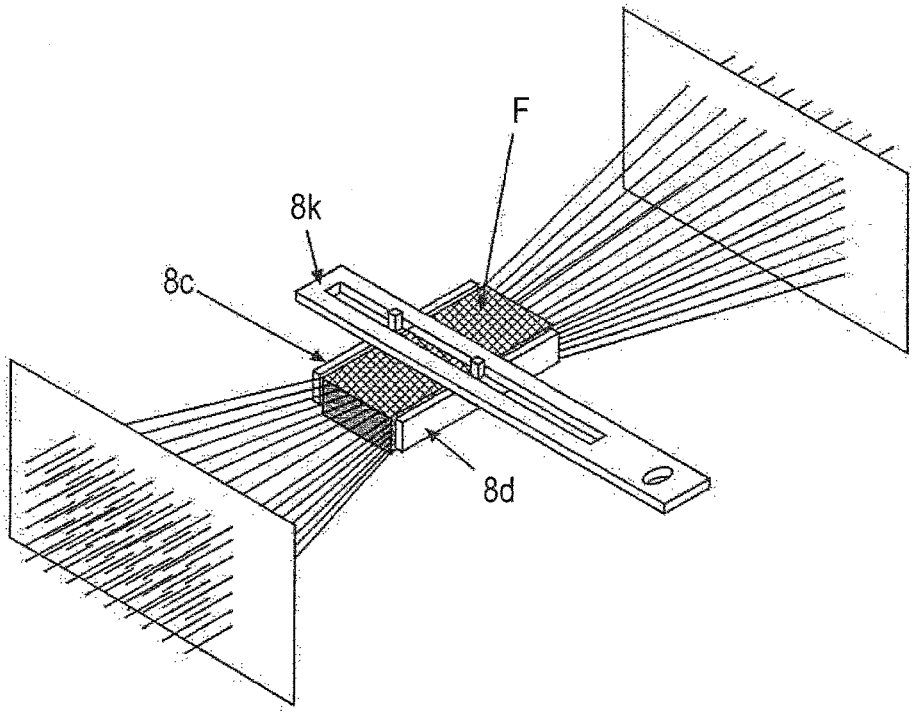

Preferably both types of units (8*a*) and (8*b*) are designed to receive clamping jaws (8*c*-8*d*)/prongs (8*e*-8*h*) from a range of different dimensions and shapes so that they can be interchanged in accordance with the dimensions and shapes of the 3D fabric (F) to be held. For the person skilled in the art, working of both these doffing unit types (8*a*) and (8*b*) will be obvious now if one of them is described. Accordingly, working of only the former type (8*a*) is described in the following. The suitably attached clamping jaws (8*c* and 8*d*) are opened in accordance with the dimensions of the 3D fabric's sides to be held and arm (8*k*) is then lowered and brought over and close to the 3D fabric (F) as indicated in FIG. 23*a*. The positioning movement of arm (8*k*), which bears clamping jaws (8*c*-8*d*), is performed either manually or in an automated way. Once the clamping jaws (8*c*-8*d*) are located in desired position, they are brought closer to each other to clamp gently, but firmly, the 3D fabric (F) in between them as shown in FIG. 23*b*.

Figure 24:
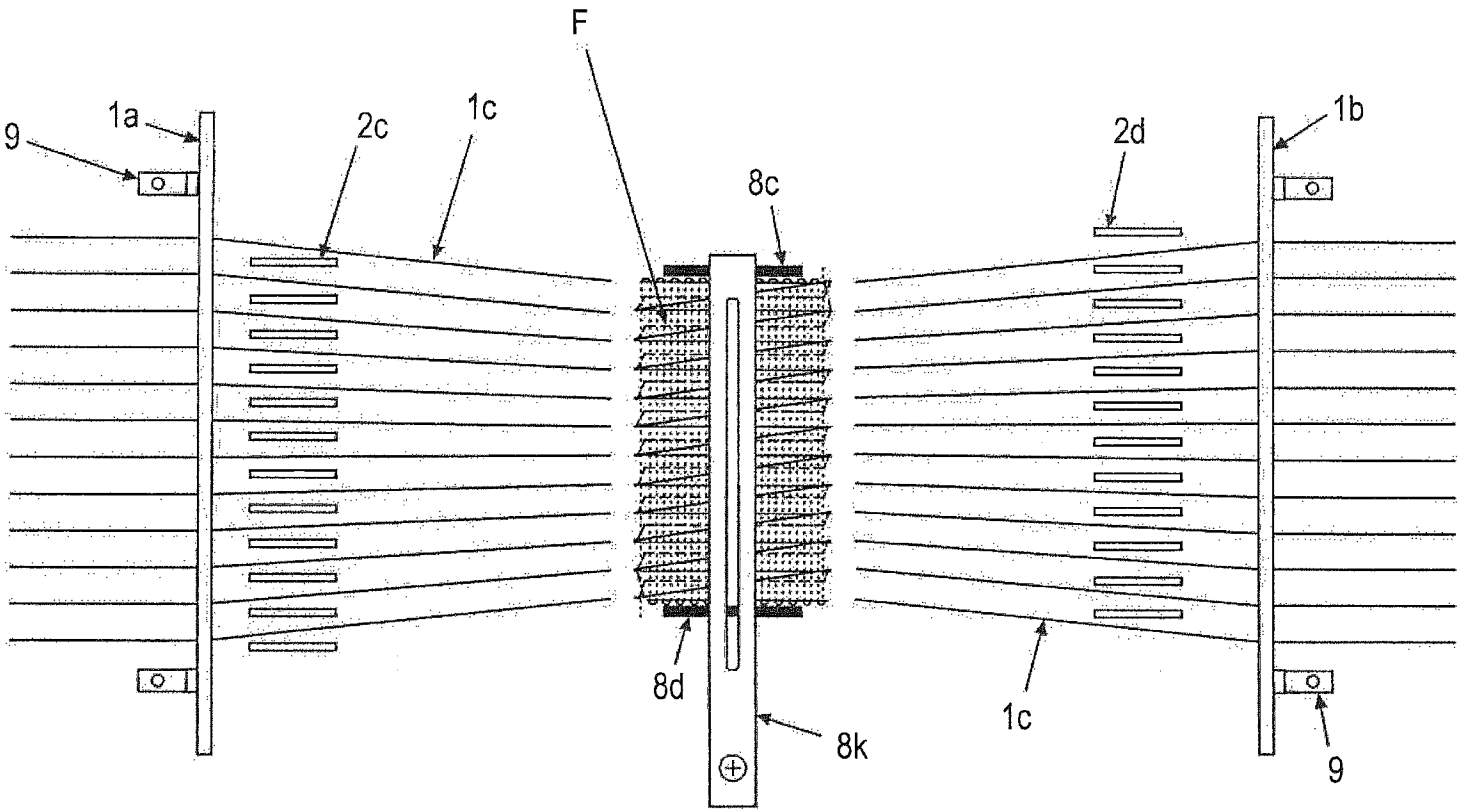
FIG. 24 exemplifies produced 3D fabric (F) (top view), clamped by doffing unit and disengaged from the stem hooks, ready for packaging.

To disengage the clamped 3D fabric (F) from the hook stems (1*c*), each of the hinged walls (1*a*) and (1*b*) are lightly tilted, either simultaneously or one at a time, and either manually or in an automated manner, towards the produced 3D fabric direction. Because the walls (1*a*) and (1*b*) are supported on hinges (9), they can be inclined in a controlled way toward the respective end sides of 3D fabric (F) from the fixed positions of the hinges (9). The controlled manner of inclining walls (1*a*) and (1*b*) about hinges (9) pushes the respective hook stems (1*c*) angularly into the corresponding end sides of 3D fabric (F). The hooking part (1*d*) slightly push the yarns in contact with it into the 3D fabric whereby the loops of axial yarns (X) loosen up the hooking part (1*d*). Combined with the flexibility of hook stems (1*c*), the hooking part (1*d*) slips out from the respective loops of axial yarns (X) with little assistance, such as light tapping, shaking, vibrating etc. and leaves the yarn threaded by needles (7*a*) within the loops therein. The produced 3D fabric (F), held by doffing unit (8*a*), gets completely disengaged now from the hook stems (1*c*) as shown in FIG. 24. The walls (1*a* and 1*b*) are either turned on the respective hinges (9) or pushed back so the hook stems (1*c*) will not interfere with the produced 3D fabric in any way. As the loops of axial yarns (X) are integrated (with either the binding yarns (Y) or (Z) or bias-binding yarns (+V) or (−V) or extra yarns or fused thermoplastic yarns etc.), the lateral compressive forces in binding yarns of sets (Y) and (Z), as also that in bias-binding yarns (+V and −V) when used, tend to push them towards the two end sides of produced 3D fabric whereby the set of axial yarns (X) also tends to become longitudinally tensioned. Thus a 3D fabric comprising pre-tensioned yarns is obtained.

The jaws of doffing unit (8*a*) when opened, frees the pre-tensioned 3D fabric (F) from its clamping action. A suitable packaging sheet/open container placed under the 3D fabric (F) (not shown) can thus directly receive the pre-tensioned 3D fabric. The deposited pre-tensioned 3D fabric is thus packaged directly by either sheet-wrapping or closing the container employing known packaging techniques. The described manner of depositing the pre-tensioned 3D fabric in its container prevents its contamination, such as that might happen by touch from hands or other sources.

Alternatively, when the hook stem (1*c*) being used has attachable-detachable type hook part (1*d*), then, depending on the constructional design of the hook stem (1*c*), walls (1*a* and 1*b*) can be tilted either towards the 3D fabric or away from the 3D fabric to disengage the hook part (1*d*) from the stem part (1*c*). The doffing unit (8*a*) then moves the 3D fabric out of the noobing device and presents it to a suitable system for subsequent removal of the hook parts (1*d*) that are attached to its end sides. The 3D fabric freed from hook parts (1*d*), without getting contaminated, is then placed into its packaging container by the doffing unit (8*a*).

Working of Noobing Device

A general working outline of the novel noobing device is described below in reference to the foregoing description of the device, which is uniquely suitable for producing both the uniaxial and multiaxial types of specific dimensioned and shaped pre-tensioned 3D fabrics.

To start with, walls (1*a* and 1*b*) are set apart by the required distance to produce either the 3D fabric's specified length or width or thickness. A predetermined number of rows and columns of hook stems (1*c*) are selected for producing the required 3D fabric's corresponding cross-sectional dimensions and shape. First, hook stems (1*c*) of the lowest row are positioned to receive the yarn (X) from unit (1*e*), which when set to working, lays yarn (X) in a zigzag formation between the two sets of hooking parts (1*d*) of hook stems (1*c*) that face each other creating the first plane of set of axial yarns (X). After yarn (X) is hooked to the last hook stem (1*c*) of the lowest row, unit (1*e*) is raised to the next higher row/level of hook stems (1*c*) and the zigzag laying of yarn (X) continued as before. This zigzag laying of axial yarns (X) is continued by unit (1*e*) until all the selected hook stems (1*c*) have been hooked with axial yarn (X). Unit (1*e*) is then moved to either its standby position or to continue working at another noobing device.

Next, the paired binding yarn carriers (2*a*-2*b*) containing the horizontal set of binding yarns (Y) and paired binding carriers (2*c*-2*d*) containing the vertical set of binding yarns (Z) are traversed in their respective directions to lay through the open spaces between rows and columns of set of axial yarns (X) from both end sides of axial yarns (X). The laid binding yarns (Y) and (Z) are positioned to a middle part of the disposed set of axial yarns (X) by slats (5*a* and 5*b*) from respective end sides. Thereafter the next sequence of laying of paired binding yarns is continued in respective directions to start producing the two halves of 3D fabric simultaneously in "middle-outwards" manner. While the described working relates to production of uniaxial noobed fabric, to produce a multiaxial noobed fabric, bias-binding yarns (+V and −V) are similarly laid in bias or diagonal directions of the fabric cross-section being produced in suitable sequencing using corresponding bias-binding yarn carriers.

Fingers (6*a* and 6*b*) of bunching unit (6) are activated at suitable moments to bunch the disposed set of axial yarns (X) by a predetermined distance, or in dimensionally confined space, and close to where the corresponding last binding yarns (Y) and (Z) have been laid. The bunching action is preferably performed after corresponding binding yarns (or bias-binding yarns (+V and −V), when used) of a given direction have been laid to achieve locking of the dimensionally confined axial yarns (X) in the folds of tensioned binding yarns (Y) and (Z).

The paired carriers of the binding yarns of each of the horizontal (Y) and vertical (Z) directions (2*a*-2*b* and 2*c*-2*d*), as also those carrying bias-binding yarns (+V and −V) when used for producing a multiaxial noobed fabric, are preferably operated simultaneously at both end sides of disposed set of axial yarns (X) during the "middle-outward" production of the 3D fabric. The laid binding yarns (Y) and (Z), as also bias-binding yarns (+V and −V) when used, are laterally pushed and compressed towards the middle of the 3D fabric under production by slats (5*a* and 5*b*) from respective end directions.

The indicated operations of laying binding yarns (Y) and (Z), as also bias-binding yarns (+V and −V) when used, compressing and packing them towards each other from the two end sides of set of axial yarns (X) by slats (5*a* and 5*b*), and bunching of the set of axial yarns (X) by bunching unit (6) are continually sequentially performed at proper moments of the cycle until one set of the laid binding/bias-binding yarns, at both end sides of axial yarns (X), reaches the looped ends of the set of axial yarns (X). Next, either the binding/bias-binding yarns of the set concerned, or alternatively extra yarns, are drawn into the eyes of corresponding needles (7*a*), which are suitably positioned. The yarns concerned are then drawn through the corresponding column-wise (or row-wise or diagonal directional) channelled loops of axial yarns (X) at both end sides of 3D fabric by unit (7) for forming the closed/sealed end surfaces of the 3D fabric (F). Alternatively, a thermoplastic yarn is used as the extra binding yarn and fused with the axial and other neighbouring yarns when the loops of axial yarns are not threaded by any yarn and cut-open. Binding/bias-binding yarns extending from the respective carriers are then cut off for tidiness.

The 3D fabric (F) is then held by the doffing unit (8). If needed, slats (5*a* and 5*b*) push the last few laid binding/bias-binding yarns lightly to loosen the hook part (1*d*) of hook stems (1*c*) from the loops of axial yarns (X). Slats (5*a* and 5*b*) are moved back to their respective stand-by positions. Walls (1*a* and 1*b*), fixed to the respective hinges (9), are tilted towards the 3D fabric to disengage the hooking parts (1*d*) of hook stems (1*c*) from the loops of the set of axial yarns (X). Walls (1*a* and 1*b*) are then either tilted away in opposite direction from the produced 3D fabric (F) or moved back from the end sides of the 3D fabric (F) so that the stem hooks (1*c*) do not interfere with the 3D fabric (F). The jaws of doffing unit (8) are then opened to deposit the produced pre-tensioned 3D fabric (F) in the provided suitable container or placed on a wrapping sheet for packaging.

The produced 3D fabric (F) with all its surfaces integrated thus has all its constituent yarns (X, Y, Z, and +V, −V when used) occurring linearly in their respective directional orientations in a pre-tensioned conditions.

As can be understood now, the described noobing device can produce both uniaxial and multiaxial 3D fabric objects of any desired specific dimensions and shapes directly, flexibly, efficiently, effectively, automatically and economically. Also, the various members of the described noobing device can be operated in desired sequences using suitable programmes.

As can be further understood now, the 3D fabric (F) with integrated surfaces comprises laterally compressed and tightly packed laid sets of axial yarns (X), and laterally compressed and tightly packed laid sets of binding yarns (Y) and (Z). The lateral compressive forces in yarns/tows of any one direction then act in the longitudinal direction of the yarns of the other two sets causing them to stretch longitudinally whereby tension is generated in them. As a consequence, all three sets of yarns (X), (Y) and (Z) remain in tensioned state. As can be understood now, the bias-binding yarns (+V and −V), when used for producing a multiaxial 3D fabric, similarly remain in a tensioned state. The disclosed 3D fabric, whether uniaxial or multiaxial, is thus uniquely a pre-tensioned 3D fabric object.

It will be also noticed that in both uniaxial and multiaxial types of pre-tensioned 3D fabrics (F) the combined length of laterally compressed binding yarns (Y) and (Z) and/or bias-binding yarns (+V and −V) nearly equals the linear length of the set of the longitudinally tensioned axial yarns (X). Similarly, the combined length of laterally compressed axial yarns (X) nearly equals the linear length of longitudinally tensioned binding yarns of sets (Y and Z) (in height/thickness and width directions), and bias-binding yarns (+V and −V) (in diagonal directions).

It would be abundantly apparent now to a person skilled in the art that all fibre types such as natural (cotton, silk, jute, cocoanut, bast, wool, sea weed etc.) and manufactured (polyester, polyamide, acrylic, amide, carbon, glass, aramid, boron, ceramic, metal etc.) can be processed into a 3D fabric object by the described noobing process and noobing device. The described workings of the noobing process and device are only representative and a variety of modifications can be implemented without departing from the spirit of the described inventions. Given below are some examples to illustrate the point and will be obvious now to a person skilled in the art.

1. Producing 3D fabric either using wet fibres or in a wet environment surrounding the 3D fabric production.
2. Laying either horizontal or vertical or bias or all these sets of binding yarns in doubled/hair pin form.
3. Producing a 3D fabric wherein fibre type of one direction is different from that of the other direction/s.

4. Producing a 3D fabric wherein different fibre types are used in either axial or thickness or width or bias or all these directions.
5. Producing a 3D fabric wherein the lengths of constituent yarns of either any one or more directions is of either relatively similar or different lengths to result in corresponding shape/form.
6. Producing a 3D fabric wherein either the binding yarns and/or bias-binding yarns of at least one direction are laid in either similar or dissimilar sequences compared with that of the other direction.
7. Producing a 3D fabric wherein either the binding yarns or bias-binding yarns of at least one direction are laid mutually differently, for example, only as a group of select yarns of a set in one operational cycle, while remaining yarns of that set are laid in subsequent one or more cycles.
8. Producing a 3D fabric wherein either only alternate binding yarns or bias-binding yarns of at least one direction are laid in one operational cycle.
9. Producing a 3D fabric wherein relatively fewer binding yarns and/or bias-binding yarns of at least one direction are used compared to either the number of columns or rows or diagonal direction spacings of the disposed axial yarns.
10. Producing a 3D fabric wherein the count/filament numbers/dimension of the binding yarns, bias-binding yarns and axial yarns are either equal or different.
11. Producing a 3D fabric wherein the spacing of the binding yarns and/or bias-binding yarns of at least one direction is either equal or unequal creating corresponding equal/unequal density (i.e. number of yarns per unit length).
12. Producing a 3D fabric wherein its production is automated by way of initiating the setting up of axial yarns for a new 3D fabric after the one under production is completed.
13. Producing a 3D fabric wherein its production is automated by way of packaging and removing a 3D fabric from the noobing device.
14. Producing a 3D fabric wherein the colours of the sets of axial, binding yarns and/or bias-binding yarns are either similar or dissimilar.
15. Producing a 3D fabric wherein its constituent axial, binding yarns and/or bias-binding yarns exhibit either equal or unequal tensions.
16. Producing a 3D fabric wherein some of either its axial yarns or binding yarns or bias-binding yarns or some of these are arranged discontinuously, but integrated within the body of 3D fabric, for example when creating a hole, opening, recess, slot, groove/channel, hollow etc.
17. Producing a 3D fabric wherein some of either its axial yarns or binding yarns or bias-binding yarns or some of these are arranged continuously but in relatively different planes and lengths relative to lengths of some other yarns of the respective similar directions to create integrated projections, for example one or more legs projecting from a surface and such legs/projecting part/s being of either equal or unequal dimensions and of either similar or dissimilar shapes.
18. Producing a 3D fabric wherein either all of the axial yarns or binding yarns or bias-binding yarns are either twisted or untwisted or some are twisted and others are untwisted.
19. Producing a 3D fabric wherein the constituent yarns are either composed of either similar or dissimilar fibrous materials.
20. Producing a 3D fabric using materials whereby either similar or different thermal, electrical, sound, light, magnetic and mechanical properties are exhibited in different directions.
21. Producing a 3D fabric whereby either similar or different thermal, electrical, sound, light, magnetic and mechanical properties are exhibited either wholly or partly, for example at surface and core sections.
22. Producing a 3D fabric wherein either similar or different abrading/wearing out properties are exhibited in different areas/sections.
23. Producing a 3D fabric wherein either similar or different compressive, tensile, bending, twisting and shearing properties are exhibited in different directions.
24. Producing a 3D fabric wherein two of the edges of at least one of the surfaces are either parallel or non-parallel.
25. Producing a 3D fabric wherein additional axial yarns may be either included during production or existing yarns excluded/removed during production for changing the dimensions and shapes of the 3D fabric.
26. Producing a 3D fabric wherein the axial yarns are disposed to produce 3D fabrics of either circular or any other polygonal or non-circular solid cross-sectional shapes.
27. Producing a 3D fabric wherein the axial yarns (X) are disposed to produce polygonal/non-circular tubular items.
28. Producing a 3D fabric wherein the axial yarns are disposed to produce either regular or irregular or asymmetric shaped cross-sections.
29. Producing a 3D fabric wherein the axial yarns are disposed to produce either partly solid or partly hollow structures.
30. Producing a 3D fabric wherein the axial yarns are disposed to produce either planar or non-planar surface/s, such as a contoured surface.
31. Producing a 3D fabric wherein the axial yarns are disposed to produce either convex or concave shaped surface/s.
32. Producing a 3D fabric wherein either the axial yarns or binding yarns or bias-binding yarns are incorporated to produce either equal or unequal fabric densities/fibre volume-fractions in their respective directions.
33. Producing a 3D fabric wherein at least some of either the axial yarns or binding yarns or bias-binding yarns are composed of materials that can be either fused or dissolved suitably.
34. Producing a 3D fabric wherein at least some of either the axial yarns or binding yarns or bias-binding yarns or new additional non-fibrous objects are incorporated as carriers for discharging suitable chemical formulations to function as either a crack sealant or indicator of damage in composite material and injury mitigation material comprising such 3D fabric.
35. Producing a 3D fabric wherein at least some of either the axial yarns or binding yarns or bias-binding yarns or new additional non-fibrous objects are incorporated as carriers for suitable medical formulations to deliver either a healing agent or anti-bacterial/germicidal agent or bodily discharge/fluid neutralizing/absorbing agent or blood coagulating agent or time dependent agent or pressure dependent agent.

36. Producing a 3D fabric wherein the axial yarns are disposed to produce fabric end surfaces that are either similar or dissimilar in cross-sectional shape, such as square at one end and rectangular at the opposite end.
37. Producing a 3D fabric wherein some of either the axial yarns or binding yarns or bias-binding yarns are of either fusible or stretchable or malleable types to render the 3D fabric to be either be split-resistant or conforming to or retaining a certain shape or forming a shaped composite product.
38. Producing a 3D fabric wherein at least some of either the axial yarns or binding yarns or bias-binding yarns are arranged in a manner to accommodate either regular or irregular shaped inserts in the created opening/slot/recess etc.
39. Producing a 3D fabric wherein at least some of either the axial yarns or binding yarns or bias-binding yarns are selected and disposed to produce a filter for fluids (i.e. liquid and gas) that are either hot or cold and either electrically charged or neutral.
40. Producing a 3D fabric that is of branching type, such as forked, wherein the branches occur in either same or different planes, and such branches being either similar or dissimilar in their shapes and dimensions and similar or dissimilar in their relative orientations.
41. Producing a 3D fabric that has either varying thickness or width or both thickness and width.
42. Producing a 3D fabric that has either one or both its ends ending in either a tip/pointed form or curved/rounded form or linear/flat form.
43. Producing a 3D fabric that has at least one of its edges being either parallel to another or inclined at an angle to another and such edge being either of straight/linear or curved/non-linear form.
44. Producing a 3D fabric that has both its end surfaces in either parallel or non-parallel disposition or its side surfaces in either parallel or non-parallel disposition.
45. Producing a 3D fabric that has either all or some of its axial yarns occurring in a non-linear path about its longitudinal axis, such as helix-like, to create a twisted/screw thread/DNA-structure form.
46. Producing a 3D fabric that has either equal or unequal areas of end cross-sections.
47. Producing a 3D fabric that has at least some of its either axial yarns or binding yarns or bias-binding yarns in linear and non-linear arrangements.
48. Producing a 3D fabric that has at least one of its surfaces in either tapered form or stepped form relative to another surface.
49. Producing a 3D fabric with cross-sectional area that either varies or is partly constant and partly varying between the two end surfaces.
50. Producing a 3D fabric with either a partly-linear and partly-bending segment in either latitudinal or longitudinal planes/directions.

A person skilled in the art will understand now that the described noobing device is also unique in another way—there is no fabric take-up involved as the 3D fabric object is directly produced to the required customized dimensions "middle-outwards".

A person skilled in the art will further understand now that the described noobing method and device, which provides new opportunities to employ and exploit them for producing 3D fabrics, can be modified in different ways. Some of these can be: (a) incorporation of an arrangement that individually feeds specially designed hook stems (1*c*) to the walls (1*a* and 1*b*) in a manner that these hook stems while being fed to the walls (1*a* and 1*b*) engage with the presented yarns (1*f*) and create the set of zigzag axial yarns (X); (*b*) arranging the axial yarns in a manner whereby circular/cylindrical 3D fabrics are produced by laying one set of binding yarns in circumferential direction and the other set in radial direction; (*c*) arranging the walls to move mutually relatively in different planes, instead of keeping them either stationary or jointly moving them in same respective planes, to produce 3D fabrics that bend either longitudinally or latitudinally or in both these directions, for example, like a spring; (d) setting up the noobing device in either vertical or horizontal orientations for production of certain 3D fabrics; (e) inclusion of arrangement to either spray a liquid or apply chemical formulation at suitable moments to either the fabric as it is produced or to the fibres involved in producing the fabric; (f) inclusion of an arrangement to place/embed a foreign object, such as thermal/impact/vibration etc. sensors, medicinal capsules, electrical wires, optical fibres, signal emitters etc. in the 3D fabric during production.

It will be clear now to the person skilled in the art that the described noobing method and device are novel and their 3D fabric structures and products are also novel. The method, device and 3D fabric structure can be modified in numerous ways, some of which have been exemplified here, without deviating from the spirit of the indicated different inventions, and not limited by the Claims listed below.

REFERENCES

[1] Khokar, N. 3D Fabric-forming Processes: Distinguishing Between 2D-Weaving, 3D-Weaving and an Unspecified Non-interlacing Process, J. Text. Inst., 87, Part 1 (1996).
[2] Khokar, N. 3D-Weaving: Theory and Practice, J. Text. Inst., 92, Part 1, No. 2 (2001).
[3] Khokar, N. Noobing: A Nonwoven 3D Fabric-Forming Process Explained, J. Text. Inst., 93, Part 1, No. 1 (2002).

The invention claimed is:

1. A 3D fabric comprising:

at least one first yarn laid in essentially parallel turns or convolutions in a first direction and in a first plane, and in a plurality of superposed layers in parallel to said first plane, wherein adjacent turns or convolutions are either connected to each other, or cut apart at the ends;

second yarns laid in a second direction which is different from said first direction, whereby said second yarns at least partly extend between said superposed layers of said at least one first yarn, said second yarns being arranged obliquely or parallel to the first plane of the first yarn, each of said second yarns being a continuous string arranged in consecutive turns or convolutions to form a zigzag or sinuous formation; and third yarns laid in a third direction which is different from said first and second directions, whereby said third yarns at least partly extend between the turns or convolutions of said at least one first yarn and in between the turns or convolutions of said zigzag or sinuous formation of the second yarns, said third yarns thereby being arranged obliquely or essentially orthogonal to the first plane of said at least one first yarn, each of said third yarns being a continuous string arranged in consecutive turns or convolutions to form a zigzag or sinuous formation;

wherein a majority of the turns or convolutions of the third yarns are laid so that at least two turns or convolutions of said at least one first yarn in each layer are provided between each pair of adjacent turns or convolutions of any two individual adjacent third yarns.

2. The 3D fabric of claim 1, wherein said second yarns are laid between said superposed layers of said at least one first yarn, thereby being arranged parallel to the first plane of said at least one first yarn.

3. The 3D fabric of claim 1, wherein said third yarns are laid between the turns or convolutions of said zigzag or sinuous formations of the superposed layers of said at least one first yarn, and thereby being essentially orthogonal to the first plane of said at least one first yarn.

4. The 3D fabric of claim 1, wherein at least one of the second and third yarns extend obliquely in relation to the first plane.

5. The 3D fabric of claim 1, wherein said at least one first yarn is laid as a continuous string in consecutive turns or convolutions to form a zigzag or sinuous formation in a first plane, and in a plurality of superposed layers in parallel to said first plane.

6. The 3D fabric of claim 1, further comprising additional second yarn laid below or on top of the superposed layers of said at least one first yarn, whereby said additional second yarn is enclosed by the third yarns.

7. The 3D fabric of claim 1, further comprising additional third yarn laid beside the columns formed by the second yarn, whereby said additional third yarn is enclosed by the second yarns.

8. The 3D fabric of claim 1, wherein all surfaces of the fabric are closed surfaces.

9. The 3D fabric of claim 1, further comprising additional binding yarns in the fabric, said additional binding yarns being laid in at least one direction which is non-parallel to each of said at least one first yarn, second yarn and third yarn, thereby providing a multiaxial 3D fabric.

10. The 3D fabric of claim 1, wherein said at least one first yarn is of a first material, and wherein at least one of the second and third yarns are of a second material, said second material being different from said first material.

11. A composite material comprising a 3D fabric according to claim 1.

12. An injury mitigation protective material comprising a 3D fabric according to claim 1.

13. The 3D fabric of claim 1, wherein the third yarns are arranged in paths passing through the planes of the first yarn.

14. The 3D fabric of claim 1, wherein the third yarns are arranged so that they do not cross each other.

15. The 3D fabric of claim 1, wherein at least some of the third yarns are arranged so that they cross each other.

* * * * *